US011535972B2

(12) United States Patent
Jung et al.

(10) Patent No.: US 11,535,972 B2
(45) Date of Patent: Dec. 27, 2022

(54) LAUNDRY TREATING APPARATUS

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/142,903

(22) Filed: Jan. 6, 2021

(65) Prior Publication Data

US 2021/0222341 A1 Jul. 22, 2021

(30) Foreign Application Priority Data

Jan. 20, 2020 (KR) ..... 10-2020-0007594

(51) Int. Cl.
*D06F 39/02* (2006.01)
*D06F 23/02* (2006.01)
*D06F 39/14* (2006.01)

(52) U.S. Cl.
CPC ..... *D06F 39/02* (2013.01); *D06F 23/02* (2013.01); *D06F 39/14* (2013.01); *D06F 39/028* (2013.01)

(58) Field of Classification Search
CPC ..... D06F 39/02; D06F 39/028; D06F 39/14; D06F 23/02
USPC ..... 68/12.18
See application file for complete search history.

(56) References Cited

U.S. PATENT DOCUMENTS

2006/0162392 A1* 7/2006 Kwon ..... D06F 39/02 68/3 R
2017/0233934 A1* 8/2017 Lee ..... D06F 39/022 68/200

FOREIGN PATENT DOCUMENTS

| | | |
|---|---|---|
| CN | 101153452 | 4/2008 |
| CN | 103835098 | 6/2014 |
| CN | 106460295 | 2/2017 |
| EP | 1903136 | 3/2008 |
| EP | 2868797 | 5/2015 |
| EP | 3431648 | 1/2019 |
| KR | 19990065043 | 8/1999 |
| KR | 1020070001601 | 1/2007 |
| KR | 1020180090003 | 8/2018 |

(Continued)

OTHER PUBLICATIONS

EP Extended European Search Report in European Appln. No. 21151504.4, dated Jun. 22, 2021, 6 pages.

(Continued)

*Primary Examiner* — Tinsae B Ayalew
(74) *Attorney, Agent, or Firm* — Fish & Richardson P.C.

(57) ABSTRACT

Disclosed is a laundry treating apparatus including a cabinet, a tub, a drum, and a detergent storage unit, wherein the detergent storage unit includes a detergent storage unit frame having an open top face and retracted into and extended from the cabinet through a opening, an locking bar disposed on the detergent storage unit frame and restricting an extension distance of the detergent storage unit extending from the cabinet, and a detergent cup accommodated in the detergent storage unit frame through the open top face of the detergent storage unit frame, wherein the detergent cup stores the detergent therein and includes a separation preventing protrusion protruding from a side wall, wherein upward deviation of the detergent cup from the detergent storage unit frame is restricted as the separation preventing protrusion is located below the locking bar.

20 Claims, 48 Drawing Sheets

(56) References Cited

FOREIGN PATENT DOCUMENTS

WO WO2018108091 6/2018

OTHER PUBLICATIONS

Notice of Allowance in Chinese Appln. No. 202110073986.s, dated Oct. 21, 2022, 8 pages (with English translation).

* cited by examiner

LAUNDRY TREATING APPARATUS

CROSS-REFERENCE TO RELATED APPLICATION

This application claims the benefit of Korean Patent Application No. 10-2020-0007594, filed on Jan. 20, 2020, which is hereby incorporated by reference as if fully set forth herein.

TECHNICAL FIELD

The present disclosure relates to a laundry treating apparatus, more particularly to, a laundry treating apparatus having a detergent supply.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent supply that feeds detergent into the drum.

When the drum is rotated by a motor while wash water is supplied to the laundry accommodated in the drum, dirt on the laundry may be removed by friction with the drum and the wash water.

The detergent supply has a detergent feeding function to improve a washing effect. Herein, the detergent means a substance, such as fabric detergent, fabric softener, fabric bleach, and the like, that enhances the washing effect. Detergent in a powder form and detergent in a liquid form may be used as the detergent.

In one example, published document KR 10-2018-0090003 A1 discloses the detergent supply included in the laundry treating apparatus. The laundry treating apparatus may be used as detergent storage of the detergent supply is retracted or extended by a user.

In one example, the detergent storage may include a detergent storage frame and a plurality of components arranged on the detergent storage frame, and at least some of the plurality of components may be manufactured separately from the detergent storage frame and arranged on the detergent storage frame.

However, as above, the component in the detergent storage that is manufactured separately from the detergent storage frame and placed on the detergent storage frame may be placed on the detergent storage frame without separate fastening means such that the user may easily couple and separate the component. In this case, unintended separation of the component may occur during handling of the detergent storage.

Therefore, it is an important task to prevent occurrence of inconvenience in use and handling of the detergent storage resulted from unintended separation of the components of the detergent storage including the components that are manufactured separately from the detergent storage frame and placed on the detergent storage frame.

SUMMARY

Embodiments of the present disclosure aim to provide a laundry treating apparatus that may facilitate separation of components by a user and effectively prevent unintended separation of components in handling of a detergent storage.

Further, embodiments of the present disclosure aim to provide a laundry treating apparatus that may effectively improve ease of use by implementing an efficient extension distance with respect to a detergent storage.

Further, embodiments of the present disclosure aim to provide a laundry treating apparatus that improves structural stability and in which efficient arrangement of components are made.

A detergent cup may be seated in a detergent storage. The detergent cup may be placed on a detergent storage frame of the detergent storage, and may be easily separated from the detergent storage frame depending on handling of the detergent storage in a manufacturing process and the like of a detergent supply or a laundry treating apparatus.

An embodiment of the present disclosure has a deviation preventing protrusion on the detergent cup and an engaging bar that prevents deviation of the preventing protrusion disposed on the detergent storage frame, thereby effectively preventing the detergent cup from being unintentionally separated from the detergent storage frame.

Further, the deviation preventing protrusion protrudes rearward from the detergent cup. Accordingly, a user may lift a front end of the detergent cup to move the deviation preventing protrusion forward and separate the detergent cup from the detergent storage frame, thereby securing ease of use.

The engaging bar may include an engaging protrusion, and a dispenser disposed inside a housing and above the detergent storage may include a stopper. As the stopper is disposed to overlap the engaging protrusion in a front and rear direction, an extension distance of the detergent storage may be restricted by a spacing distance between the stopper and the engaging protrusion.

In an embodiment of the present disclosure, as the spacing distance between the stopper and the engaging protrusion is appropriately set, a set extension distance at which the detergent cup or the like is exposed to the outside of the housing and is easily used by a user in a state in which at least a portion of the detergent storage is exposed to the outside of the housing may be implemented.

Particular implementations of the present disclosure provide a laundry treating apparatus that includes a cabinet defining an opening at a front side of the cabinet, a tub disposed in the cabinet, a drum configured to rotate in the tub, and a detergent storage configured to receive a detergent. The detergent storage is configured to be inserted into and drawn out from the cabinet through the opening. The detergent storage may include a detergent storage frame, a locking bar, and a detergent cup. The detergent storage frame has an open top and is configured to be inserted into and drawn out from the cabinet through the opening. The locking bar is disposed at the detergent storage frame and configured to restrict a distance that the detergent storage is drawn out from the cabinet. The detergent cup is configured to be received in the detergent storage frame through the open top of the detergent storage frame and configured to receive the detergent. The detergent cup includes a separation preventing protrusion that protrudes from a side wall of the detergent cup. At least a portion of the locking bar is located above the separation preventing protrusion and configured to restrict an upward movement of the separation prevention protrusion to thereby restrict movement of the detergent cup relative to the detergent storage frame.

In some implementations, the apparatus can optionally include one or more of the following features. The detergent storage frame has a detergent containing wall protruding upward from a bottom face of the detergent storage frame and defines a detergent containing region surrounded by the detergent containing wall. The detergent cup is located at the detergent containing region. The locking bar is disposed at the detergent containing wall. A first portion of the detergent cup has a larger width than a second portion of the detergent cup. The first portion of the detergent cup has a wide width portion that extends laterally beyond the second portion of the detergent cup. The separation preventing protrusion protrudes from a wall of the wide width portion in a first direction away from the front side of the cabinet. A top face of the separation preventing protrusion is inclined downward in a direction away from the wall of the wide width portion. The laundry treating apparatus may include a fixing portion disposed in the cabinet and located above the detergent storage. The fixing portion includes a stopper that protrudes toward the detergent storage. The locking bar includes a locking protrusion that protrudes toward the fixing portion. At least a portion of the stopper of the fixing portion is spaced apart from the locking protrusion of the locking bar. The locking protrusion of the locking bar is configured to, based on the detergent storage being drawn out from the cabinet, contact the stopper and restrict the distance of the detergent storage being drawn out from the cabinet. The detergent containing wall includes a detergent containing rear wall located at a rear of the detergent cup relative to the front side of the cabinet. The locking bar extends from the detergent containing rear wall toward the wide width portion. The locking bar includes a free end that is positioned above the separation preventing protrusion and is downwardly movable. Based on the locking protrusion contacting the stopper, the free end of the locking bar, the detergent container, and the detergent cup are at least partially exposed outward of the cabinet through the opening. The fixing portion include a guide protrusion that extends from the stopper in the first direction and is configured to guide the free end of the locking bar to be positioned below the stopper. The locking protrusion defines a penetration groove that faces toward the guide protrusion of the fixing portion. The locking protrusion is configured to contact the stopper based on (i) the detergent storage being drawn out from the cabinet and (ii) the guide protrusion being inserted into the penetration groove and moving toward the front side of the cabinet. The detergent containing wall includes detergent containing side walls that is located on opposing sides of the detergent cup, and a detergent containing front wall that is spaced apart from a front face of the detergent cup toward the front side of the cabinet and that is connected to the detergent containing side walls. The laundry treating apparatus includes a detergent container that is disposed between the detergent containing front wall and the detergent cup at the detergent containing region. The detergent is configured to be injected into the detergent container through an open top of the detergent container. The detergent storage frame includes a blocking portion that is disposed between the detergent cup and the detergent container and that is configured to block a movement of the detergent cup toward the front side of the cabinet. A detergent outlet is configured to discharge the detergent and is disposed at a detergent containing bottom face surrounded by the detergent containing wall at the detergent containing region. The detergent outlet is located below the detergent cup. The detergent cup has a cup discharge portion configured to discharge the detergent at a bottom of the detergent cup. The blocking portion is spaced upwardly apart from the detergent containing bottom face to thereby provide fluid communication between the detergent container and the detergent outlet. The detergent cup has an open top face configured to introduce the detergent into the detergent cup. The detergent containing wall includes a detergent containing rear wall that is located at a rear of the detergent cup relative to the front side of the cabinet and that is connected to the detergent containing side walls. The detergent containing rear wall includes a rear spacer protrusion that protrudes from the detergent containing rear wall toward the detergent cup and spaces the detergent containing rear wall from the detergent cup. The detergent cup includes a spacer rib protruding from a face of the detergent cup that faces toward the detergent containing rear wall. The spacer rib faces the rear spacer protrusion and contacting the rear spacer protrusion. The detergent cup includes a detergent cup leg that protrudes from a bottom face of the detergent cup toward the detergent containing bottom face and spaces the bottom face of the detergent cup apart from the detergent containing bottom face. The detergent cup leg includes a leg reinforcing rib that protrudes from the detergent cup leg and that is connected to the bottom face of the detergent cup. The first portion of the detergent cup is positioned closer to the front side of the cabinet than the second portion of the detergent cup is. The detergent containing wall includes detergent containing side walls that is located on opposing sides of the detergent cup, and a detergent containing front wall that is spaced apart from a front face of the detergent cup toward the front side of the cabinet and that is connected to the detergent containing side walls. The laundry treating apparatus includes a detergent container that is disposed between the detergent containing front wall and the detergent cup at the detergent containing region. The detergent is configured to be injected into the detergent container through an open top of the detergent container. The detergent containing front wall is positioned closer to the front side of the cabinet than the detergent containing rear wall is. The blocking portion extends along a direction transverse an axis of rotation of the drum. The detergent containing front wall is positioned closer to the front side of the cabinet than the detergent containing rear wall is.

In an aspect of the present disclosure, a laundry treating apparatus includes a housing having a front opening defined therein, a tub disposed inside the housing, a drum rotatably disposed inside the tub, and a detergent storage retractable into the housing through the front opening, wherein detergent is stored in the detergent storage.

The detergent storage includes a detergent storage frame having an open top face and retracted into and extended from the housing through the front opening, a detergent cup accommodated in the detergent storage frame through the open top face of the detergent storage frame, wherein the detergent cup stores the detergent therein and includes a deviation preventing protrusion protruding in a direction parallel to the top face of the detergent storage frame, and an engaging bar disposed on the detergent storage frame and positioned above the deviation preventing protrusion to restrict upward deviation of the deviation preventing protrusion and the detergent cup.

Accordingly, in an embodiment of the present disclosure, the deviation preventing protrusion is restricted from moving upward by the engaging bar, so that the detergent cup may be effectively prevented from separating and deviating from the detergent storage frame upward.

In one implementation, the detergent storage frame has a detergent containing wall protruding upward from a bottom face of the detergent storage frame, a detergent containing region surrounded by the detergent containing wall is defined in the detergent storage frame, and the detergent cup is located in the detergent containing region, and the engaging bar is disposed on the detergent containing wall.

In one implementation, the detergent cup is formed such that a front end thereof has a larger width than a rear end thereof, so that a wide width portion protruding in a direction transverse to a front and rear direction of the detergent storage than the rear end is formed, and the deviation preventing protrusion protrudes rearward from a rear wall of the wide width portion.

Accordingly, in an embodiment of the present disclosure, the user may lift a front end of the detergent cup to move the deviation preventing protrusion forward and separate the detergent cup from the detergent storage frame efficiently. In one implementation, a top face of the deviation preventing protrusion is inclined downward in a direction away from the rear wall of the wide width portion.

In one implementation, the laundry treating apparatus further includes a fixing portion disposed inside the housing and located above the detergent storage, a stopper protruding rearward from the fixing portion, and an engaging protrusion protruding upward from a top face of the engaging bar.

The stopper may be disposed to overlap the engaging protrusion along a front and rear direction of the detergent storage, and be spaced forwardly apart from the engaging protrusion in a state in which the detergent storage is retracted into the housing. In a process of extending from the housing, the engaging protrusion of the engaging bar may be in contact with the stopper, so that an extension distance of the detergent storage may be restricted.

Accordingly, even when the user does not completely separate the detergent storage from the housing, the ease of use may be improved as the detergent storage may be used by extending the detergent storage from the housing by an extension distance restricted in design by the stopper and engaging protrusion.

In one implementation, the detergent containing wall includes a detergent containing rear wall located at the rear of the detergent cup, the engaging bar extends from the detergent containing rear wall toward the wide width portion, and a front end of the engaging bar positioned above the deviation preventing protrusion forms a free end and is downwardly movable.

In one implementation, while the engaging protrusion is in contact with the stopper, the front end of the engaging bar, the detergent container, and the detergent cup are exposed outward of the housing through the front opening.

In one implementation, the fixing portion further includes a guide protrusion having a smaller width than the stopper and extending rearward from a rear face of the stopper to guide the front end of the engaging bar to be positioned below the stopper, a groove recessed downward and opened in the front and rear direction is defined at a center of the engaging protrusion, and, while the detergent storage is extending, the engaging protrusion comes into contact with the stopper as the guide protrusion is inserted into the groove and moves forward.

In one implementation, the detergent containing wall includes detergent containing side walls located on both sides of the detergent cup, and a detergent containing front wall disposed spaced forwardly apart from a front face of the detergent cup and connected to the detergent containing side walls, and the laundry treating apparatus further includes a detergent container disposed between the detergent containing front wall and the detergent cup in the detergent containing region, and having an open top face, so that the detergent is flowed into and is contained in the detergent container.

In one implementation, the detergent storage frame further includes a front blocking portion disposed between the detergent cup and the detergent container and extending along a direction transverse to a front and rear direction of the detergent storage to block a forward movement of the detergent cup.

In one implementation, a detergent outlet for discharging the detergent therethrough is disposed on a detergent containing bottom face surrounded by the detergent containing wall in the detergent containing region, the detergent outlet is located below the detergent cup, the detergent cup has a cup discharge portion for discharging the detergent therethrough at a bottom thereof, and the front blocking portion is spaced upwardly apart from the detergent containing bottom face, so that the detergent container and the detergent outlet are in communication with each other.

In one implementation, a top face of the detergent cup is opened, so that the detergent is introduced into and contained in the detergent cup, the detergent containing wall further includes a detergent containing rear wall located at the rear of the detergent cup and connected to the detergent containing side walls, and the detergent containing rear wall includes a rear spacer protrusion protruding from the detergent containing rear wall toward the detergent cup to space the detergent containing rear wall and the detergent cup apart from each other.

In one implementation, detergent cup further includes a rear spacer rib protruding from a rear face thereof facing toward the detergent containing rear wall to face the rear spacer protrusion and in contact with the rear spacer protrusion.

In one implementation, the detergent cup further includes a detergent cup leg protruding from a bottom face of the detergent cup toward the detergent containing bottom face to space the bottom face of the detergent cup apart from the detergent containing bottom face.

In one implementation, the detergent cup leg further includes a leg reinforcing rib protruding from the detergent cup leg and connected to the bottom face of the detergent cup.

Accordingly, in an embodiment of the present disclosure, structural stability is efficiently improved and rigidity is increased in the detergent cup, so that durability of the detergent cup may be improved.

Embodiments of the present disclosure may provide the laundry treating apparatus that may facilitate the separation of the components by the user and effectively prevent the unintended separation of the components in the handling of the detergent storage.

Further, embodiments of the present disclosure may provide the laundry treating apparatus that may effectively improve the ease of use by implementing the efficient extension distance with respect to the detergent storage.

Further, embodiments of the present disclosure may provide the laundry treating apparatus that improves the structural stability and in which the efficient arrangement of the components are made.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DETAILED DESCRIPTION

Figure 1:
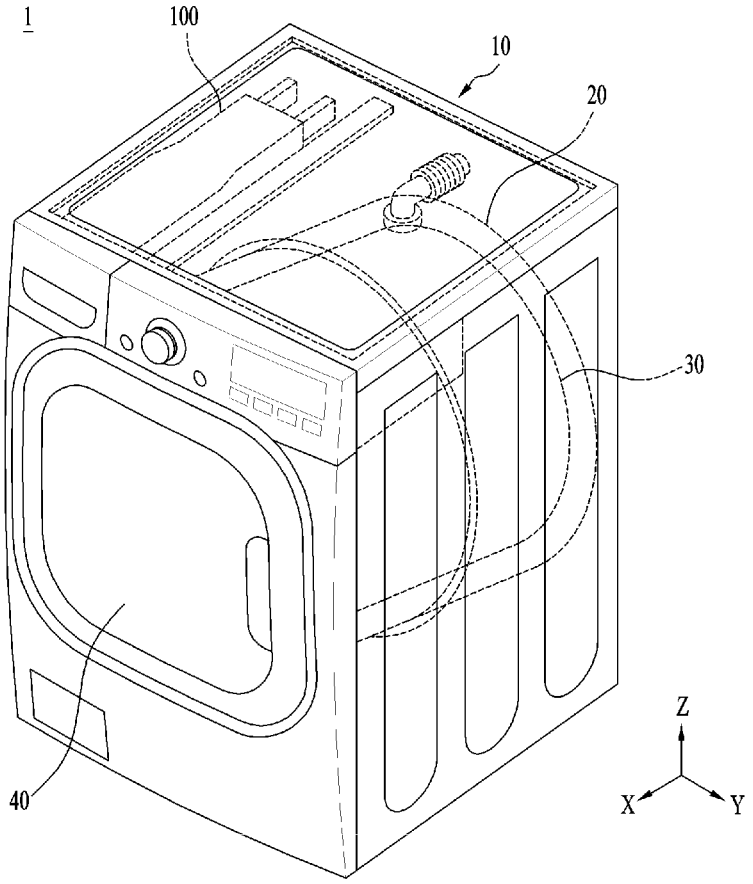
FIG. 1 is a perspective view illustrating a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
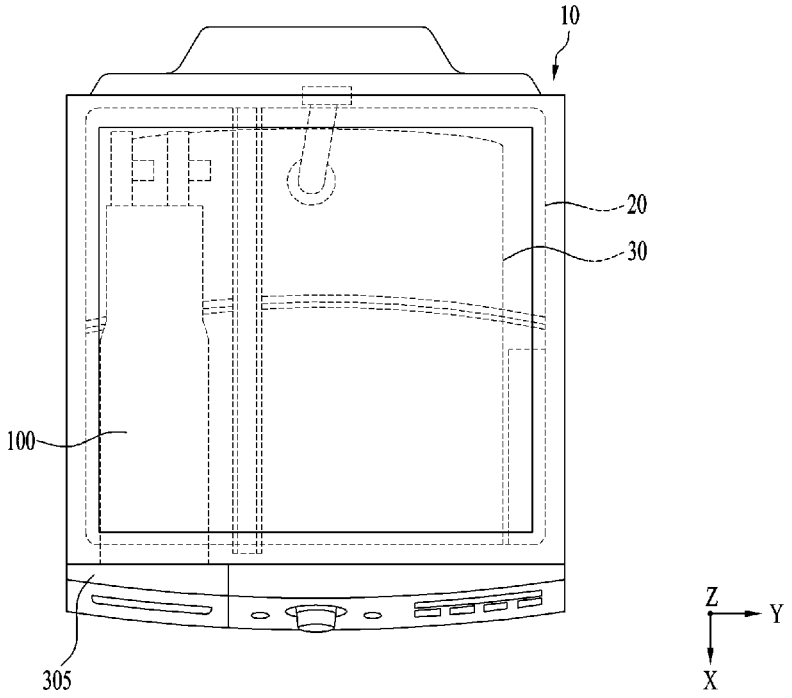
FIG. 2 is a top view of a laundry treating apparatus according to an embodiment of the present disclosure.
Figure 3:
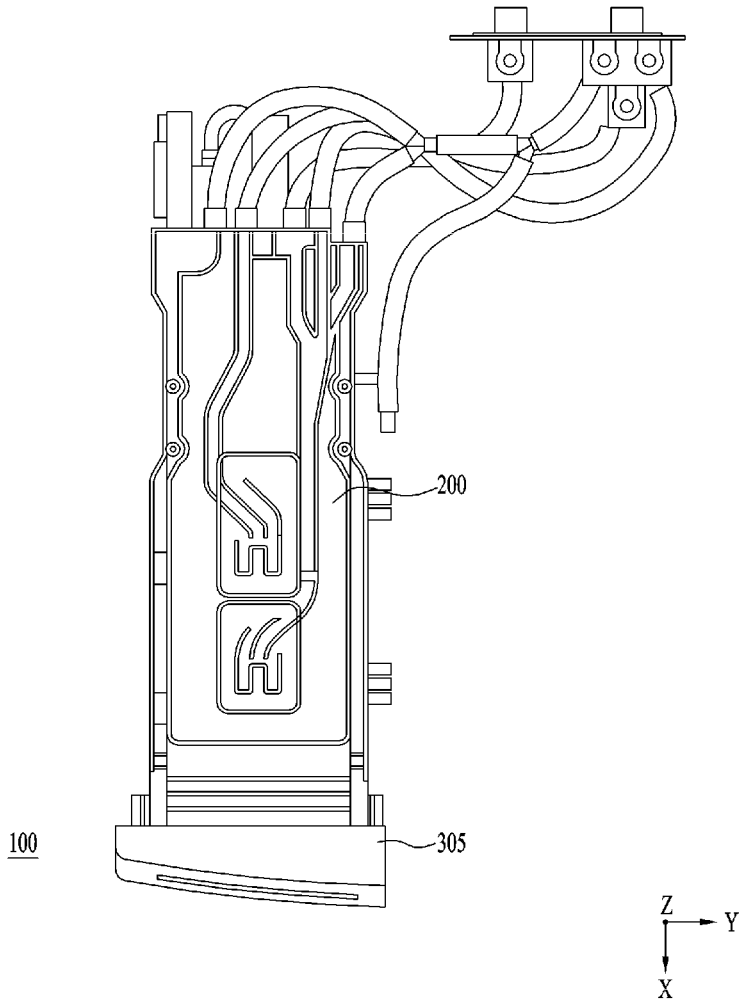
FIG. 3 is a view of a detergent supply of a laundry treating apparatus according to an embodiment of the present disclosure.

FIG. 1 is a perspective view illustrating a laundry treating apparatus 1 according to an embodiment of the present disclosure, FIG. 2 is a view of the laundry treating apparatus 1 viewed from above, and FIG. 3 is a top view of a detergent supply 100 of the laundry treating apparatus 1 according to an embodiment of the present disclosure.

Referring to FIGS. 1 to 3, the laundry treating apparatus 1 according to an embodiment of the present disclosure includes a cabinet 10 having an opening 15 defined in a front face thereof, a tub 20 installed inside the cabinet 10, a drum 30 rotatably installed inside the tub 20, and a detergent supply 100 installed in the opening 15.

The laundry treating apparatus 1 may include a washing machine in which a cloth is inserted into a washing tank to be washed, rinsed, dehydrated, and the like, a dryer in which a wet cloth is inserted to be dried, or the like.

The laundry treating apparatuses 1 may be classified into a top loading type laundry treating apparatus and a front loading type laundry treating apparatus. FIG. 1 illustrates the front loading type laundry treating apparatus 1, but this is only for convenience of description. Because the present disclosure is not applied only to front loading type washing machines, the present disclosure may be applicable to top loading type washing machines.

As shown in FIG. 1, the laundry treating apparatus 1 may have the cabinet 10 forming an appearance of the laundry treating apparatus 1. A manipulation unit having a display that receives various control commands from a user and displays information on an operating state may be included.

In addition, the cabinet 10 may include a door 40 installed on a front face thereof. The door 40 may be pivotably disposed on the cabinet 10 to regulate entry of the laundry into the drum 30.

The cabinet 10 forms the appearance of the laundry treating apparatus 1. A space in which various components constituting the laundry treating apparatus 1 may be accommodated may be defined inside the cabinet 10. The drum 30 for accommodating therein the laundry inserted through the door 40 may be installed inside the cabinet 10.

Specifically, the tub 20 containing wash water therein and the drum 30 that is rotatably disposed inside the tub 20 to accommodate the laundry therein may be arranged inside the cabinet 10. A balancer for compensating for eccentricity caused by the rotation may be installed on one side of the drum 30.

The manipulation unit may include various keys for manipulating the operating state of the laundry treating apparatus 1 and the display for displaying the operating state of the laundry treating apparatus 1. The door 40 may contain a transparent member such as tempered glass and the like such that an interior of the cabinet 10 or the drum 30 may be visually identified.

In one example, in an embodiment of the present disclosure, the laundry treating apparatus 1 may have the opening 15 defined in a front face thereof, and the detergent supply 100 may be disposed at a rear portion of the detergent opening 15 inside the cabinet 10.

A position and a shape of the opening 15 may be various. FIG. 1 illustrates the opening 15 forwardly opened from a front face of the cabinet 10. The opening 15 may be defined in an edge region of the front face of the cabinet 10, for example, at one side of an upper end of the front face to be parallel with a manipulation unit in a left and right direction.

The detergent supply 100 may be installed at the rear portion of the opening 15 inside the opening 15 that may be defined at one side of an upper portion of the cabinet 10. The detergent supply 100 may include detergent storage 300 that may store detergent therein, a dispenser 200 located on the detergent storage 300 to supply water into the detergent storage 300, and a detergent supply casing 400 in which the detergent storage 300 retracted into the cabinet 10 is accommodated. FIG. 3 is the top view of the detergent supply 100.

The detergent supply 100 serves to automatically feed the detergent stored in the detergent storage 300 to an interior of the drum 30 during the washing operation. The detergent refers to a substance that may improve a washing effect of the laundry, which may include liquid fabric detergent and liquid fabric softener.

Figure 4:
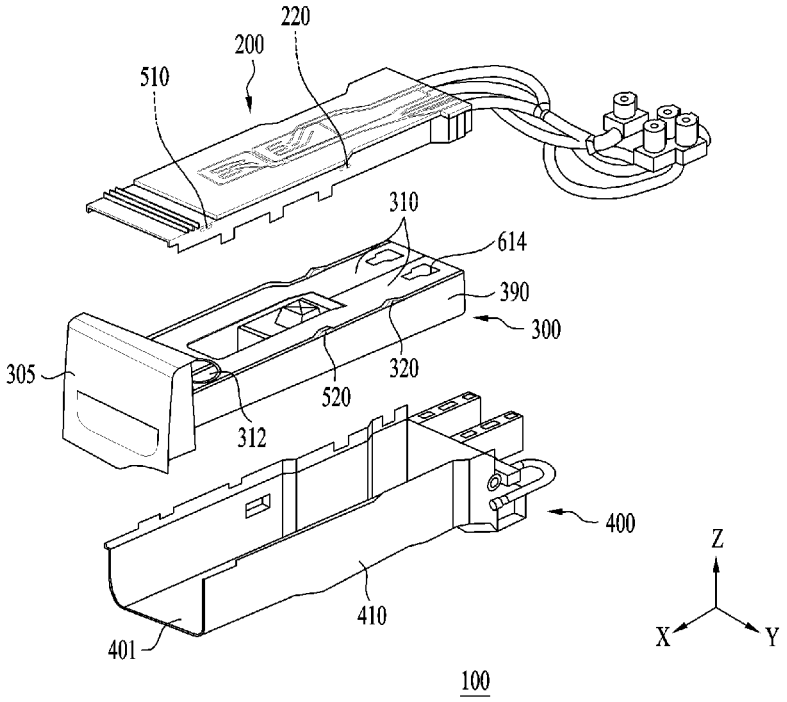
FIG. 4 is an exploded view of a detergent supply in a laundry treating apparatus according to an embodiment of the present disclosure.

FIG. 4 illustrates a state in which the detergent supply 100 is disassembled. The detergent supply 100 may include a dispenser 200, the detergent storage 300, and a detergent supply casing 400 from above as shown in FIG. 4.

The dispenser 200 may receive the water from the outside, and may supply the supplied water back into the detergent storage 300 or the detergent supply casing 400. The detergent used in the washing process and the like is stored inside the detergent storage 300. The detergent storage 300 is accommodated and seated in the detergent supply casing 400. The detergent supply casing 400 may receive at least a portion of the water discharged from the dispenser 200 or the detergent stored in the detergent storage 300 and supply the received water of detergent to the tub 20 or the like.

The detergent storage 300 may store the detergent therein, and may be retracted into the cabinet 10 or extend from the interior of the cabinet 10 through the opening 15 along a front and rear direction. The detergent storage 300 may include a front handle 305, a detergent storage frame 390, and a detergent reservoir 310 and a detergent cup 700 seated in the detergent storage frame 390.

In the present disclosure, the front and the rear may be defined based on a position of the opening 15 in the cabinet 10. For example, a direction from an interior of the cabinet 10 toward the opening 15 may correspond to a forward direction and an opposite direction thereof may be defined as a rearward direction.

In other words, a direction from the interior of the cabinet 10 toward an exterior of the cabinet 10 through the opening 15 may be defined as the forward direction, and a direction from the opening 15 toward the interior of the cabinet 10 may be defined as the rearward direction.

That is, in the present disclosure, even when the door 40 and the opening 15 are arranged on different faces of the cabinet 10, the front and the rear may be defined around the opening 15.

FIG. 4 is a view of the opening 15 of the cabinet 10 viewed from the outside when the detergent storage 300 is fully extended. The dispenser 200 and the detergent supply casing 400 may be installed inside the cabinet 10 through the opening 15, and the detergent storage 300 may be retracted into or extended from the cabinet 10 through the opening 15.

Figure 5:
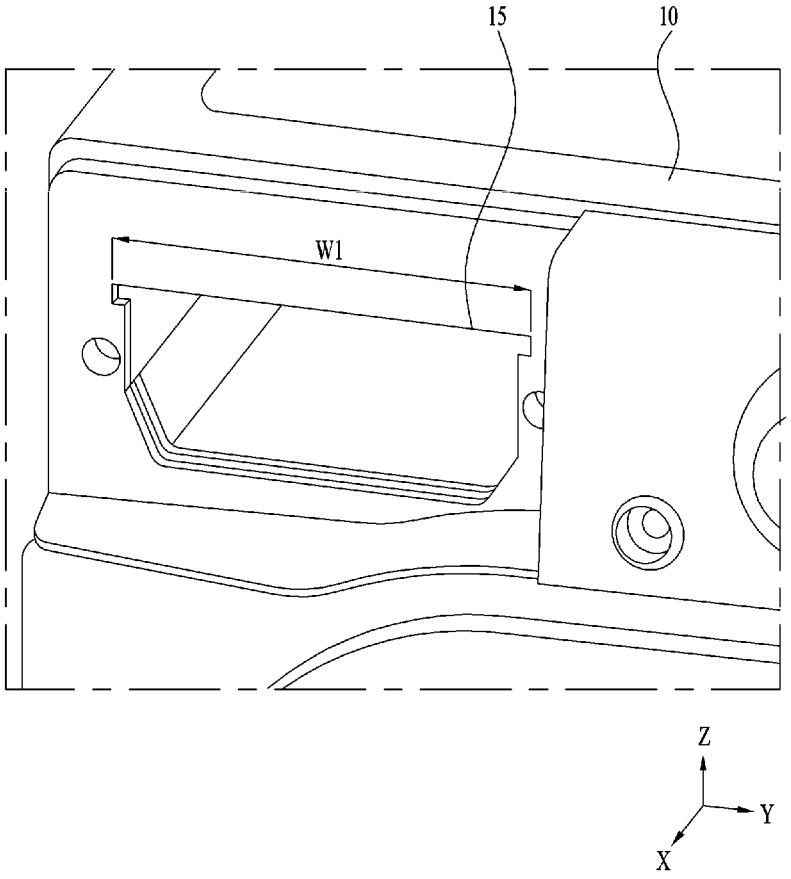
FIG. 5 is a view illustrating an opening defined in a housing in a laundry treating apparatus according to an embodiment of the present disclosure.

FIG. 5 illustrates a view of the detergent storage 300 extended from the opening 15 viewed from the outside of the cabinet 10. The detergent storage 300 in FIG. 5 may be in a state of being extended by a set extension distance preset by design as will be described later.

As shown in FIGS. 1 and 2, in the state in which the detergent storage 300 is retracted into the cabinet 10 through the opening 15, when the user grips and pulls the handle 305 that is disposed on the front face of the detergent storage 300 and exposed to the outside of the cabinet 10, the detergent storage 300 in the state of being retracted into the opening 15 may be moved forward from a state of being stacked with the dispenser 200 and the detergent supply casing 400 to be extended to be exposed to the outside of the cabinet 10. Similarly, when the user pushes the handle 305 rearward, the detergent storage 300 may be slid and inserted into the opening 15.

Figure 7:
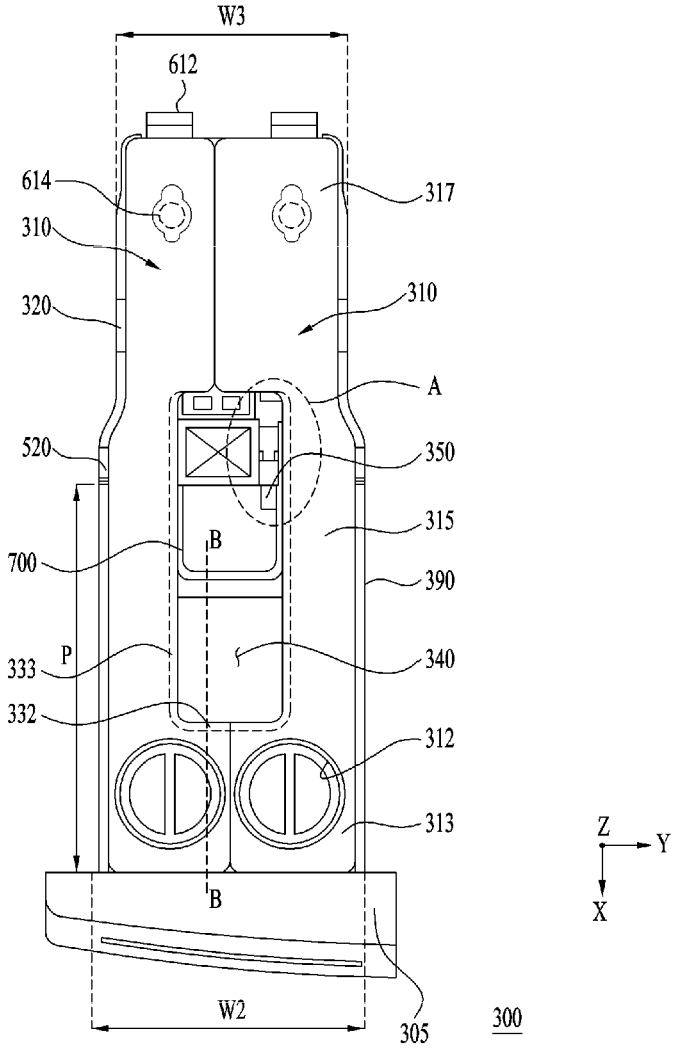
FIG. 7 is a top view of detergent storage in a laundry treating apparatus according to an embodiment of the present disclosure.
Figure 8:
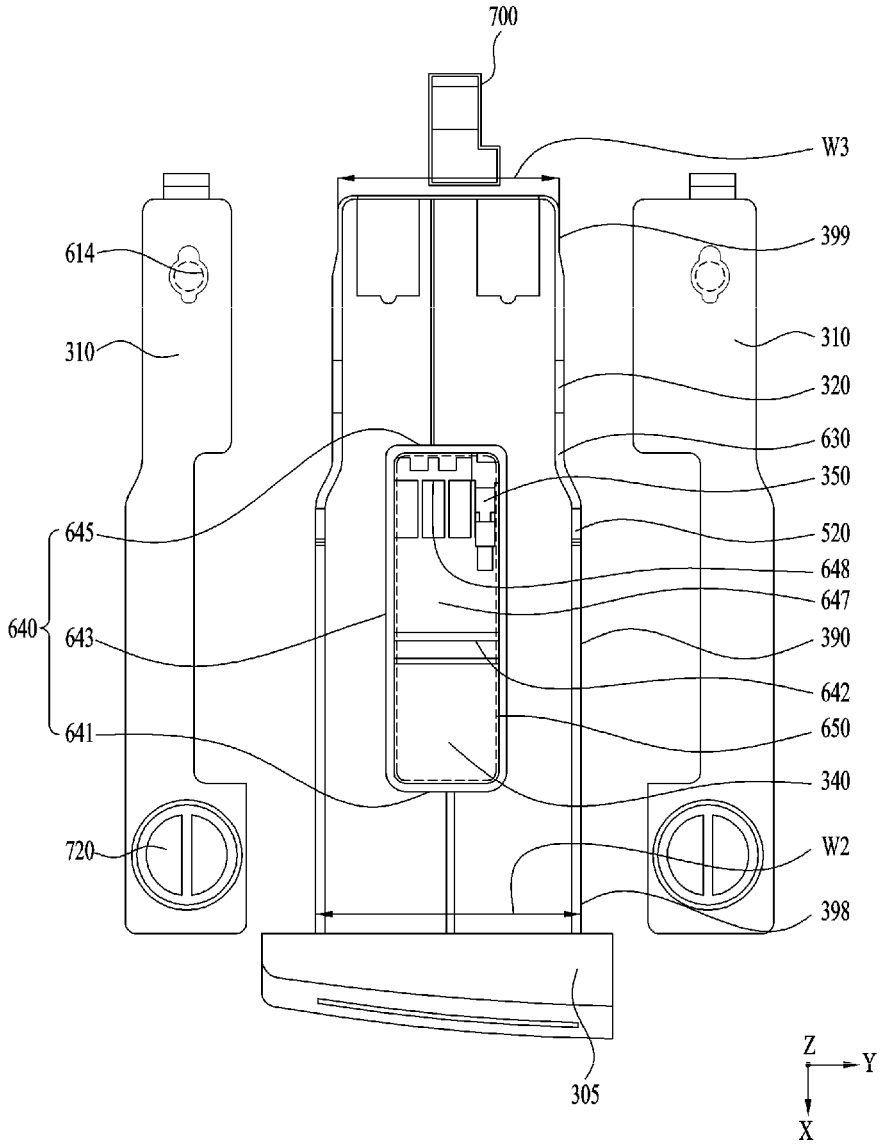
FIG. 8 is a view illustrating an exploded view of detergent storage in a laundry treating apparatus according to an embodiment of the present disclosure.

In one example, FIG. 7 illustrates the detergent storage 300 viewed from above, and FIG. 8 illustrates an exploded view of the detergent storage 300 in FIG. 7.

Referring to FIGS. 7 and 8, in an embodiment of the present disclosure, the detergent storage 300 may include the detergent storage frame 390, the detergent reservoir 310, a detergent container 340, and the detergent cup 700.

The detergent storage frame 390 may be retracted into and extended from the cabinet 10 through the opening 15 in the state in which the detergent reservoir 310, the detergent cup 700, or the like is installed therein. The detergent storage frame 390 may have a length along a front and rear direction, and a top face thereof may be opened as shown in FIG. 8 such that the user may easily install the detergent reservoir 310, the detergent cup 700, and the like therein.

The detergent storage frame 390 may be retracted into or extended from the cabinet 10 through the opening 15 in various moving schemes. For example, as will be described later, a sliding rail 404 along which the detergent storage frame 390 slides may be disposed on the detergent supply casing 400, and the detergent storage frame 390 may be supported on the sliding rail 404 and be retracted and extended while being slid by the user.

In addition, the handle 305 may be disposed on the front face of the detergent storage frame 390. The handle 305 may be disposed such that a cross-section thereof viewed from the front is larger than the detergent storage frame 390 to shield the opening 15 and not expose the opening 15 to the outside.

The detergent reservoir 310 may have a detergent storage space defined therein in which the detergent is stored. The detergent reservoir 310 may be installed to be detachable from the detergent storage frame 390, and the user may detach the detergent reservoir 310 to wash or replace the detergent reservoir 310 as necessary.

The detergent reservoir 310 may be installed on the detergent storage frame 390 through the open top face of the detergent storage frame 390, and may include a plurality of detergent reservoirs as necessary. FIGS. 7 and 8 illustrate a state in which two detergent reservoirs 310 are arranged and installed on the detergent storage frame 390 according to an embodiment of the present disclosure.

In one example, the detergent storage frame 390 includes the detergent container 340 in which the detergent is contained. The detergent container 340 may be disposed as a portion of the detergent storage frame 390. For example, as shown in FIG. 8, the detergent container 340 may have a space defined therein in which the detergent is contained by a detergent containing wall 640 protruding from a bottom face of the detergent storage frame 390.

The detergent container 340 contains the detergent separately from the detergent reservoir 310. In the present disclosure, for convenience of description, the detergent stored in the detergent reservoir 310 is classified as first detergent, the detergent stored in the detergent container 340 is classified as second detergent, and the detergent contained in the detergent cup 700, which will be described later, is classified as third detergent.

The first detergent, the second detergent, and the third detergent are only classified based on objects into which they are stored, and their characteristics may not necessarily be different. However, the present disclosure has a plurality of regions into which the detergents may be stored, thereby allowing the user to use various detergents.

Figure 6:
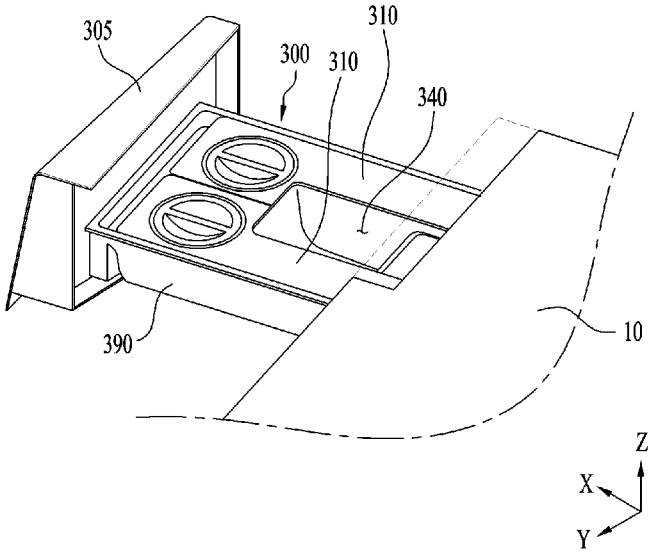
FIG. 6 is a view illustrating a state in which detergent storage is extended in a laundry treating apparatus according to an embodiment of the present disclosure.

A top face of the detergent container 340 may be opened, so that the detergent may be injected into the detergent container 340. In the state in which the detergent storage 300 is extended from the cabinet 10, for example, in the state in which the detergent storage 300 is extended by the set extension distance as shown in FIG. 6, the user may inject the detergent through the open top face.

In one example, the detergent cup 700 is installed to be detachable from the detergent storage frame 390. FIG. 7 illustrates the detergent cup 700 coupled to the detergent storage frame 390, and FIG. 8 illustrates the detergent cup 700 detached from the detergent storage frame 390.

A top face of the detergent cup 700 is opened, so that the detergent may be injected into the detergent cup 700. The detergent injected into the detergent cup 700 may be defined as the third detergent for the classification. The user may inject the same detergent or different detergents into the detergent reservoir 310, the detergent container 340, and the detergent cup 700 and use the same detergent or the different detergents as necessary.

For example, liquid detergent may be injected into the detergent reservoir 310, powder detergent may be injected into the detergent container 340, and a fabric softener may be injected into the detergent cup 700 as a type of the detergent.

However, as above, the first detergent, the second detergent, and the third detergent do not necessarily have to be detergents of different characteristics. Therefore, the user is able to use the first, second, and third detergents as the same type of detergent, or store the detergent only in one of the detergent reservoir 310, the detergent container 340, and the detergent cup 700.

The detergent cup 700 may be located adjacent to the detergent container 340. As the detergent container 340 and the detergent cup 700 with the open top faces are positioned adjacent to each other, the user may conveniently separate and utilize the detergent container 340 and the detergent cup 700 without using an unnecessarily spaced detergent containing space.

In addition, even when the detergent storage 300 is not fully extended as shown in FIG. 6, the detergent cup 700 adjacent to the detergent container 340 may be easily exposed to the outside of the cabinet 10 together with the detergent container 340 and the user may conveniently inject the detergent into the detergent cup 700, which may be advantageous.

In one example, in an embodiment of the present disclosure, the detergent container 340 and the detergent cup 700 are arranged to be surrounded by the detergent reservoir 310. Accordingly, space utilization may be optimized while using the three different detergent containing spaces.

Specifically, the detergent reservoir 310 may have the widest detergent storage space for the detergent. The detergent reservoir 310 may be formed in a shape surrounding the detergent container 340 and the detergent cup 700 so as to secure a wide space inside the detergent storage frame 390 even when the detergent container 340 and the detergent cup 700 are arranged to use the second detergent and third detergent, which are distinguished from the first detergent in the detergent reservoir 310.

Accordingly, the detergent container 340 and the detergent cup 700 may be arranged at a center of the detergent reservoir 310 and surrounded by the detergent reservoir 310. The detergent reservoir 310 may have a structure capable of securing the widest space while being detachable from the detergent storage frame 390 even when the detergent container 340 and the detergent cup 700 are arranged.

For example, when the detergent container 340 and the detergent cup 700 are arranged at a rear end 399 of the detergent storage frame 390, the user must extend the detergent storage 300 fully to the outside of the cabinet 10 in order to inject the second detergent and the third detergent respectively into the detergent container 340 and the detergent cup 700 of the detergent storage 300, which may cause inconvenience in use.

In addition, when the detergent container 340 and the detergent cup 700 are arranged at a front end 398 of the detergent storage frame 390, the user may use the detergent storage 300 by partially extending the detergent storage 300 from the cabinet 10. In this case, because a length of the detergent reservoir 310 retracted into the cabinet 10 is increased, the detachment of the detergent reservoir 310 may become inconvenient.

Therefore, in an embodiment of the present disclosure, the detergent reservoir 310 has a shape extending approximately along a longitudinal direction of the detergent storage frame 390, so that the detergent container 340 and the detergent cup 700 are arranged at the center of the detergent reservoir 310. Thus, even when the user only partially extends the detergent storage 300, the detergent container 340 and the detergent cup 700 are exposed to the outside of the cabinet 10, which is convenient to detach and use the detergent reservoir 310.

In one example, as shown in FIGS. 7 and 8, the detergent storage frame 390 may be constructed such that a width W3 of the rear end 399 is smaller than a width W2 of the front end 398, and the detergent container 340 may be located at the center between the front end 398 and the rear end 399.

Specifically, the detergent storage frame 390 may have a shape in which a width of the detergent storage frame 390 decreases at least in part from the front end 398 to the rear end 399 along the longitudinal direction. FIG. 7 illustrates a state in which a width change portion in which the width is decreased is formed between the rear end 399 and the front end 398 according to an embodiment of the present disclosure.

In an embodiment of the present disclosure, as the width W3 of the rear end 399 is smaller than that of the front end 398, a space may be defined between the rear end 399 and a side wall 410 of the detergent supply casing 400. The space may be variously utilized. For example, water may be supplied to the space from a rear shower means 267 to be described later.

In the detergent storage frame 390, the detergent container 340 may be located between the front end 398 and the rear end 399. That is, the detergent container 340 may be located at the center of the detergent storage frame 390. The width W2 of the front end 398 located in front of the detergent container 340 may be larger than the width W3 of the rear end 399 located at the rear of the detergent container 340.

In one example, in an embodiment of the present disclosure, the width W3 of the rear end 399 of the detergent storage frame 390 may be smaller than a width W1 of the opening 15 of the cabinet 10, and the width W2 of the front end 398 of the detergent storage frame 390 may correspond to the width W1 of the opening 15.

That is, the width W1 of the opening 15 illustrated in FIG. 5 may be larger than the width W3 of the rear end 399 of the detergent storage frame 390 illustrated in FIG. 7, and may correspond to the width W2 of the front end 398. For example, the width W2 of the front end 398 of the detergent storage frame 390 may be the same as the width W1 of the opening 15.

Accordingly, when the user inserts the detergent storage 300 completely detached from the cabinet 10 into the opening 15, a free space is secured between the detergent storage 300 and the opening 15, thereby improving convenience. The detergent storage 300 whose retraction into the cabinet 10 is terminated may be structurally and stably fixed inside the opening 15.

Specifically, when the detergent storage 300 is inserted into the opening 15, the rear end 399 of the detergent storage frame 390 faces the opening 15 and moves toward the opening 15. Because the width W3 of the rear end 399 of the detergent storage frame 390 is smaller than the width W1 of the opening 15, the free space is secured between the detergent storage frame 390 and the opening 15. Further, the user may easily insert the rear end 399 of the detergent storage frame 390 into the opening 15.

In addition, in the situation where the rear end 399 of the detergent storage frame 390 is inserted into the opening 15, when the retraction of the detergent storage frame 390 proceeds, the front end 398 of the detergent storage frame 390 is eventually located on a side of the opening 15. As the front end 398 of the detergent storage frame 390 has a width corresponding to, for example, the same as the width of the opening 15, coupling stability may be improved.

In one example, as illustrated in FIGS. 7 and 8, in an embodiment of the present disclosure, the detergent storage frame 390 may have frame side walls 630 extending in the front and rear direction of the detergent storage 300 respectively on both sides thereof.

In addition, the frame side wall 630 may include an engaging protrusion 320 protruding upward and a sagging preventing protrusion 520 protruding upward and positioned in front of the engaging protrusion 320.

Specifically, the frame side walls 630 may be located on both sides in the left and right direction of the detergent storage frame 390. In the present disclosure, the both sides in the left and right direction may be defined by the cabinet 10 defining the front and rear direction, and the definition of the both sides in the left and right direction may be also shared in the dispenser 200, the detergent storage 300, the detergent supply casing 400, and the like.

For example, the both sides in the left and right direction may be defined based on side faces of the cabinet 10, and the left and right direction may be a direction transverse to the front and rear direction on the same plane as the front and rear direction, for example, a vertical direction.

The vertical direction may be defined based on the bottom face and the top face of the cabinet 10, and may be a direction perpendicular to the ground. For example, in an embodiment of the present disclosure, the dispenser 200, the detergent storage 300, and a bottom 401 of the detergent supply casing 400 may have a structure stacked in the vertical direction.

In the present disclosure, it is defined that the front and rear direction of the detergent storage 300 is the same as a front and rear direction of the dispenser 200 and the detergent supply casing 400, the left and right direction of the detergent storage 300 is the same as a left and right direction of the dispenser 200 and the detergent supply casing 400, and the vertical direction of the detergent storage 300 is the same as a vertical direction of the dispenser 200 and the detergent supply casing 400.

In one example, the frame side wall 630 may extend in the front and rear direction of the detergent storage 300. That is, as the frame side walls 630 extend respectively from the both sides of the detergent storage frame 390 in the front and rear direction, the frame side walls 630 may be constructed to shield the interior of the detergent storage frame 390 in the left and right direction.

The frame side wall 630 may include the engaging protrusion 320 and the sagging preventing protrusion 520. The engaging protrusion 320 and the sagging preventing protrusion 520 may be spaced apart from each other in the front and rear direction, and the sagging preventing protrusion 520 may be located in front of the engaging protrusion 320.

The engaging protrusion 320 and the sagging preventing protrusion 520 may protrude upward. The engaging protrusion 320 and the sagging preventing protrusion 520 protruding upward may have a contact or pressure relationship with other components inside the cabinet 10 and may be variously used.

For example, the engaging protrusion 320 may be constructed to provide a sense of resistance or a sense of damping to the user during the retraction and the extension processes of the detergent storage frame 390. The sagging preventing protrusion 520 may be constructed to prevent the detergent storage frame 390 from sagging downward because of a self load or the like during the retraction and the extension processes of the detergent storage frame 390.

Figure 9:
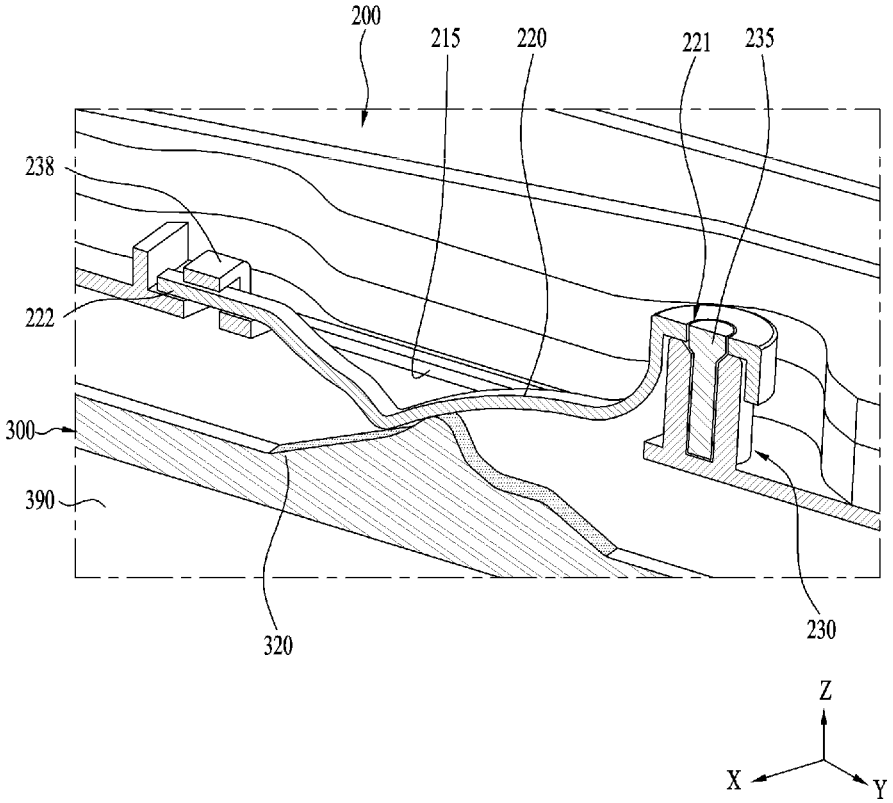
FIG. 9 is a view illustrating an engaging protrusion and an engaging elastic portion in a laundry treating apparatus according to an embodiment of the present disclosure.
Figure 10:
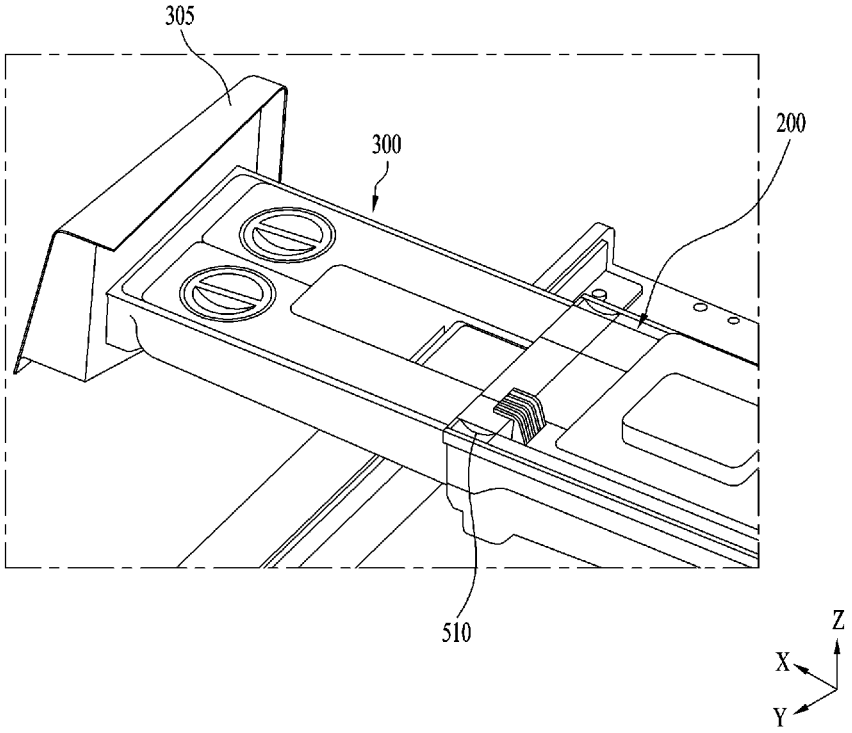
FIG. 10 is a view illustrating a sagging preventing elastic portion in a laundry treating apparatus according to an embodiment of the present disclosure.

In one example, FIG. 9 illustrates an engaging elastic portion 220 and the engaging protrusion 320 arranged on a fixing portion according to an embodiment of the present disclosure. FIG. 10 schematically illustrates the sagging preventing elastic portion 510 disposed on the fixing portion, and FIG. 11 illustrates the sagging preventing elastic portion 510 and the sagging preventing protrusion 520 arranged on the fixing portion.

Figure 11:
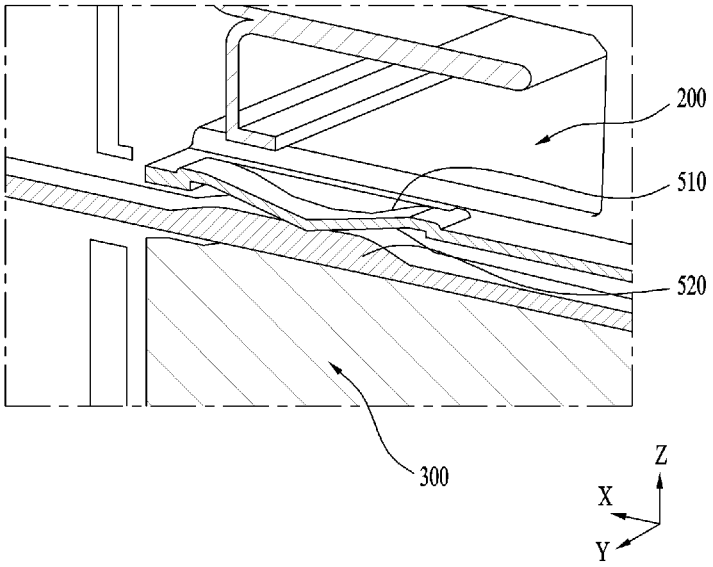
FIG. 11 is a view illustrating a sagging preventing protrusion and a sagging preventing elastic portion in a laundry treating apparatus according to an embodiment of the present disclosure.

Referring to FIGS. 9 and 11, an embodiment of the present disclosure may further include the fixing portion disposed in the cabinet 10 and positioned above the detergent storage 300. The fixing portion may include the sagging preventing elastic portion 510 and the engaging elastic portion 220.

The sagging preventing elastic portion 510 is disposed at a front end of the fixing portion and protrudes downward, so that at least a portion thereof may overlap with the sagging preventing protrusion 520 along the front and rear direction. The engaging elastic portion 220 is positioned at the rear of the sagging preventing elastic portion 510 and protrudes downward, so that at least a portion thereof may overlap the engaging protrusion 320 along the front and rear direction.

Specifically, the fixing portion may be disposed inside the cabinet 10 and disposed above the detergent storage 300 to face the top face of the detergent storage 300.

In an embodiment of the present disclosure, the fixing portion may be the dispenser 200 positioned on the detergent storage 300 to supply water to the detergent storage 300, but may not be limited thereto.

The fixing portion, for example, the dispenser 200, unlike the detergent storage 300, may not be retracted or extended through the opening 15 in the state of being installed inside the cabinet 10, and may be disposed in a fixed state at a specific position.

The engaging protrusion 320 may be disposed on a top face of the frame side wall 630 of the detergent storage frame 390 facing the fixing portion, for example, the dispenser 200. FIGS. 7 and 8 schematically illustrates a location of the engaging protrusion 320 in the detergent storage 300, and FIG. 9 illustrates the engaging protrusion 320 in contact with the engaging elastic portion 220. A protruding shape of the engaging protrusion 320 may vary.

The engaging elastic portion 220 may be disposed on the fixing portion. The engaging elastic portion 220 may be formed to protrude downward from the fixing portion toward the detergent storage 300. In FIG. 4, the dispenser 200 is constructed as the fixing portion, and the engaging elastic portion 220 disposed on the dispenser 200 is schematically illustrated. FIG. 9 illustrates the engaging elastic portion 220 in contact with the engaging protrusion 320.

At least a portion of the engaging elastic portion 220 may overlap the engaging protrusion 320 along the front and rear direction. That is, the engaging elastic portion 220 may be positioned in parallel with the engaging protrusion 320 along the front and rear direction. Accordingly, at least a portion of the engaging elastic portion 220 may be pressed and elastically deformed by the engaging protrusion 320 during the retraction or extension process of the detergent storage 300.

The protruding shape of the engaging elastic portion 220 may be varied as needed. For example, the engaging protrusion 320 and the engaging elastic portion 220 may have a shape in which a center protrudes such that front and rear sides have a gentle slope.

The engaging elastic portion 220 may have elasticity and may be made of a material that may be deformed and restored, and may have higher elasticity than the engaging protrusion 320. In addition, the engaging elastic portion 220 may have higher elasticity than a material of the fixing portion.

FIG. 9 illustrates the engaging elastic portion 220 and the engaging protrusion 320 in a state in which the detergent storage 300 is retracted into the opening 15 according to an embodiment of the present disclosure. Referring to FIG. 9, the engaging elastic portion 220 may be disposed such that at least a portion, for example, a portion including an end protruding downward, overlaps the engaging protrusion 320 along the front and rear direction or a retraction direction of the detergent storage 300.

In the state in which the engaging protrusion 320 is positioned in front of the engaging elastic portion 220 in the retraction process, the detergent storage 300 may move rearward toward the engaging elastic portion 220, and may move rearward by passing the engaging elastic portion 220.

That is, in the retraction process, the engaging elastic portion 220 may be positioned to overlap the engaging protrusion 320 in the vertical direction, and may be pressed and deformed by the engaging protrusion 320. The engaging elastic portion 220 pressed by the engaging protrusion 320 may be deformed such that a protruding height thereof is lowered. Accordingly, the engaging protrusion 320 may pass the engaging elastic portion 220 and move rearward.

When the detergent storage 300 is fully retracted into the opening 15, the engaging protrusion 320 passes the engaging elastic portion 220 and is positioned at the rear of the engaging elastic portion 220 as shown in FIG. 9. The engaging elastic portion 220 may be elastically restored when the engaging protrusion 320 passes the engaging elastic portion 220 after the engaging elastic portion 220 is deformed by the engaging protrusion 320.

The user may extend the detergent storage 300 from the opening 15 using the handle 305 and inject the detergent into the detergent storage 300. The detergent storage 300 in which the detergent is stored may be retracted by sliding back to the opening 15. In this connection, the user may recognize the retraction situation of the detergent storage 300 through the contact relationship between the engaging protrusion 320 and the engaging elastic portion 220.

For example, in the process of gripping the handle 305 and pushing the detergent storage 300 rearward, the user perceives the sense of resistance and the like resulted from the contact between the engaging protrusion 320 and the engaging elastic portion 220 and a predetermined pressure is transmitted to the user. As the engaging protrusion 320 passes the engaging elastic portion 220, the force transmitted to the user may be reduced and the user may identify that the detergent storage 300 has reached the fully retracted state.

In addition, as the restoring force of the engaging elastic portion 220 is transmitted to the engaging protrusion 320, the engaging elastic portion 220 may provide a moving force to the engaging protrusion 320 such that the detergent storage 300 moved such that the engaging protrusion 320 passes the engaging elastic portion 220 is retracted to a distal end of the opening 15.

Accordingly, the user may retract the detergent storage 300 into the opening 15 while feeling a certain reaction force, and then feel a smooth and stable feeling of retraction as the reaction force disappears and a force that induces the retraction is rather provided.

In one example, as shown in FIG. 9, the engaging elastic portion 220 may be detachably coupled to the fixing portion. The engaging elastic portion 220 may be manufactured separately from the fixing portion, and may correspond to an elastic body that is deformed by being pressed by the engaging protrusion 320 and restored.

It may be advantageous that the engaging elastic portion 220 is easier to be deformed and has higher elasticity than the material of the fixing portion. An embodiment of the present disclosure manufactures such engaging elastic portion 220 separately from the fixing portion, for example, the dispenser 200 to manufacture the engaging elastic portion 220 using a material different from that of the fixing portion having high rigidity, which may be advantageous.

Hereinafter, for convenience of description, it will be described that the dispenser 200 corresponds to the fixing portion according to an embodiment of the present disclosure. However, this is only for convenience of description, and the fixing portion is not necessarily limited to the dispenser 200.

Manufacturing of the dispenser 200 may include a heat-treatment process. In this case, the material of the dispenser 200 may decrease in elasticity and increase in rigidity after the heat-treatment. When the engaging elastic portion 220 is molded together with the dispenser 200, the engaging elastic portion 220 may also decrease in the elasticity by the heat-treatment process.

That is, an embodiment of the present disclosure is advantageous in that a change in properties of the material resulted from a series of molding processes included in the manufacture of the dispenser 200 may be avoided as the engaging elastic portion 220 is manufactured separately from the dispenser 200 and is detachably coupled to the dispenser 200.

In one example, as shown in FIG. 9, in the state in which the detergent storage 300 is retracted into the opening 15, in the laundry treating apparatus 1 according to an embodiment of the present disclosure, a maximally protruded point of the engaging elastic portion 220 may be positioned forwardly of a maximally protruded point of the engaging protrusion 320 and the engaging elastic portion 220 may rearwardly support the engaging protrusion 320.

The maximum protrusion point of the engaging elastic portion 220 refers to a point of the engaging elastic portion 220 protruding farthest from the engaging elastic portion 220 in the vertical direction, and the maximum protrusion point of the engaging protrusion 320 refers to a point protruding farthest from the detergent storage 300 in the vertical direction.

In the engaging protrusion 320, a front pressing portion 352 inclined may be positioned in front of the maximally protruded point, a flat pressing portion 352 may be positioned at the rear of the maximally protruded point, and a rear pressing portion 352 may be positioned at the rear of the flat pressing portion 352.

In the retraction process of the detergent storage 300, the engaging elastic portion 220 may be pressed by the rear pressing portion 352 of the engaging protrusion 320. Thereafter, as the maximally protruded point of the engaging elastic portion 220 is supported on the flat pressing portion 352 of the engaging protrusion 320, the deformed state of the engaging elastic portion 220 may be maintained. Accordingly, the reaction force by the engaging elastic portion 220 may be provided stepwise in the retraction process of the detergent storage 300.

When the maximally protruded point of the engaging protrusion 320 passes the maximally protruded point of the engaging elastic portion 220, while the front pressing portion 352 of the engaging protrusion 320 supports the engaging elastic portion 220, the engaging elastic portion 220 is gradually restored.

In the engaging elastic portion 220, a front inclined portion may be positioned in front of the maximally protruded point, and a rear inclined portion may be positioned at the rear of the maximally protruded point.

The front inclined portion may extend rearward from a front end of the engaging elastic portion 220 and may become closer to the detergent storage 300 as the front inclined portion is further away from the front end. That is, the front inclined portion may be formed to be inclined such that a protruding height thereof increases toward the maximally protruded point.

In one example, the rear inclined portion may extend rearward from the front inclined portion, and may be constructed to move away from the detergent storage 300 as a distance from the front inclined portion increases. That is, the rear inclined portion may be formed to be inclined such that a protruding height thereof decreases rearwardly from the maximally protruded point.

In the process in which the detergent storage 300 is retracted into the opening 15, the engaging protrusion 320 presses the front inclined portion to elastically deform the engaging elastic portion 220. In the state in which the detergent storage 300 is retracted into the opening 15, the engaging protrusion 320 may be in contact with and supported by the rear inclined portion.

Figure 15:
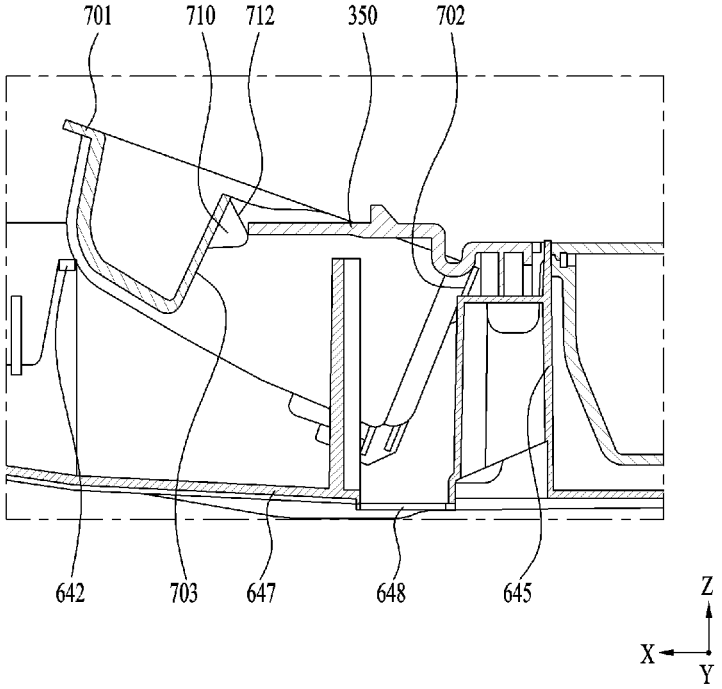
FIG. 15 is a view illustrating a state in which a detergent cup illustrated in FIG. 14 is being detached from a detergent storage frame.

In one example, the front inclined portion may have a longer and smoother inclined face than the rear inclined portion. FIG. 15 illustrates a state in which a length L1 of the front inclined portion is larger than a length L2 of the rear inclined portion.

Accordingly, the engaging elastic portion 220 may provide a reaction force of a relatively low increase rate to the engaging protrusion 320 in the retraction process of the detergent storage 300 such that the retraction process is not disturbed, and provide a reaction force of a relatively high increase rate in the extension process of the detergent storage 300 such that unnecessary extension of the detergent storage 300 may be prevented.

When the detergent storage 300 is fully retracted into the opening 15, the engaging protrusion 320 may be pressed rearwardly by the engaging elastic portion 220, and accordingly, the retracted state of the detergent storage 300 may be stably maintained.

Further, when the user extends the detergent storage 300, as the extension of the detergent storage 300 starts, the reaction force caused by the engaging elastic portion 220 may be immediately recognized, so that the user may effectively recognize the extension situation of the detergent storage 300 and may restrict the unnecessary extension of the detergent storage 300.

In one example, referring to FIG. 9, in an embodiment of the present disclosure, the dispenser 200 has a through-hole 215 that opens toward said one face of the detergent storage 300. A central portion of the engaging elastic portion 220 may pass through the through-hole 215 and protrude toward the detergent storage 300.

A shape of the through-hole 215 may vary, and may penetrate the fixing portion. The central portion of the engaging elastic portion 220 may pass through the through-hole 215 and protrude toward said one face of the detergent storage 300. The maximally protruded point of the engaging elastic portion 220 may be positioned at the central portion.

When the engaging elastic portion 220 protrudes to pass through the through-hole 215 of the dispenser 200, compared to a case in which the engaging elastic portion 220 protrudes directly from a bottom face of the dispenser 200, a total protruding length of the engaging elastic portion 220 may be increased, which may be advantageous for the elastic deformation.

The engaging elastic portion 220 may be bent such that the central portion extending from the front end and the rear end passes through the through-hole 215. That is, the engaging elastic portion 220 may be constructed such that a strap or a straight member is bent or curved.

Accordingly, the engaging elastic portion 220 has an empty space on an opposite side of a contact face with the engaging protrusion 320, so that the engaging elastic portion 220 may be easily deformed by the pressing of the engaging protrusion 320 and elastically restored.

In one example, referring to FIG. 9, in an embodiment of the present disclosure, the dispenser 200, that is, the fixing portion may be formed rearward of the through-hole 215. The engaging elastic portion 220 may be positioned such that the rear end thereof overlaps the fastening groove.

The engaging elastic portion 220 may be penetrated by a fastening member 235, which is inserted into the fastening groove 233, and coupled to the dispenser 200. However, the fastening groove may be defined forward of the through-hole 215, and the front end of the engaging elastic portion 220 may be coupled to the fastening groove.

The fastening member 235 may couple the engaging elastic portion 220 with the dispenser 200 by penetrating an end of the engaging elastic portion 220 overlapping the fastening groove and being inserted into the fastening groove.

The fastening member 235 may have a length like a bolt or the like, may be inserted into the fastening groove, and may be easily coupled to and removed from the fastening groove. In one example, as shown in FIG. 9, an embodiment of the present disclosure may further include a fastening portion 230 and a cap 221.

The fastening portion 230 may be disposed in the dispenser 200 and protrude along an insertion direction of the fastening member 235, and the fastening groove may be defined at a center of the fastening portion 230. As the fastening groove is defined in the fastening member 235 protruding from the dispenser 200, a length of the fastening groove into which the fastening member 235 may be inserted may be easily secured.

The cap 221 may be disposed on the rear end of the engaging elastic portion 220. That is, the cap 221 may be disposed at an end of the engaging elastic portion 220 overlapping the fastening groove.

The cap 221 may have a space defined therein, and an outer circumferential face thereof may be disposed to surround an outer circumferential face of the fastening portion 230. That is, the fastening portion 230 may be coupled to be inserted into the cap 221.

In the cap 221 into which the fastening portion 230 is inserted, a top face may be penetrated by the fastening member 235. Accordingly, as the fastening portion 230 protruding from the dispenser 200 is inserted into the cap 221 and coupled with the fastening portion 230 by the fastening member 235, the cap 221 may have a stable coupling structure with the fastening portion 230.

In one example, as shown in FIG. 9, the front end of the engaging elastic portion 220 may be constructed to be slidable and the cap 221 may be formed at the rear end of the engaging elastic portion 220. when the front end is disposed to be slidable on the fixing portion, an amount of elastic deformation of the central portion may be increased. However, when the cap 221 of the engaging elastic portion 220 is disposed on the front end, the rear end may be constructed to be slidable.

When the engaging elastic portion 220 is pressed and deformed by the engaging protrusion 320, a slidable end of the engaging elastic portion 220 may be slid away from the center of the engaging elastic portion 220 to satisfy an amount of change in the protruding height of the engaging elastic portion 220.

When the rear end is fixed and the front end forms the slidable sliding end 222 in the engaging elastic portion 220, a larger amount of deformation may be accepted in the extension process than in the retraction process of the detergent storage 300.

That is, the engaging elastic portion 220 may provide a greater reaction force to the engaging protrusion 320 in the extension process of the detergent storage 300. Therefore, the reaction force is reduced in the retraction process of the detergent storage 300, thereby providing a soft retraction feeling.

A fixing force for the retracted detergent storage 300 may be increased and the larger amount of deformation by the engaging protrusion 320 may be accepted in the extension process, so that a large reaction force may be provided during the extension and the stable retracted state of the detergent storage 300 may be maintained.

In one example, an embodiment of the present disclosure may further include a guide 238. The guide 238 may be disposed in the dispenser 200, and a central portion thereof may be penetrated in the front and rear direction by the front sliding end 222 of the engaging elastic portion 220.

The guide 238 surrounds the sliding end 222 of the engaging elastic portion 220 and fixes the position of the sliding end 222. In an embodiment of the present disclosure, the front end of the engaging elastic portion 220 is not deviated from a sliding region using the guide 238, thereby securing structural stability.

In one example, FIG. 10 illustrates a sagging preventing elastic portion 510 viewed from the outside of the dispenser 200 in the extension process of the detergent storage 300 according to an embodiment of the present disclosure, and FIG. 11 is an enlarged view of the sagging preventing elastic portion 510 and a sagging preventing protrusion 520.

For reference, FIG. 4 schematically illustrates the sagging preventing elastic portion 510 of the dispenser 200, and FIGS. 7 to 8 schematically illustrate the sagging preventing protrusion 520. The sagging preventing protrusion 520 may be spaced rearwardly apart from the sagging preventing elastic portion 510 by the set extension distance as will be described below.

The sagging preventing elastic portion 510 may be disposed at the front end 291 of the dispenser 200. In addition, the sagging preventing elastic portion 510 may protrude toward the top face of the detergent storage 300 like the engaging elastic portion 220 and may be elastically deformed and restored. The sagging preventing protrusion 520 may be disposed on the top face of the detergent storage 300 and may protrude toward the fixing portion.

In the extension process of the detergent storage 300, when a center of gravity of the detergent storage 300 is positioned outward of the opening 15 based on the front and rear direction, a front end of the detergent storage 300 may be inclined downward by a self-load thereof.

In an embodiment of the present disclosure, as the sagging preventing elastic portion 510 and the sagging preventing protrusion 520 are arranged, in the state in which the detergent storage 300 is extended by the set extension distance, the sagging preventing protrusion 520 may prevent sagging of the detergent storage 300 by pressing and being in close contact with the sagging preventing elastic portion 510.

That is, the sagging preventing elastic portion 510 may prevent the sagging of the detergent storage 300 by pressing and supporting the sagging preventing protrusion 520 overlapped in the vertical direction. The set extension distance refers to an extension distance of the detergent storage 300 set in advance such that the user may conveniently use the detergent storage 300 even when the detergent storage 300 is not completely separated from the opening 15.

The sagging preventing elastic portion 510 is positioned in the fixing portion, for example, at the front end 291 of the dispenser 200 to overlap the sagging preventing protrusion 520 on the detergent storage 300 in the extended state and is advantageous in providing an elastic force.

The sagging preventing protrusion 520 may be disposed to be spaced apart from the front end of the detergent storage 300 by the set extension distance. That is, an extension distance in which the sagging preventing protrusion 520 physically overlaps the sagging preventing elastic portion 510 in the extension process corresponds to the set extension distance according to an embodiment of the present disclosure.

A separation distance P from the front end of the detergent storage 300 to the sagging preventing protrusion 520 is indicated in FIG. 7. The corresponding distance P may correspond to the set extension distance according to an embodiment of the present disclosure.

When the detergent storage 300 extends from the opening 15 by the set extension distance, the sagging preventing protrusion 520 may be positioned below the sagging preventing elastic portion 510 and pressed and supported by the sagging preventing elastic portion 510.

The user may identify the set extension distance considering appropriateness of use by recognizing a resistance or reaction force generated as the sagging preventing protrusion 520 and the sagging preventing elastic portion 510 overlap each other in the extension process of the detergent storage 300.

In an embodiment of the present disclosure, the sagging preventing protrusion 520 may be positioned in front of the engaging protrusion 320 and the engaging elastic portion 220. The sagging preventing elastic portion 510 positioned at the front end 291 of the dispenser 200 may be positioned in front of the engaging elastic portion 220.

The sagging preventing protrusion 520 may be positioned in front of the engaging elastic portion 220 in the retraction and extension processes of the detergent storage 300. Accordingly, a situation in which the sagging preventing protrusion 520 unnecessarily contacts the engaging elastic portion 220 may be prevented.

In one example, as will be described later, an locking protrusion 353 and a stopper 250 may be arranged to restrict the extension distance of the detergent storage 300 to the set extension distance. The locking protrusion 353 may protrude from the detergent storage 300 toward the fixing portion, for example, the dispenser 200, and the stopper 250 may be disposed in the fixing portion and protrude toward the detergent storage 300.

When a movement of the locking protrusion 353 is restricted by the stopper 250 in the extension process of the detergent storage 300, the extension of the detergent storage 300 may be restricted. Further, in a state in which the locking protrusion 353 and the stopper 250 are in contact with each other, the sagging preventing protrusion 520 may be positioned below the sagging preventing elastic portion 510 and pressed.

Referring to FIGS. 7 and 8 again, in an embodiment of the present disclosure, a distance between the sagging preventing protrusions 520 respectively disposed on the both sides of the detergent storage frame 390 may be larger than a distance between the engaging protrusions 320.

Specifically, in an embodiment of the present disclosure, the detergent storage frame 390 may be formed such that the width W3 of the rear end 399 is smaller than the width W2 of the front end 398, and the frame side wall 630 may also be formed to correspond to the change in the width of the detergent storage frame 390.

In one example, the sagging preventing protrusion 520 may be located in front of the engaging protrusion 320. Accordingly, the distance between the pair of sagging preventing protrusions 520 respectively positioned on the both sides of the detergent storage frame 390 may be equal to the width W1 of the front end 398 of the detergent storage frame 390.

In addition, the engaging protrusion 320 is located at the rear of the sagging preventing protrusion 520. The distance between the pair of engaging protrusions 320 may be equal to the width W3 of the rear end 399 of the detergent storage frame 390.

That is, the sagging preventing protrusions 520 may be arranged at points having the same width as the width W2 of the front end 398 of the detergent storage frame 390 on the frame side wall 630, and the engaging protrusions 320 may be arranged at points having the same width as the width W3 of the rear end 399 of the detergent storage frame 390.

As a result, the sagging preventing protrusion 520 and the engaging protrusion 320 do not overlap each other in the front and rear direction, and are spaced apart from each other in a width direction. Accordingly, the sagging preventing elastic portion 510 and the engaging elastic portion 220 are also constructed to have different widths. Further, an unnecessary situation in which the engaging protrusion 320 is in contact with the sagging preventing elastic portion 510 in the retraction and extension process of the detergent storage 300 may be prevented.

Figure 12:
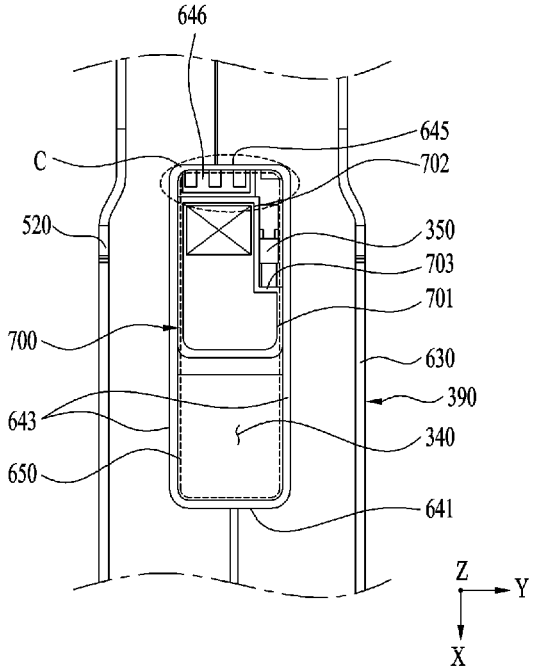
FIG. 12 is a view illustrating a detergent cup coupled to a detergent storage frame in a laundry treating apparatus according to an embodiment of the present disclosure.

In one example, FIG. 8 illustrates a detergent containing region 650 of the detergent storage frame 390 from which the detergent cup 700 is detached, and FIG. 12 illustrates the detergent receiving region 650 of the detergent storage frame 390 to which the detergent cup 700 is coupled.

Referring to FIGS. 8 and 12, in an embodiment of the present disclosure, the detergent storage frame 390 may be provided with the detergent containing wall 640 protruding upward from the bottom face, and the detergent containing region 650 surrounded by the detergent containing wall 640 may be defined.

In addition, the detergent container 340 may be formed in a portion of the detergent receiving region 650, and the detergent cup 700 may be installed in the remaining portion.

The detergent containing wall 640 may protrude upward from the bottom face of the detergent storage frame 390, and may be integrally formed with the bottom face of the detergent storage frame 390, or manufactured separately from the bottom face and coupled to the bottom face.

The detergent containing wall 640 is formed in a ring shape when viewed from above, so that a closed cross-section may be defined therein. The ring shape may be circular or polygonal, and FIG. 12 illustrates the detergent containing wall 640 forming a rectangular closed cross-section according to an embodiment of the present disclosure.

The detergent containing region 650 surrounded by the detergent containing wall 640 may be defined inside the detergent storage frame 390. That is, the internal space of the detergent storage frame 390 may be divided into the detergent containing region 650 inside the detergent containing wall 640 and an external space of the detergent containing wall 640.

The detergent reservoirs 310 may be inserted and installed in the space outside the detergent containing wall 640 in the detergent storage frame 390. The detergent reservoirs 310 may include two detergent reservoirs, and the two detergent reservoirs may extend in the front and rear direction and be arranged adjacent to each other in the left and right direction. The detergent storage frame 390 may extend in the front and rear direction, cross a center, and have reservoir fixing ribs for fixing the detergent reservoirs 310 on both sides.

Because the top face of the detergent containing region 650 is opened and the detergent containing region 650 is partitioned from the outside by the detergent containing wall 640, the detergent and the like inside may not leak outside the detergent containing wall 640.

As shown in FIG. 12, in an embodiment of the present disclosure, the detergent cup 700 may be inserted into the detergent containing region 650. Accordingly, the portion of the detergent containing region 650 may form the detergent container 340, and the detergent cup 700 may be disposed in the remaining portion.

That is, in an embodiment of the present disclosure, the detergent cup 700 and the detergent container 340 are arranged together in the detergent containing region 650 partitioned and defined by the detergent containing wall 640. The detergent container 340 is constructed such that the leakage of the detergent is prevented by the detergent containing wall 640. Further, the detergent cup 700 is separated from the detergent container 340 by an outer wall thereof. Thus, while sharing the detergent containing region 650, the detergent container 340 may be separated from the detergent.

The detergents that are distinguished from each other may be respectively stored in the detergent container 340 and the detergent cup 700. For example, the second detergent may be stored in the detergent container 340 and the third detergent may be stored in the detergent cup 700. In an embodiment of the present disclosure, the leakage of the detergent from the detergent container 340 and the detergent cup 700 may be prevented by the detergent containing wall 640 defining the sealed detergent containing region 650.

Further, even when the third detergent leaks through the open top face of the detergent cup 700, the third detergent leaked by the detergent containing wall 640 does not leave the detergent containing region 650, which is effective in the usability and manageability of the detergent storage 300.

In one example, in an embodiment of the present disclosure, the detergent containing wall 640 may include detergent containing side walls 643 respectively located on both sides of the detergent cup 700, and a detergent containing front wall 641 disposed spaced forwardly apart from a front face of the detergent cup 700 and connected to the detergent receiving side walls 643. In addition, the detergent container 340 may be disposed between the detergent receiving front wall 641 and the detergent cup 700 in the detergent containing region 650. That is, the detergent container 340 may be located in front of the detergent cup 700.

In addition, referring to FIG. 8, the detergent storage frame 390 may further include a front blocking portion 642 between the detergent cup 700 and the detergent container 340. The front blocking portion 642 may extend along the left and right direction of the detergent storage 300 to block a forward movement of the detergent cup 700.

In an embodiment of the present disclosure, the detergent cup 700 and the detergent container 340 share the detergent containing region 650, and the front blocking portion 642 is disposed in the detergent containing region 650, so that the detergent cup 700 installed in the detergent containing region 650 may be prevented from invading the detergent container 340 by moving forward.

The front blocking portion 642 may extend along the left and right direction of the detergent storage 300. For example, the front blocking portion 642 may have both ends respectively connected to the pair of detergent containing side walls 643 on the both sides of the detergent cup 700.

Figure 13:
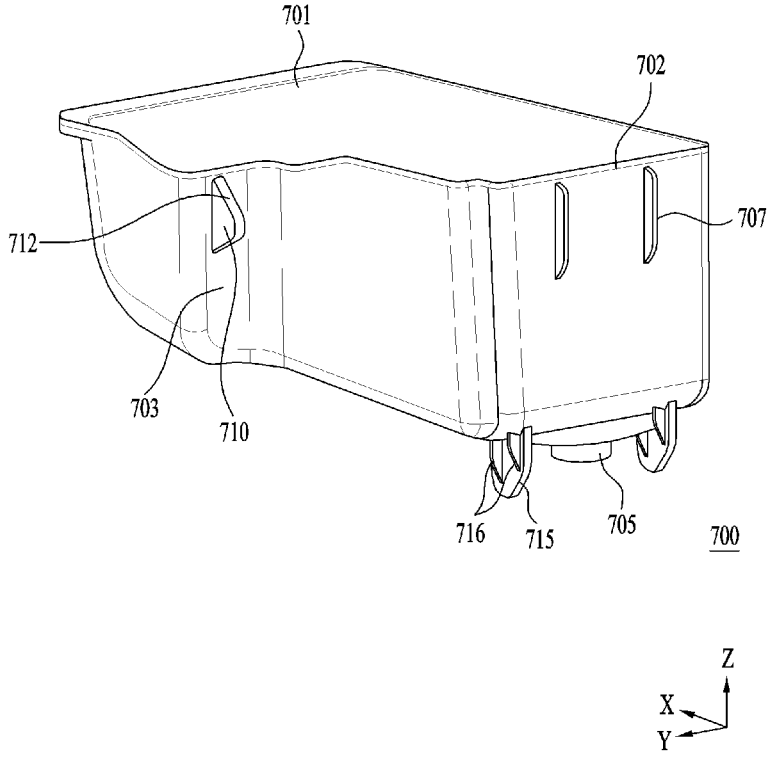
FIG. 13 is a perspective view of a detergent cup in a laundry treating apparatus according to an embodiment of the present disclosure.
Figure 14:
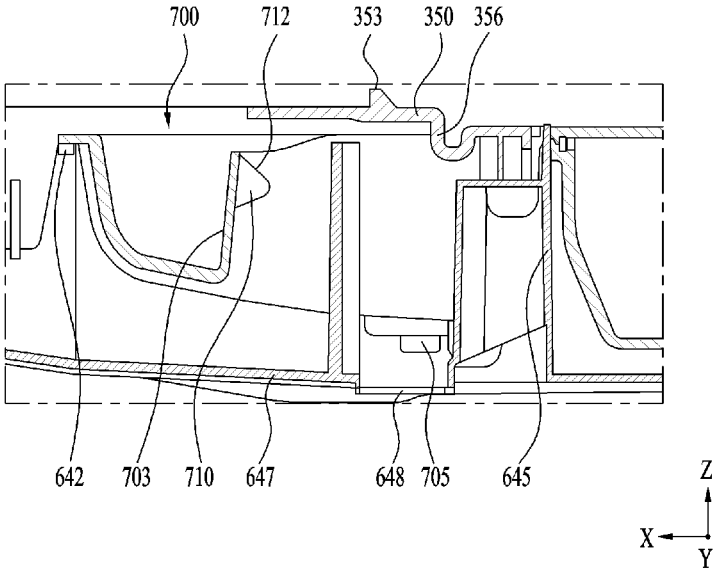
FIG. 14 is a cross-sectional view of a detergent cup coupled to a detergent storage frame in a laundry treating apparatus according to an embodiment of the present disclosure, viewed from the side.

In one example, FIG. 13 is a perspective view of the detergent cup 700, and FIG. 14 illustrates a cross-sectional view in which the detergent cup 700 is installed in the detergent containing region 650. For reference, FIG. 8 illustrates a detergent outlet 648 formed in the detergent containing region 650.

Referring to FIGS. 13 and 14, in an embodiment of the present disclosure, the detergent cup 700 may have a cup discharge portion 705 through which the third detergent is discharged. Further, the detergent outlet 648 through which the second detergent and the third detergent flow out may be formed on a detergent containing bottom face 647 surrounded by the detergent containing wall 640 in the detergent containing region 650.

The detergent outlet 648 is located below the cup discharge portion 705, and the front blocking portion 642 is spaced upwardly apart from the detergent containing bottom face 647. Thus, the detergent container 340 and the detergent outlet 648 may communicate with each other.

Specifically, the detergent cup 700 may have the cup discharge portion 705 at a bottom. Detergent stored in the detergent cup 700, for example, the third detergent, may be discharged to the outside of the detergent cup 700 through the cup discharge portion 705. The cup discharge portion 705 may have an opening that opens downward, and may discharge the detergent downward of the detergent cup 700.

The detergent outlet 648 may be formed in the detergent containing region 650. The detergent outlet 648 may be disposed on the detergent containing bottom face 647 surrounded by the detergent containing wall 640, may have an opening that is opened downward, and may flow the detergent inside the detergent containing region 650 toward the detergent supply casing 400.

The detergent outlet 648 may be located below the detergent cup 700. Accordingly, the third detergent discharged from the detergent cup 700 to the detergent containing region 650 through the cup discharge portion 705 may be flowed to the outside of the detergent storage frame 390, that is, toward the detergent supply casing 400, through the detergent outlet 648.

In one example, the front blocking portion 642 extending at a portion between the detergent container 340 and the detergent cup 700 may be spaced upwardly apart from the detergent containing bottom face 647. That is, the detergent container 340 may pass the front blocking portion 642 and communicate with the detergent outlet 648 located below the detergent cup 700.

Accordingly, the second detergent contained in the detergent container 340 may flow out toward the detergent supply casing 400 through the detergent outlet 648 located below the detergent cup 700.

Consequently, in an embodiment of the present disclosure, the detergent containing region 650 in which the leakage of the detergent to the outside is prevented by the detergent containing wall 640 may be defined, the detergent container 340 may be formed in the portion of the detergent containing region 650 and the detergent cup 700 may be installed in the remaining portion, and the second detergent of the detergent container 340 and the third detergent of the detergent cup 700 may flow out toward the detergent supply casing 400 through the detergent outlet 648 formed in the detergent containing region 650 together.

Based on the fact that the detergent container 340 is in communication with the detergent outlet 648 formed on the detergent containing bottom face 647, the second detergent may flow out through the detergent outlet 648 at the same time the second detergent is injected into the detergent container 340. Thus, the second detergent may be the powder detergent instead of the liquid detergent, and the third detergent in the detergent cup 700 may be the liquid detergent, such as the fabric softener. The detergent flowed out toward the detergent supply casing 400 may be supplied toward the tub 20 through a detergent drain hole 402 of the detergent supply casing 400, which will be described later.

In one example, FIG. 13 illustrates a state in which a separation preventing protrusion 710 is disposed on the detergent cup 700, and FIG. 14 illustrates the locking bar 350 positioned above the separation preventing protrusion 710.

Referring to FIGS. 13 and 14, in an embodiment of the present disclosure, the detergent cup 700 may include the separation preventing protrusion 710 protruding in a direction in parallel with the top face of the detergent storage frame 390, and may further include the locking bar 350 disposed on the detergent storage frame 390 and positioned above the separation preventing protrusion 710 to restrict upward deviation of the separation preventing protrusion 710 and the detergent cup 700.

Specifically, the separation preventing protrusion 710 may protrude from the detergent cup 700 in the direction in parallel with the top face of the detergent storage frame 390 or the top face of the detergent cup 700. For example, the separation preventing protrusion 710 may protrude in the front and rear direction or may protrude in a direction transverse to the front and rear direction. In addition, the separation preventing protrusion 710 may protrude from the side wall of the detergent cup 700.

The locking bar 350 may be disposed on the detergent storage frame 390 and may be positioned above the separation preventing protrusion 710 of the detergent cup 700 coupled to the detergent storage frame 390. The locking bar 350 may include the locking protrusion 353, and may restrict the extension distance of the detergent storage 300 from the cabinet 10 to the set extension distance. Details on the restriction of the extension distance of the detergent storage 300 by the locking bar 350 will be described later.

The detergent cup 700 may have a form of a cup whose interior is sealed except for the open top face, and may be seated in the detergent containing region 650 and the like. As the locking bar 350 is positioned above the separation preventing protrusion 710, the detergent cup 700 may be prevented from being detached from or deviated upward from the detergent storage frame 390 through the open top face of the detergent storage frame 390.

The detergent storage 300 in which the detergent cup 700 is placed may be handled after being completely extended and detached from the cabinet 10 by the user in the use environment. In manufacturing and transportation processes, the detergent storage 300 may be separated from the cabinet 10 and handled separately.

In the situation in which the detergent storage 300 is handled separately as above, for example, in a case in which the open top face of the detergent storage frame 390 faces the ground, there is a possibility that the detergent cup 700 may be detached and deviated from the detergent storage frame 390 through the open top face of the detergent storage frame 390.

An embodiment of the present disclosure may have the separation preventing protrusion 710 on the detergent cup 700 and the locking bar 350 on the detergent storage frame 390 in order to prevent the derivation of the detergent cup 700.

As described above, the separation preventing protrusion 710 may be disposed to protrude from the side wall or the like of the detergent cup 700, and the locking bar 350 may be disposed on the detergent storage frame 390 and be positioned above the separation preventing protrusion 710.

Accordingly, the locking bar 350 positioned above the separation preventing protrusion 710 may be positioned so as not to cover the open top face of the detergent cup 700, thereby ensuring the usability of the detergent cup 700. Furthermore, it may be possible for the user to detach the detergent cup 700 while adjusting the separation preventing protrusion 710 to be moved below the locking bar 350.

Even when the open top face of the detergent storage frame 390 faces the ground during the handling of the detergent storage 300, the separation preventing protrusion 710 of the detergent cup 700 may be restricted from being moved to the top face of the detergent storage frame 390 by the locking bar 350. Accordingly, the detachment of the detergent cup 700 from the detergent storage frame 390 may be suppressed.

In one example, referring to FIG. 14, in an embodiment of the present disclosure, the locking bar 350 may be disposed on the detergent containing wall 640 and positioned above the separation preventing protrusion 710. Because the detergent cup 700 is inserted and installed in the detergent containing region 650, the separation preventing protrusion 710 is also located inside the detergent containing region 650. Accordingly, the locking bar 350 may have a shape extending from the detergent containing wall 640 and at least a portion of the locking bar 350 may be positioned above the separation preventing protrusion 710.

Referring back to FIG. 13, the detergent cup 700 is formed such that the front end 701 has a larger width than the rear end 702, so that a wide width portion 703 protruding in the left and right direction of the detergent storage 300 than the rear end 702 may be formed. In addition, the separation preventing protrusion 710 may protrude rearward from a rear wall of the wide width portion 703.

The detergent cup 700 may define the front as the front end 701 and the rear as the rear end 702 based on a point where a difference in the width occurs. Alternatively, it may be understood that a portion having the same width as the front end 701 and extending rearward and a portion having the same width as the rear end 702 and extending forward are connected to each other at a central portion.

The wide width portion 703 of the detergent cup 700 may be understood as a portion protruding in the left and right direction than the rear end 702 based on the left and right direction. That is, the front end 701 of the detergent cup 700 may include the wide width portion 703. When the wide width portion 703 is removed from the detergent cup 700, the detergent cup 700 may have a rectangular cross-section.

The separation preventing protrusion 710 may be disposed on the rear wall directed in a rearward direction of the wide width portion 703. That is, the separation preventing protrusion 710 may be disposed to protrude rearward from the rear wall of the wide width portion 703.

In addition, the locking bar 350 may be disposed to deviate from the open top face of the detergent cup 700, and may be extended from the detergent containing wall 640 and positioned above the separation preventing protrusion 710. Accordingly, when the detergent cup 700 is simply moved upward of the detergent storage frame 390, for example, when the top face of the detergent storage frame 390 faces the ground, the separation preventing protrusion 710 may be in contact with the locking bar 350 to restrict the deviation of the detergent cup 700.

In one example, FIG. 15 illustrates a state in which the detergent cup 700 installed in the detergent storage frame 390 is detached from the detergent storage frame 390 as shown in FIG. 14. As shown in FIG. 15, in an embodiment of the present disclosure, the detergent cup 700 may be detached from the detergent storage frame 390 as the front end 701 is moved upward.

Specifically, in an embodiment of the present disclosure, because the separation preventing protrusion 710 protrudes rearward from the detergent cup 700, the user may detach the detergent cup 700 from the detergent storage frame 390 by lifting the front end 701 of the detergent cup 700 upward.

In addition, when the separation preventing protrusion 710 is located at a forefront of the detergent cup 700, even when the separation preventing protrusion 710 protrudes rearward, the detachment of the detergent cup 700 may be difficult because it may be impossible to lift the front end 701 of the detergent cup 700 by the separation preventing protrusion 710.

In one example, when the separation preventing protrusion 710 protrudes rearward from the rear face of the detergent cup 700, as an entirety of the detergent cup 700 is located in front of the separation preventing protrusion 710, the entirety of the detergent cup 700 may be lifted upward. Thus, an ability to prevent the detergent cup 700 from deviating may be greatly reduced.

In an embodiment of the present disclosure, the wide width portion 703 is formed by allowing the width of the front end 701 of the detergent cup 700 to be larger than the width of the rear end 702, and the separation preventing protrusion 710 protrudes rearward from the rear wall of the wide width portion 703. Thus, the detergent cup 700 may be arbitrarily detached by lifting a front portion of the separation preventing protrusion 710 from the detergent cup 700. At the same time, an ability to prevent the detergent cup 700 from being unintentionally separated from the detergent storage frame 390 may be secured as the rear wall of the wide width portion 703 is located between the front face and the rear face of the detergent cup 700.

In one example, as shown in FIGS. 13 to 15, in an embodiment of the present disclosure, a top face 712 of the separation preventing protrusion 710 may be formed to be inclined downward as the top face 712 moves away from the rear wall of the wide width portion 703.

As described above, the separation preventing protrusion 710 is formed to protrude from the detergent cup 700 rearward. Thus, as the front end 701 of the detergent cup 700 is lifted upward, the detergent cup 700 may be separated from the detergent storage frame 390.

In addition, in an embodiment of the present disclosure, as the top face 712 facing the locking bar 350 of the separation preventing protrusion 710 is formed to be inclined downward as the top face 712 moves away from the rear wall of the wide width portion 703, the front end 701 of the detergent cup 700 corresponding to the portion in front of the separation preventing protrusion 710 is allowed to be lifted upward.

For example, when the entirety of the detergent cup 700 is moved toward the top face of the detergent storage frame 390, even when the top face 712 of the separation preventing protrusion 710 is formed to be inclined, because the upward movement of the separation preventing protrusion 710 is restricted by the locking bar 350, the deviation of the detergent cup 700 may be prevented.

On the other hand, when the user lifts the front end 701 of the detergent cup 700, even when the front end 701 of the detergent cup 700 is moved upward as the rear end 702 of the detergent cup 700 is moved forward as shown in FIG. 15, because the top face 712 of the separation preventing protrusion 710 is inclined downward, a distance to the locking bar 350 may be continuously secured and assembling and detachment of the detergent cup 700 may be facilitated.

Figure 16:
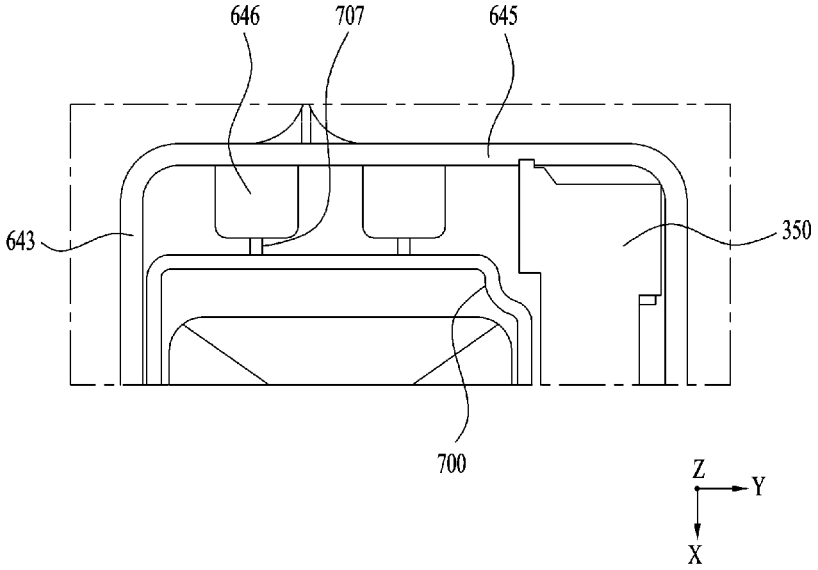
FIG. 16 is an enlarged view of a region C in FIG. 12.

In one example, FIG. 16 is an enlarged view of a region C in FIG. 12, and a rear spacer protrusion 646 disposed in the detergent containing region 650 is illustrated in FIG. 16.

Referring to FIG. 16, in an embodiment of the present disclosure, the detergent containing wall 640 may include a detergent containing rear wall 645 located at the rear of the detergent cup 700, and the detergent containing rear wall 645 may include the rear spacer protrusion 646 protruding toward the rear face of the detergent cup 700 to separate the detergent containing rear wall 645 and the rear face of the detergent cup 700 from each other.

The rear spacer protrusion 646 may protrude forward from the detergent containing rear wall 645. That is, the rear spacer protrusion 646 may protrude from the detergent containing rear wall 645 toward the detergent cup 700. By the rear spacer protrusion 646, the detergent cup 700 may be spaced apart from the detergent containing rear wall 645 by at least a protruding length of the rear spacer protrusion 646.

The detergent cup 700 is installed in the detergent containing region 650 surrounded by the detergent containing wall 640 and the top face thereof is opened. When the detergent is excessively injected during the use or the water is supplied from the dispenser 200, liquid may leak through the open top face of the detergent cup 700. The liquid may be the water or the detergent.

When the detergent cup 700 and the detergent containing wall 640 are in close contact with each other, the liquid leaking to the open top face of the detergent cup 700 may deviate from the detergent cup 700 and at the same time cross the detergent containing wall 640 and invade the exterior of the detergent containing region 650.

Accordingly, in an embodiment of the present disclosure, as the rear spacer protrusion 646 is disposed such that a separation distance is formed between the rear face of the detergent cup 700 and the detergent containing rear wall 645, the liquid leaking from the detergent cup 700 may not be able to deviate the detergent containing region 650 by being flowed into a portion between the detergent cup 700 and the detergent containing rear wall 645.

Figure 17:
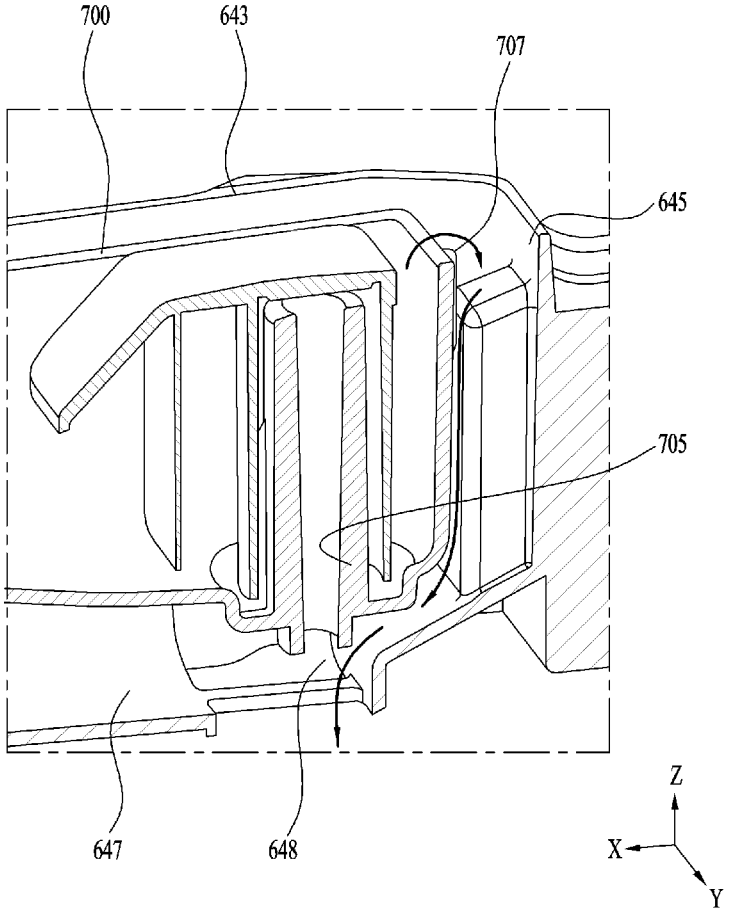
FIG. 17 is a cross-sectional view illustrating a rear end of a detergent cup coupled to a detergent storage frame in a laundry treating apparatus according to an embodiment of the present disclosure.

FIG. 17 illustrates a cross-section of the detergent cup 700 disposed in the detergent containing region 650, and a state in which the detergent cup 700 and the detergent containing rear wall 645 are separated from each other by the rear spacer protrusion 646 is illustrated in FIG. 17. In FIG. 17, a path of the liquid leaking through the open top face of the detergent cup 700 and collected at the portion between the detergent cup 700 and the detergent containing rear wall 645 is shown by arrows.

The rear spacer protrusion 646 may be in a form of a protrusion protruding from the detergent containing rear wall 645, or may be in various forms, such as a rib extending parallel to the detergent containing rear wall 645.

In one example, referring to FIG. 16, in an embodiment of the present disclosure, the detergent cup 700 may further include rear spacer ribs 707 protruding from the rear face thereof facing the detergent containing rear wall 645 to face the rear spacer protrusion 646 and in contact with the rear spacer protrusion 646. FIG. 13 illustrates the rear face of the detergent cup 700 on which the rear spacer ribs 707 are formed.

The rear spacer ribs 707 may protrude rearward from the rear face of the detergent cup 700. In addition, each rear spacer rib 707 may be disposed such that at least a portion thereof faces toward the rear spacer protrusion 646 in front and rear direction.

That is, in the detergent cup 700, each rear spacer rib 707 may be in contact with each rear spacer protrusion 646. The detergent cup 700 may further secure the separation distance to the detergent containing rear wall 645 by the rear spacer rib 707, and may stably in contact with the rear spacer protrusion 646. Further, rigidity of the rear face of the detergent cup 700 may be effectively reinforced.

The rear spacer ribs 707 may be extended in a direction parallel to the rear face of the detergent cup 700. When the rear spacer protrusion 646 is in a form of a rib extending in the direction parallel to the rear face of the detergent cup 700, the rear spacer rib 707 extends parallel to the rear spacer protrusion 646, so that an entirety of the rear spacer rib 707 may face the rear spacer protrusion 646.

FIG. 16 illustrates the rear spacer protrusions 646 and the rear spacer ribs 707 extending in the vertical direction according to an embodiment of the present disclosure, but the present disclosure is not limited thereto.

Figure 18:
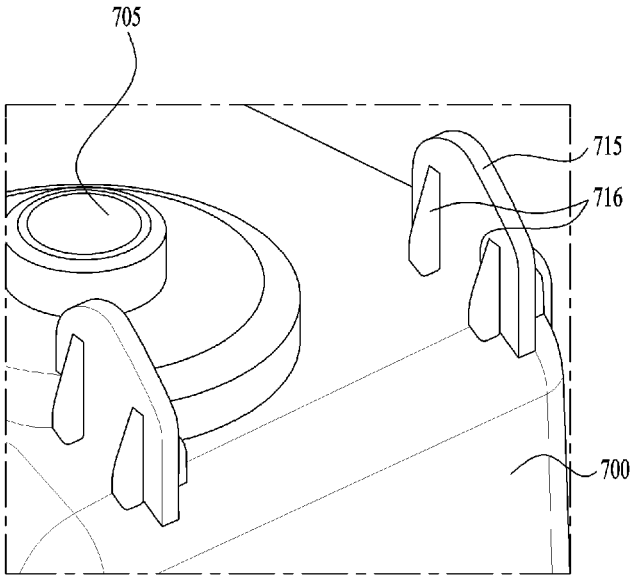
FIG. 18 is a view illustrating a detergent cup leg of a detergent cup in a laundry treating apparatus according to an embodiment of the present disclosure.

In one example, FIG. 18 illustrates a bottom face of the detergent cup 700. Referring to FIG. 18, in an embodiment of the present disclosure, the detergent cup 700 may further include a detergent cup leg 715.

The detergent cup leg 715 protrudes from the bottom face of the detergent cup 700 toward the detergent containing bottom face 647 to separate the bottom face of the detergent cup 700 from the detergent containing bottom face 647. That is, the detergent cup 700 is supported by the detergent cup leg 715, so that the bottom face of the detergent cup 700 may be separated from the detergent containing bottom face 647, and a separation distance between the bottom face of the detergent cup 700 and the detergent outlet 648 may be secured.

Accordingly, the detergent and the like discharged from the detergent container 340 and the detergent cup 700 may be efficiently flowed into the detergent outlet 648.

In one example, as shown in FIG. 18, the detergent cup leg 715 may further include leg reinforcing ribs 716. The leg reinforcing ribs 716 may protrude from the detergent cup leg 715 and may be connected to the bottom face of the detergent cup 700.

The detergent cup leg 715 may protrude downward from the bottom face of the detergent cup 700, and the leg reinforcing ribs 716 may protrude from the detergent cup 700 in the left and right direction and the like. FIG. 18 illustrates a state in which the detergent cup leg 715 extends in the front and rear direction and the leg reinforcing ribs 716 protrude in the left and right direction from a side face of the detergent cup leg 715, according to an embodiment of the present disclosure.

The leg reinforcing ribs 716 may be connected to the bottom face of the detergent cup 700 together with the detergent cup leg 715. Accordingly, an area of the bottom face of the detergent cup 700 where a load transferred to the detergent cup leg 715 is distributed may increase, and rigidity of the bottom face of the detergent cup 700 or the detergent cup leg 715 may be improved.

Figure 19:
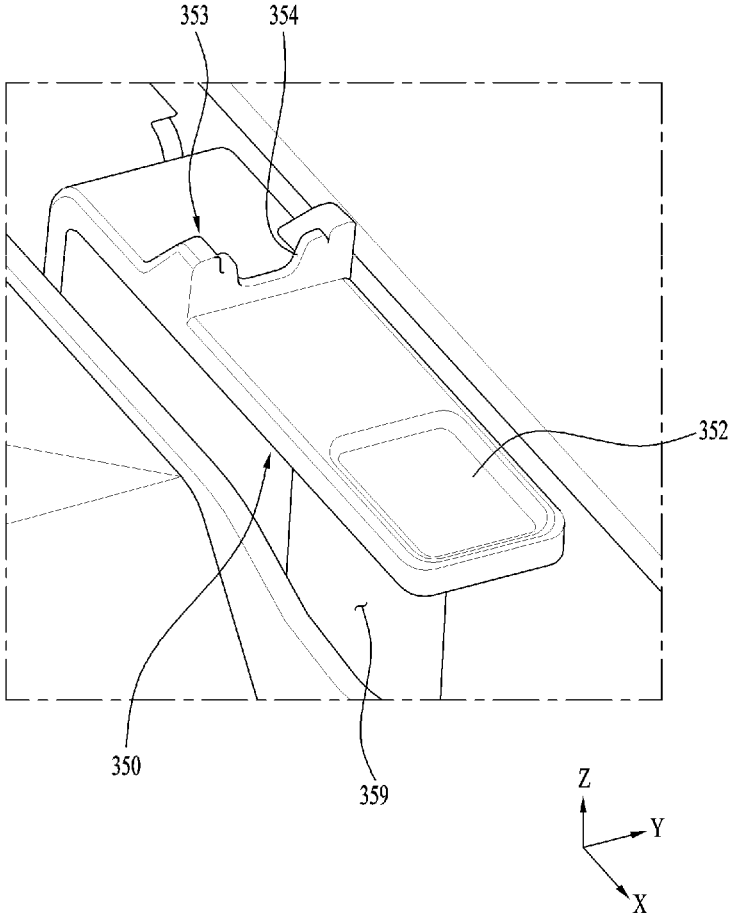
FIG. 19 is an enlarged view of a region A in FIG. 7.
Figure 20:
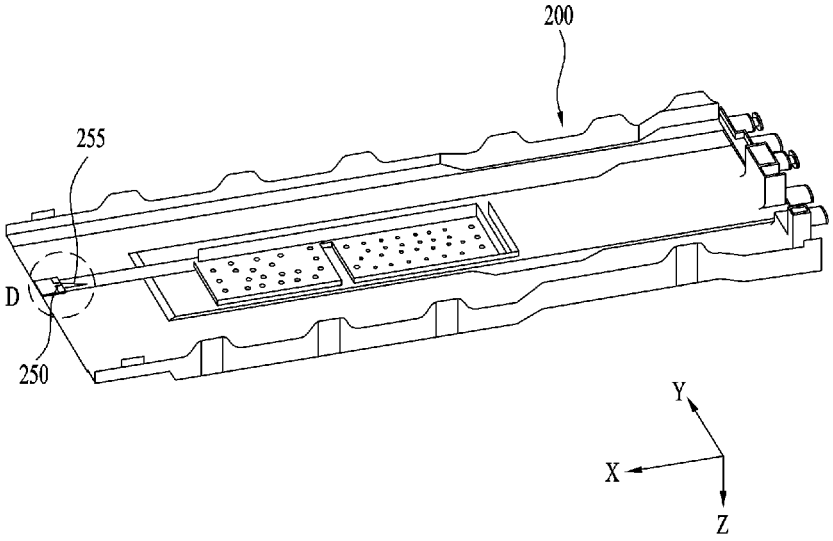
FIG. 20 is a view illustrating a bottom face of a dispenser in a laundry treating apparatus according to an embodiment of the present disclosure.
Figure 21:
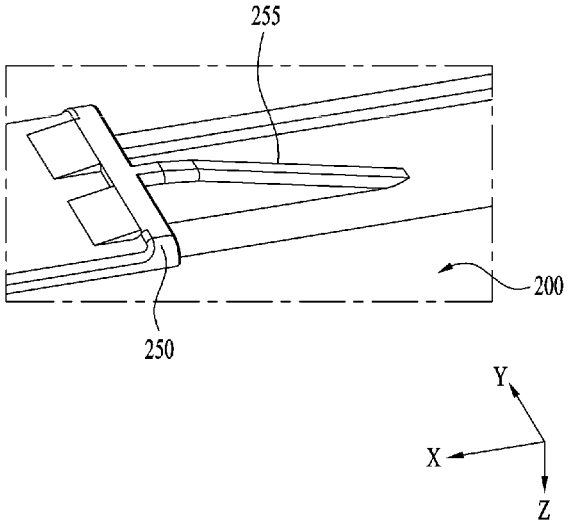
FIG. 21 is an enlarged view of a region D in FIG. 20.

In one example, FIG. 19 illustrates an enlarged view of a region A in FIG. 7, FIG. 20 illustrates the bottom face of the dispenser 200, and FIG. 21 is an enlarged view of a region D in FIG. 20.

Figure 22:
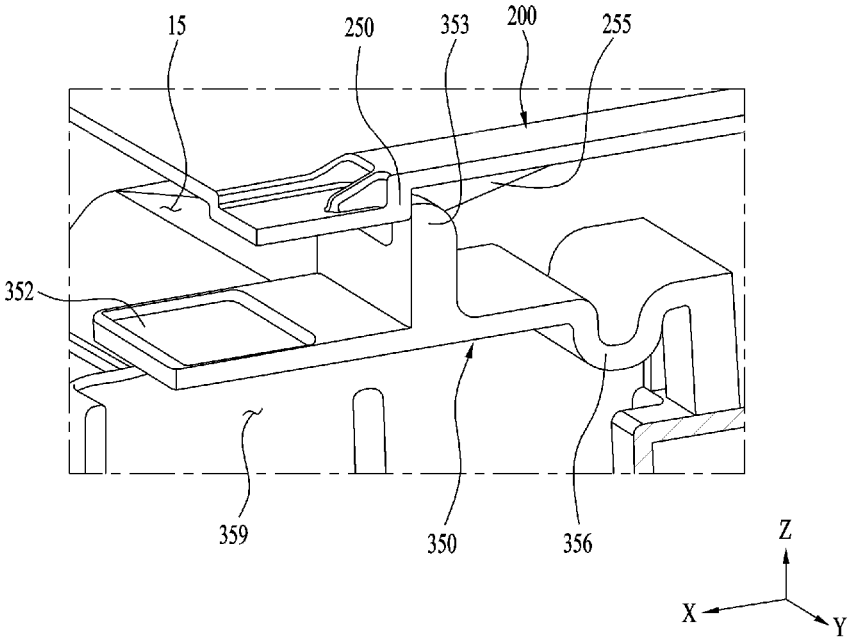
FIG. 22 is a view illustrating a stopper and an engaging portion in a laundry treating apparatus according to an embodiment of the present disclosure.

In addition, FIG. 22 illustrates a state in which the stopper 250 and the locking protrusion 353 are in contact with each other according to an embodiment of the present disclosure.

Referring to FIGS. 19 to 22, an embodiment of the present disclosure may further include the stopper 250 protruding downward from the fixing portion and the locking protrusion 353 protruding upward from the top face of the locking bar 350.

FIG. 19 illustrates the locking protrusion 353 disposed on the locking bar 350, and FIGS. 20 and 21 illustrate the stopper 250 disposed on the bottom face of the dispenser 200.

The stopper 250 may be disposed to overlap the locking protrusion 353 along the front and rear direction of the detergent storage 300, and may be spaced forwardly apart from the front of the locking protrusion 353 in the state in which the detergent storage 300 is retracted into the cabinet 10.

In the process in which the detergent storage 300 is extended from the cabinet 10, the locking protrusion 353 comes into contact with the stopper 250, so that the extension distance may be restricted.

Specifically, the stopper 250 may protrude downward from the fixing portion, for example, the dispenser 200, and the locking protrusion 353 may protrude upward from the locking bar 350. The stopper 250 and the locking protrusion 353 may be arranged to overlap each other along the front and rear direction.

That is, the locking protrusion 353 disposed on the detergent storage 300 may be in contact with the stopper 250 in the extension process of the detergent storage 300 and may be restricted in the movement. As the movement of the locking protrusion 353 is restricted by the stopper 250, the extension distance of the detergent storage 300 may be restricted.

In the state in which the detergent storage 300 is fully retracted into the cabinet 10, the extension distance of the detergent storage 300 in which the movement of the locking protrusion 353 is restricted by the stopper 250 may correspond to the set extension distance of the present disclosure described above.

Thus, in the state in which the detergent storage 300 is fully retracted into the cabinet 10, the stopper 250 may be disposed to be forwardly spaced apart from the locking protrusion 353, and a separation distance between the stopper 250 and the locking protrusion 353 may correspond to the separation distance between the sagging preventing protrusion 520 and the sagging preventing elastic portion 510, which corresponds to the set extension distance described above.

When the user extends the detergent storage 300 by gripping the handle 305 of the detergent storage 300 in the state in which the detergent storage 300 is retracted into the opening 15, and when the locking protrusion 353 of the detergent storage 300 in in contact with the stopper 250 of the dispenser 200, the extension of the detergent storage 300 may be restricted and the user may store the detergent using the detergent storage 300 extended by the set extension distance.

That is, in the state in which the locking protrusion 353 is in contact with the stopper 250, the sagging preventing protrusion 520 of the detergent storage 300 may overlap the sagging preventing elastic portion 510 of the dispenser 200 in the vertical direction to prevent sagging of the detergent storage 300.

The stopper 250 and the sagging preventing elastic portion 510 may be arranged on the front end of the dispenser 200, that is, the fixing portion. In this case, the locking protrusion 353 and the sagging preventing protrusion 520 may be positioned in parallel with each other in the left and right direction.

In an embodiment of the present disclosure, as the locking protrusion 353 and the stopper 250 are arranged, it is easy for the user to extend the detergent storage 300 only by the set extension distance, so that the detergent supply 100 may be efficiently utilized.

The stopper 250 may be disposed on the bottom face of the dispenser 200 so as not to overlap the aforementioned engaging elastic portion 220 and sagging preventing elastic portion 510 in the front and rear direction. That is, the stopper 250 may be disposed to be spaced apart from the engaging elastic portion 220 and the sagging preventing elastic portion 510 in the left and right direction.

The locking protrusion 353 may be disposed not to overlap the engaging protrusion 320 in the front and rear direction. For example, the engaging protrusion 320 may be disposed on the side wall of the detergent storage frame 390, and the locking protrusion 353 may be disposed at a center of the detergent storage frame 390 based on the left and right direction.

Shapes of the stopper 250 and the locking protrusion 353 may vary. The stopper 250 may have a flat face facing the locking protrusion 353 and in contact with the locking protrusion 353, and the locking protrusion 353 may also have a flat face facing the stopper 250 and in contact with the stopper 250.

In one example, in an embodiment of the present disclosure, the locking bar 350 may be constructed such that the locking bar 350 extends from the detergent containing rear wall 645 toward the wide width portion 703, and a front end thereof positioned above the separation preventing protrusion 710 forms a free end and is downwardly movable.

The locking bar 350 may be located at the rear of the wide width portion 703, may be positioned higher than the separation preventing protrusion 710, and may extend from the detergent containing rear wall 645 toward the wide width portion 703.

That is, the locking bar 350 may have a rear end fixed to the detergent containing rear wall 645, and the front end thereof facing the rear wall of the wide width portion 703 may form the free end and may be moved downward in response to a pressure. The locking protrusion 353 may protrude upward between the front end and the rear end of the locking bar 350.

The locking bar 350 is elastically deformed, so that the front end may be moved in the vertical direction with respect to the rear end. This may be accomplished by the user pressing the front end of the locking bar 350.

Figure 23:
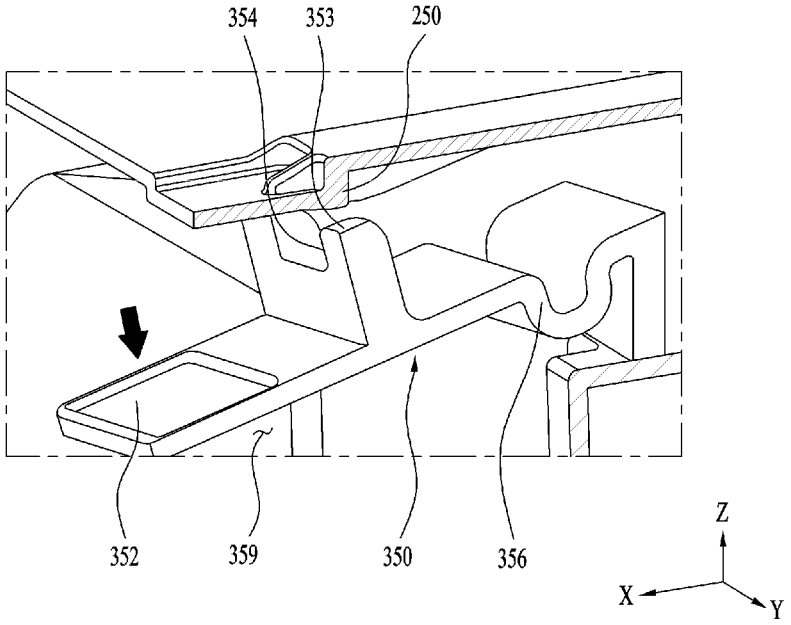
FIG. 23 is a view illustrating a state in which an engaging bar illustrated in FIG. 22 is pressed downward.

FIG. 23 illustrates a state in which the front end of the locking bar 350 in FIG. 22 is pressed and moved downward. The detergent storage 300 may have a deformation space 359 defined underneath the front end of the locking bar 350 in which the front end of the locking bar 350 may be moved downward.

The deformation space 359 may correspond to a portion rearward of the wide width portion 703 and may correspond to a portion next to the rear end 702 of the detergent cup 700. The separation preventing protrusion 710 may be located in the deformation space 359, and the separation preventing protrusion 710 may be spaced downwardly apart from the locking bar 350 so as not to interfere the downward movement of the front end of the locking bar 350.

The locking bar 350 may have the pressing portion 352 pressed by the user on a top face of the front end. The front end may be elastically deformed so as to move toward the deformation space 359 by a pressing force transmitted to the pressing portion 352. A groove may be defined in the pressing portion 352 to facilitate the user's pressing.

A width of the deformation space 359 may correspond to a width of the locking bar 350. That is, a width of the wide width portion 703 may correspond to the width of the locking bar 350. When the front end of the locking bar 350 is pressed and moved downward, the locking protrusion 353 protruding upward from the locking bar 350 is also moved downward.

Accordingly, as shown in FIG. 23, the locking protrusion 353 and the stopper 250 do not overlap each other in the front and rear direction, so that the user may extend the detergent storage 300 fully from the interior of the cabinet 10.

In one example, in an embodiment of the present disclosure, in the state in which the locking protrusion 353 is in contact with the stopper 250, the front end of the locking bar 350, the detergent container 340, and the detergent cup 700 may be exposed to the outside of the cabinet 10 through the opening 15.

As described above, when the locking protrusion 353 and the stopper 250 are in contact with each other, the detergent storage 300 is in the state of being extended by the set extension distance according to an embodiment of the present disclosure. In this connection, the front end of the locking bar 350, the detergent container 340, and the detergent cup 700 may be exposed to the outside of the cabinet 10 through the opening 15.

Therefore, in the situation in which the detergent storage 300 is extended by the set extension distance determined by design by the locking protrusion 353 and the stopper 250, the user may inject the detergent into the detergent container 340 and the detergent cup 700 exposed to the outside of the cabinet 10. When necessary, the user may press the front end of the locking bar 350 exposed to the outside of the cabinet 10 to move the locking protrusion 353 downward and may fully extend the detergent storage 300.

In addition, in an embodiment of the present disclosure, the locking bar 350 may include a bent portion 356 positioned rearward of the locking protrusion 353 and bent in the vertical direction.

FIGS. 22 and 23 illustrate the bent portion 356 bent to protrude downward. The bent portion 356 may be formed in a bent or curved shape, so that the front end of the locking bar 350 may be easily moved in the vertical direction.

That is, in an embodiment of the present disclosure, when the pressing portion 352 is pressed while the front end of the locking bar 350 maintains a shape thereof with rigidity, the bent portion 356 may be deformed, so that the front end of the locking bar 350 may be moved downward.

Unlike the front end or the rear end of the locking bar 350, the bent portion 356 may be made of a material having high elasticity, or may be integrally molded with the front end and the rear end as an entirety of the locking bar 350 and be formed in a curved shape.

In one example, referring to FIGS. 20 and 21, in an embodiment of the present disclosure, the fixing portion or the dispenser 200 may further include a guide protrusion 255. The guide protrusion 255 may have a smaller width than the stopper 250 and extend rearward from the rear face of the stopper 250 to guide the front end of the locking bar 350 to be located below the stopper 250.

The penetration groove 354 recessed downward and opened in the front and rear direction is defined at a center of the locking protrusion 353 in the left and right direction. In the extension process of the detergent storage 300, the locking protrusion 353 may be in contact with the stopper 250 as the guide protrusion 255 is inserted into the penetration groove 354.

In the extension process of the detergent storage 300, the front end of the locking bar 350 protruding forward to form the free end may be unintentionally caught by the stopper 250 depending on a use environment.

In this case, the user becomes not able to extend the detergent storage 300 by the set extension distance and the detergent reservoir 310 or the detergent container 340 becomes not able to be exposed to the outside of the detergent opening 15, which may make it difficult for the user to use the apparatus.

An embodiment of the present disclosure may include the guide protrusion 255 and the penetration groove 354 to prevent the front end of the locking bar 350 from interfering with the extension of the detergent storage 300 by being in contact with the stopper 250.

The guide protrusion 255 may have the smaller width than the stopper 250, and the penetration groove 354 may have a width corresponding to the guide protrusion 255. The engaging portion 353 may have a larger width than the penetration groove 354.

The guide protrusion 255 extends rearward from a rear face of the stopper 250. Accordingly, the situation in which the locking bar 350 is unintentionally positioned such that the front end overlaps the stopper 250 may be prevented.

For example, in the extension process of the detergent storage, a vertical level of the front end of the locking bar 350 may be restricted by the guide protrusion 255 before reaching the stopper 250. Accordingly, the front end of the locking bar 350 that has reached the stopper 250 is positioned at a vertical level lower than the stopper 250 by the guide protrusion 255, so that the front end of the locking bar 350 does not contact the stopper 250.

In one example, the penetration groove 354 is defined at the center of the locking protrusion 353 and the locking protrusion 353 moves forward in the state in which the guide protrusion 255 is inserted into the penetration groove 354, so that there is no restriction of the movement by the guide protrusion 255.

When the locking protrusion 353 reaches the stopper 250, the locking protrusion 353 having the larger width than the penetration groove 354 overlaps and in contact with the stopper 250 having the larger width than the guide protrusion 255. Therefore, the locking protrusion 353 may be completely in contact with the stopper 250 and may restrict the extension of the detergent storage 300 at the set extension distance.

In one example, in an embodiment of the present disclosure, as the guide protrusion 255 is further away from the stopper 250, a protruding height thereof from the fixing portion gradually decreases, so that a bottom face thereof may be inclined. FIGS. 20 and 21 illustrate the guide protrusion 255 having the inclined bottom face viewed from below.

As the bottom face of the guide protrusion 255 is inclined such that the protruding length or height thereof decreases rearwardly, the situation in which the front end of the locking bar 350 is unintentionally caught by the guide protrusion 255 and the movement thereof is restricted may be effectively prevented. Further, because the front end of the locking bar 350 is naturally induced to be at a vertical level lower than the stopper 250 along the inclined bottom face, the unintended overlapping situation of the locking bar 350 may be effectively prevented.

Figure 24:
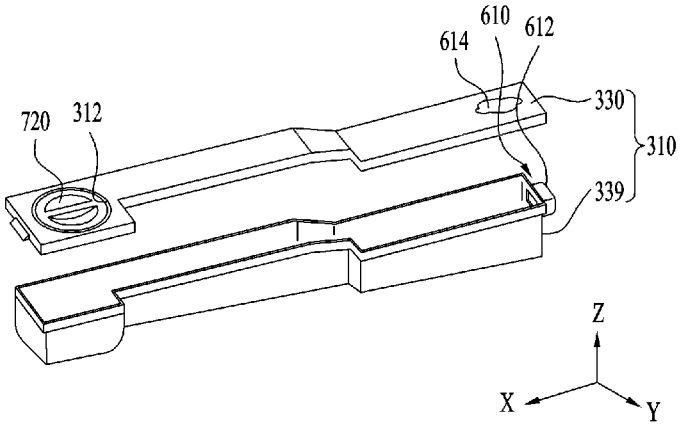
FIG. 24 is an exploded perspective view of a detergent reservoir in a laundry treating apparatus according to an embodiment of the present disclosure.

In one example, FIG. 24 illustrates a disassembled state of the detergent reservoir 310. Specifically, FIG. 24 illustrates the cap member 330 and the casing 339 of the detergent reservoir 310.

In an embodiment of the present disclosure, the detergent reservoir 310 may include a pair of detergent reservoirs, and the pair of detergent reservoirs 310 may be arranged adjacent to each other in the left and right direction and may extend along the front and rear direction of the detergent storage 300.

The pair of detergent reservoirs 310 are recessed in a direction in which respective central portions between the respective front ends and the respective rear ends are away from each other, so that the detergent container 340 and the detergent cup 700 may be located in a space defined between the respective central portions. Such arrangement of the detergent reservoir 310, the detergent container 340, and the detergent cup 700 may be seen in FIG. 7.

The front end of the detergent reservoir 310 may be a detergent injection portion 313 in which a detergent injection hole 312 is defined. As the front end of the detergent reservoir 310 forms the detergent injection portion 313, even when the user extends the detergent storage 300 by the set extension distance described above, the detergent may be injected into the detergent injection hole 312.

The rear end of the detergent reservoir 310 may be a detergent discharge portion 317 including a detergent valve 380 from which the detergent is discharged. The detergent inside the detergent reservoir 310, for example, the first detergent, may be discharged from the detergent reservoir 310 through the detergent valve 380.

The central portion of the detergent reservoir 310 may be a connection portion 315. That is, the connection portion 315 may be a portion connecting the detergent injection portion 313 and the detergent discharge portion 317 to be described later. In addition, the central portion corresponding to the connection portion 315 may have a width smaller than widths of the front end and the rear end and may extend in the front and rear direction.

Referring to FIG. 7, in an embodiment of the present disclosure, the detergent reservoir 310 may include a pair of detergent reservoirs. The detergent reservoirs 310 may extend along the front and rear direction, and may be arranged adjacent to each other in the left and right direction.

In one example, the respective central portions of the pair of detergent reservoirs 310 may be recessed in the direction away from each other. That is, the pair of detergent reservoirs 310 may be constructed such that side walls facing each other of the respective central portions are away from each other, so that the width of the central portion may be smaller than the widths of the front end and the rear end.

Accordingly, a separation space is defined between the central portions of the pair of detergent reservoirs 310. The spaced space may be the detergent containing region 650 in the detergent storage frame 390. The detergent container 340 and the detergent cup 700 may be arranged in the detergent containing region 650.

In an embodiment of the present disclosure, as the detergent container 340 and the detergent cup 700 are arranged along with the pair of detergent reservoirs 310, the detergent container 340 and the detergent cup 700 are arranged at the center of the detergent storage frame 390. Further, the detergent reservoirs 310 are arranged in a form surrounding the detergent container 340 and the detergent cup 700, which allows optimal utilization of the space of the detergent storage frame 390 and allows the user to conveniently utilize the plurality of divided detergent storage spaces.

In addition, the same detergent or the different detergents may be stored in the pair of detergent reservoirs 310. For example, the first detergent may be stored in the detergent reservoir 310, the second detergent may be stored in the detergent container 340, and the third detergent may be stored in the detergent cup 700. The different first and second detergents may be respectively stored in the pair of detergent reservoirs 310.

The distinguishment of the detergent as described above is for convenience of description or to present one of utilization schemes of the detergent storage 300 according to an embodiment of the present disclosure, and is not necessarily limited thereto. In case of using the detergents distinguished as above, the user may distinguish the different types of detergents such as the liquid detergent, the powder detergent, the fabric softener, and the like and respectively store the detergents in the plurality of detergent storage spaces described above.

In one example, in an embodiment of the present disclosure, the detergent reservoir 310 may include the casing 339 and the cap member 330 as shown in FIG. 24. The casing 339 may have an open top face and have a detergent storage space defined therein in which the first detergent is stored. In addition, the cap member 330 may be detachably coupled to the casing 339 to shield the top face of the casing 339.

The casing 339 and the cap member 330 may be extended in the front and rear direction to correspond to the detergent storage frame 390. The cap member 330 may have a groove defined therein extending along an edge thereof. An end of a side wall of the casing 339 may be inserted into the groove to be detachably coupled to the cap member 330. The detergent reservoir 310 may be retracted into or extended from the opening 15 while being inserted into the detergent storage frame 390.

Figure 25:
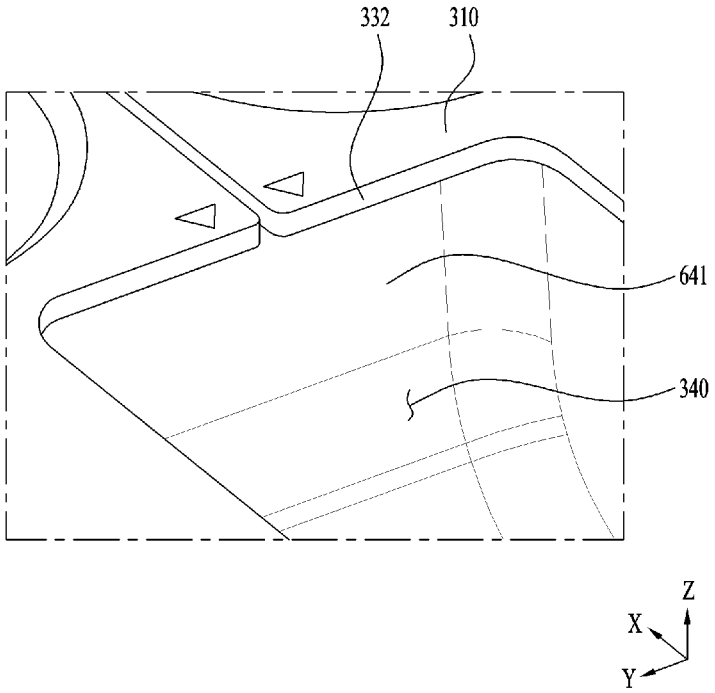
FIG. 25 is a view illustrating a gripping portion of a detergent reservoir in a laundry treating apparatus according to an embodiment of the present disclosure.

In one example, FIG. 25 illustrates the detergent containing front wall 641 viewed from the rear in the state in which the detergent reservoir 310 is inserted. A front end of the detergent reservoir 310, that is, a portion of the detergent injection portion 313 of the detergent reservoir 310 may be located in front of the detergent containing front wall 641.

Figure 26:
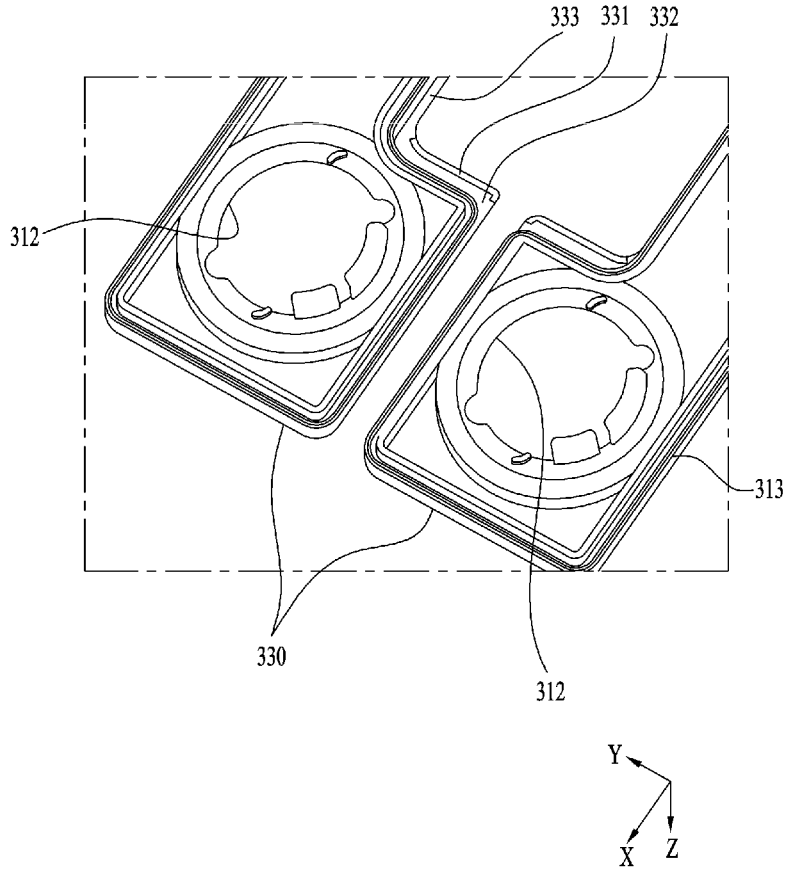
FIG. 26 is a view of a cap member of a detergent reservoir viewed from below in a laundry treating apparatus according to the embodiment of the present disclosure.
Figure 27:
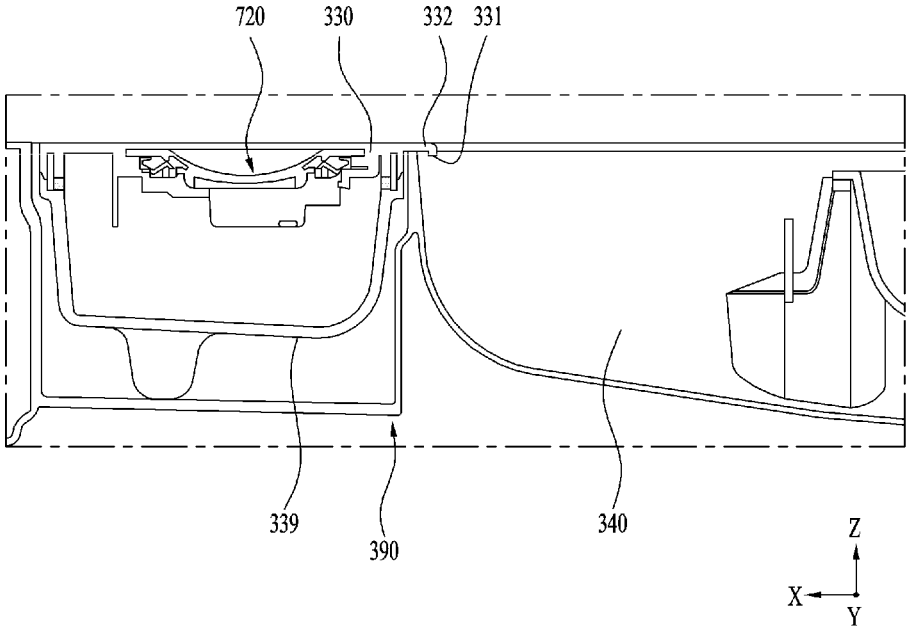
FIG. 27 is a cross-sectional view of detergent storage in FIG. 7 taken along a line B-B.

FIG. 26 is a view of the cap member 330 on a side of the detergent injection portion 313 in the detergent reservoir 310 viewed from below, and FIG. 27 illustrates a cross-section of the detergent storage 300 in FIG. 7 taken along a line B-B. FIG. 27 illustrates a shape of a gripping portion 332 protruding from the detergent reservoir 310.

Referring to FIGS. 25 to 27, an embodiment of the present disclosure may further include the gripping portion 332 protruding rearward from a protruding portion protruding in the left and right direction than the central portion at the front end of the detergent reservoir 310.

As described above, the detergent reservoir 310 is constructed such that the detergent injection portion 313 corresponding to the front end has a larger width than the connection portion 315 corresponding to the central portion. Accordingly, the detergent injection portion 313 may have a protruding portion that protrudes more in the width direction than the connection portion 315.

The protruding portion may be located in front of the detergent containing region 650, that is, the detergent containing front wall 641. In addition, an embodiment of the present disclosure may further include the gripping portion 332 protruding rearward from the protruding portion.

As the gripping portion 332 protrudes rearward from the protruding portion, the gripping portion 332 may be located in the detergent containing region 650, that is, on the open top face of the detergent container 340.

A shape of the gripping portion 332 may be various. As will be described later, the shape of the gripping portion 332 may include a shape of a flange extending from the detergent reservoir 310. As the gripping portion 332 is formed on the detergent reservoir 310, in a process of detaching the detergent reservoir 310 coupled to the detergent storage frame 390, the front end of the detergent reservoir 310 may be lifted by gripping the gripping portion 332.

In one example, in an embodiment of the present disclosure, the gripping portion 332 may extend from the cap member 330 toward the top face of the detergent container 340 in parallel with the top face of the casing 339, and may have a protrusion 331 protruding downward at an end thereof extending rearward.

Specifically, as shown in FIG. 26, in an embodiment of the present disclosure, the cap member 330 may include a flange portion 333. The flange portion 333 may extend from the top face of the casing 339 along the top face of the detergent container 340.

In other words, the flange portion 333 may correspond to a protruding portion of the cap member 330 extending in parallel with the top face of the casing 339. The flange portion 333 may be formed on an entirety or only a portion of the edge of the cap member 330.

The flange portion 333 may extend beyond the detergent containing front wall 641 and the detergent containing side wall 643 from the cap member 330. In addition, the gripping portion 332 may be included in the flange portion 333. As described above, the gripping portion 332 may extend to the top face of the detergent container 340 beyond the detergent containing front wall 641.

In one example, the gripping portion 332 may be provided with a protrusion 331 protruding downward from an extended end of the flange portion 333. As the gripping portion 332 is constructed as a portion of the flange portion 333, the gripping portion 332 is constructed to protrude from the top face of the casing 339.

The user may grip the gripping portion 332 to detach the cap member 330 from the detergent reservoir 310. The gripping portion 332 protrudes in parallel with the top face of the casing 339, so that the user may easily grip the gripping portion 332.

FIG. 27 illustrates a cross-section of the gripping portion 332 on which the protrusion 331 extending away from the top face of the casing 339 to be positioned on the open top face of the detergent container 340 and protruding downward is formed.

The gripping portion 332 may have the protrusion 331 protruding downward so as to be advantageously gripped by the user. That is, when the user grips the gripping portion 332, a finger is caught by the protrusion 331 protruding downward, so that the user may effectively grip the gripping portion 332.

The gripping portion 332 is positioned above the detergent container 340 and prevents the detergent contained in the detergent container 340 from splashing to the outside. Specifically, the detergent reservoir 310 and the detergent container 340 are extended from the detergent opening 15 together with the detergent storage frame 390 or retracted to the detergent opening 15. In the detergent container 340, whose top face is opened by the motion generated in this process, the internal detergent may splash outward due to inertia or impact.

An embodiment of the present disclosure may block the flow of the detergent of scattering or splashing from the auxiliary detergent container 340 and prevent leakage of the detergent as the flange portion 333 and the gripping portion 332 of the cap member 330 extend above the detergent container 340.

In addition, because the gripping portion 332 has the protrusion 331 protruding downward at the extended end thereof, the protrusion 331 contributes to suppressing the motion of the detergent splashing out of the detergent container 340.

For example, the detergent splashing toward the gripping portion 332 is not able to be scattered outward by an extended face of the gripping portion 332 and is returned to the detergent container 340, but may still have a fast speed in the return process. Accordingly, the returned detergent may induce another scattering of the detergent by applying an impact or transmitting a kinetic force to the detergent inside the detergent container 340.

However, in an embodiment of the present disclosure, as the protrusion 331 protruding downward is disposed on the gripping portion 332, the flow of the detergent that did not leak outward by the extended face of the gripping portion 332 is inhibited once again by the protrusion 331 of the gripping portion 332, so that the speed of the detergent is greatly reduced. Therefore, in the process in which the scattered detergent returns back to the detergent container 340, the kinetic force may be greatly reduced and stable return may be induced.

In an embodiment of the present disclosure, the detergent reservoir 310 may be positioned in front of and next to the detergent container 340, the flange portion 333 may be positioned at a front portion and a side portion of the top face of the detergent container 340, and the gripping portion 332 may be formed at a front portion of the flange portion 333 positioned at the front portion of the detergent container 340.

The detergent reservoir 310 may include a plurality of detergent reservoirs and the plurality of detergent reservoirs may be respectively disposed in the front of and next to the detergent container 340. Alternatively, at least one face of the detergent reservoir 310 may be bent such that one of the detergent reservoirs may be positioned both in the front and next to the detergent container 340.

The flange portion 333 may have the gripping portion 332 formed at the front side of the detergent container 340. Accordingly, the situation in which the detergent splashed forward of the detergent container 340 may be more effectively prevented by the gripping portion 332.

The detergent storage 300 is moved inside the opening 15 along the front and rear direction, so that the detergent is easy to splash forward. Therefore, an embodiment of the present disclosure may effectively suppress the leakage of the detergent by disposing the gripping portion 332 at the front side of the detergent container 340 on the flange portion 333 positioned at the front portion and the side portion of the top face of the detergent container 340.

Furthermore, in the situation in which the detergent storage 300 is extended by the set extension distance or fully extended from the cabinet 10, the user grips the gripping portion 332 positioned at the front side of the detergent container 340, so that the cap member 330 may be efficiently detached from the casing 339 of the detergent reservoir 310, which is advantageous.

Figure 28:
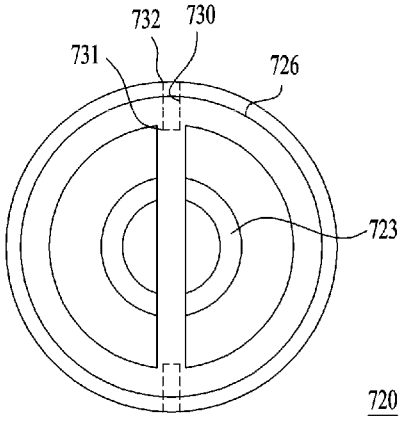
FIG. 28 is a top view of a detergent cap in a laundry treating apparatus according to an embodiment of the present disclosure.
Figure 29:
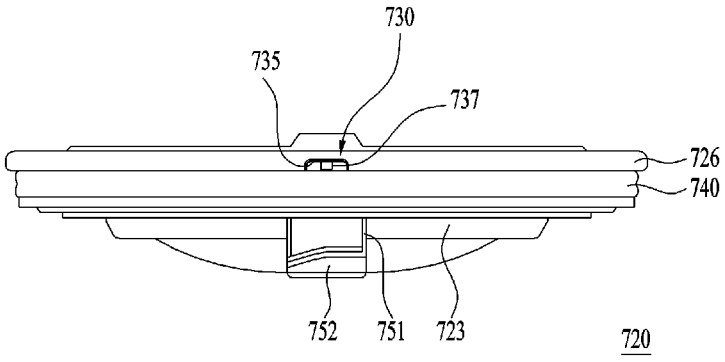
FIG. 29 is a side view of a detergent cap in a laundry treating apparatus according to an embodiment of the present disclosure.
Figure 30:
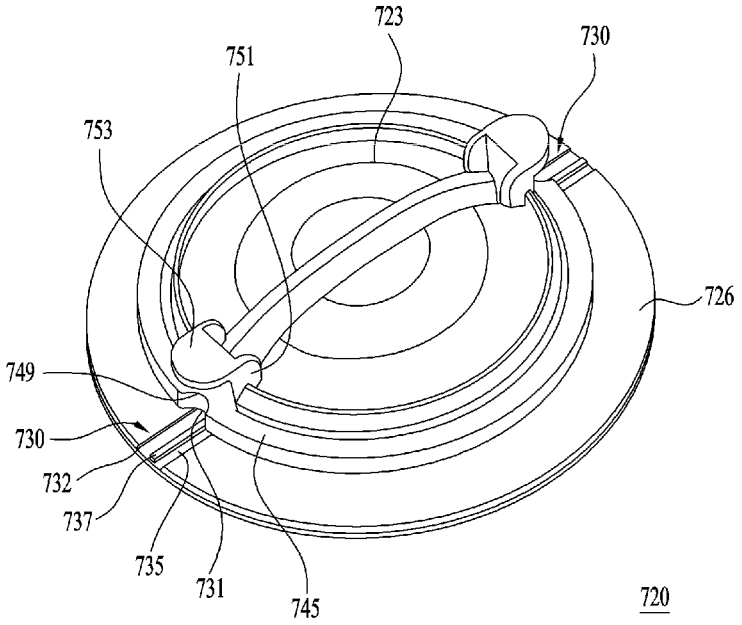
FIG. 30 is a rear view of a detergent cap in a laundry treating apparatus according to an embodiment of the present disclosure.

In one example, FIG. 24 illustrates the detergent cap 720 coupled to the cap member 330, and FIG. 28 illustrates a view of the detergent cap 720 from above. FIG. 29 illustrates the detergent cap 720 viewed from the side, and FIG. 30 illustrates the detergent cap 720 viewed from below.

Figure 31:
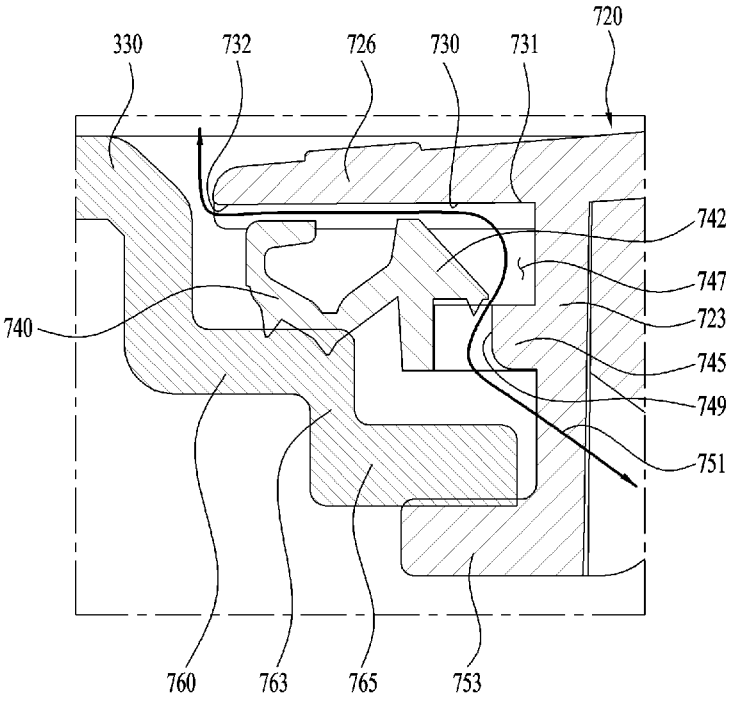
FIG. 31 is a cross-sectional view of a detergent cap coupled to a detergent reservoir in a laundry treating apparatus according to an embodiment of the present disclosure.
Figure 32:
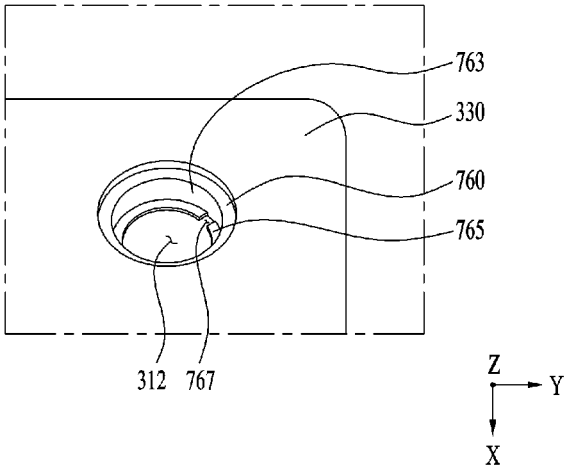
FIG. 32 is a view illustrating a detergent injection hole of a detergent reservoir in a laundry treating apparatus according to an embodiment of the present disclosure.

In one example, FIG. 31 illustrates a cross-section of the detergent cap 720 coupled to the cap member 330 of the detergent reservoir 310, and FIG. 32 illustrates a view of the detergent injection hole 312 of the detergent reservoir 310 viewed from the outside.

Referring to FIGS. 28 to 32, in an embodiment of the present disclosure, the detergent reservoir 310 includes the detergent injection hole 312 defined therein in communication with the internal detergent storage space. The detergent cap 720 may be coupled to the detergent reservoir 310 such that the detergent injection hole 312 is shielded.

The internal detergent storage space of the detergent reservoir 310 is opened through the detergent injection hole 312. The user may inject the detergent into the detergent storage space through the detergent injection hole 312. A location and a shape of the detergent injection hole 312 may be varied. FIG. 24 illustrates a state in which the detergent injection hole 312 is defined in the cap member 330 according to an embodiment of the present disclosure. The detergent injection hole 312 may be located at the front end of the detergent reservoir 310, that is, the detergent injection portion 313 of the detergent reservoir 310.

In one example, referring to FIGS. 31 and 32, the detergent reservoir 310 may include a cap support 760. The cap support 760 may surround the detergent injection hole 312 and support at least a portion of the detergent cap 720.

FIGS. 31 and 32 illustrate the cap support 760 disposed to upwardly support at least a portion of the detergent cap 720, for example, a cap flange portion 726 to be described later according to an embodiment of the present disclosure.

The cap support 760 may be formed integrally with the cap member 330 or may be manufactured separately and coupled to the cap member 330. The cap support 760 may have a ring shape surrounding the detergent injection hole 312. The ring shape may have a closed cross-section corresponding to a shape of the cross-section of the detergent injection hole 312. For example, FIG. 32 illustrates the cap support 760 having a circular ring shape to correspond to the detergent injection hole 312 of the circular cross-section.

The cap support 760 may correspond to a portion of an outer face of the cap member 330 or may be constructed to be stepped from the outer face of the cap member 330 to have a different height from the outer face. FIGS. 31 and 32 illustrate the cap support 760 spaced apart from the outer face of the cap member 330 toward the detergent storage space.

In one example, the detergent cap 720 may include a cap body 723, the cap flange portion 726, and a flange extension. At least a portion of the cap body 723, for example, an end of the cap body 723 may be inserted into the detergent injection hole 312. A shape of the cap body 723 may vary. A cross-section shape of the cap body 723 may correspond to the cross-section shape of the detergent injection hole 312. For example, FIG. 28 illustrates a state in which the cap body 723 inserted into the detergent injection hole 312 having the circular cross-section shape has a circular cross-section.

However, the cross-section shape of the cap body 723 does not necessarily have to match the cross-section shape of the detergent injection hole 312. A length of the cap body 723 may vary, and may be constructed such that, when the detergent cap 720 is coupled to the detergent reservoir 310 in the vertical direction as shown in FIG. 31, at least a portion, for example, a lower end thereof may be inserted into the detergent reservoir 310.

The cap flange portion 726 may extend or protrude from the cap body 723 in the radial direction of the detergent injection hole 312 to extend along a circumference of the detergent cap 720. The cap flange portion 726 may be constructed to be exposed to the outside of the detergent reservoir 310, and may be positioned on the cap support 760 and supported by the cap support 760.

A cross-section shape of the cap flange portion 726 may correspond to the cap support 760. FIGS. 28 to 30 illustrate the cap flange portion 726 having an approximately circular ring shape according to an embodiment of the present disclosure. Further, as shown in FIG. 31, as the cap flange portion 726 is supported on the cap support 760 of the detergent reservoir 310, the detergent cap 720 may be maintained in the coupled state with the detergent reservoir 310.

In one example, a ventilation portion may be defined in the detergent cap 720 to communicate the detergent storage space inside the detergent reservoir 310 and the outside of the detergent reservoir 310 with each other. The ventilation portion may include the flange extension 730, a ventilation space 747, and an open groove 749.

The flange extension 730 may be defined in the cap flange portion 726. The flange extension 730 may extend along the radial direction in the cap flange portion 726. An outer end 732 of the flange extension 730 facing an opposite side of the cap body 723, that is, facing the outside may be opened in the radial direction at the cap flange portion 726, and an inner end 731 of the flange extension 730 facing the cap body 723 may be in communication with the detergent storage space.

The flange extension 730 may be defined as a hole defined inside the cap flange portion 726 or a groove defined in an outer face of the cap flange portion 726. In the flange extension 730, the outer end 732 and the inner end 731 are in communication with each other. As the outer end 732 is opened outward from the cap flange and the inner end 731 is in communication with the detergent storage space, the detergent storage space is in communication with the outside and ventilated through the ventilation portion including the flange extension 730.

FIG. 28 illustrates the detergent cap 720 viewed from above, and the flange extension 730 defined in the cap flange portion 726 is indicated by a dotted line in FIG. 28. In addition, FIG. 29 illustrates the flange extension 730 viewed in the radial direction of the detergent injection hole 312, that is, an extension direction of the flange extension 730.

Referring to FIG. 29, the outer end 732 of the flange extension 730 is opened along the radial direction, and the inner end 731 may be in communication with the detergent storage space while facing the cap body 723. A scheme in which the inner end 731 of the flange extension 730 and the detergent storage space are in communication with each other may vary.

For example, the inner end 731 of the flange extension 730 may be open at a side of the cap body 723, and the inner end 731 may be in communication with the detergent storage space through a separation space defined between the cap body 723 and the cap member 330 of the detergent reservoir 310.

Alternatively, a hole or a groove that opens toward the detergent storage space may be defined inside the cap body 723, and the inner end 731 of the flange extension 730 may be in communication with the hole or the groove inside the cap body 723 to be in communication with the detergent storage space.

FIG. 30 illustrates the flange extension 730 in a form of the groove defined in a bottom face of the cap flange portion 726 as will be described later according to an embodiment of the present disclosure.

An embodiment of the present disclosure has the flange extension 730 defined in the detergent cap 720 that shields the detergent injection hole 312, and the flange extension 730 extends along the radial direction of the detergent injection hole 312 to communicate the outside with the detergent storage space, so that the leakage of the detergent stored in the detergent storage space to the outside through the flange extension 730 may be minimized.

The detergent reservoir 310 is installed in the detergent storage frame 390 and is retracted into and extend from the cabinet 10. In the retraction and extension processes, the detergent reservoir 310 moves along the front and rear direction. In this connection, a flow may be generated in the detergent inside the detergent reservoir 310, so that the detergent may be exposed to the outside through the flange extension 730.

For example, the detergent in which the flow is generated in the front and rear direction may bump into an inner face of the detergent reservoir 310 and rise or scatter. The detergent flowing upward or scattering as described above may leak to the outside through the flange extension 730.

However, an embodiment of the present disclosure has the flange extension 730 defined in the detergent cap 720, and the flange extension 730 extends along the radial direction of the detergent injection hole 312. Thus, even when the detergent in the detergent storage space flows upward or scatters, the leakage to the outside through the flange extension 730 extending in the radial direction may be minimized.

Further, in an embodiment of the present disclosure, the flange extension 730 is defined in the cap flange portion 726 of the detergent cap 720. Accordingly, even when the flange extension 730 is defined, an open region that is directly opened toward the detergent storage space in the vertical direction is not defined, so that the leakage of the detergent to the outside may be minimized.

For example, the cap flange portion 726 does not overlap the detergent injection hole 312 substantially along the vertical direction. Therefore, the flange extension 730 defined in the cap flange portion 726 may not overlap the detergent injection hole 312 in the vertical direction in general.

As a result, as the flange extension 730 is defined in the cap flange portion 726 of the detergent cap 720, in a relationship between the flange extension 730 and the detergent injection hole 312, there is no region that is directly opened toward the detergent storage space in the vertical direction. Accordingly, the detergent rising or scattering from the inside of the detergent storage space may be prevented or suppressed from leaking to the outside through the flange extension 730.

In one example, referring to FIGS. 29 to 31, in an embodiment of the present disclosure, the flange extension 730 may be defined in one face of the cap flange portion 726 facing the cap support 760 and may have a shape of a groove recessed to be away from the cap support 760.

Specifically, the flange extension 730 may be in the form of the groove defined in one face of the cap flange portion 726 facing the cap support 760. FIG. 31 illustrates a state in which the detergent cap 720 is coupled downwardly to the detergent injection hole 312 and the flange extension 730 is defined in a bottom face of the cap flange portion 726 facing the cap support 760, according to an embodiment of the present disclosure.

The flange extension 730 may have a shape of a groove recessed in a direction away from the cap support 760, that is, in a direction opposite to an insertion direction of the detergent cap 720. Accordingly, the flange extension 730 extending in the radial direction of the detergent injection hole 312 may have one face facing the cap support 760 that forms an open face.

FIGS. 29 to 31 illustrate a state in which the flange extension 730 is defined in a shape of a groove defined in the bottom face of the cap flange portion 726, is recessed upward, and extends along the radial direction as the bottom face thereof is opened, according to an embodiment of the present disclosure.

As the flange extension 730 has the shape of the groove, the inner end 731 of the flange extension 730 may be opened toward the space between the cap body 723 and the cap support 760 from the side of the cap body 723 and may be in communication with the detergent storage space.

In one example, in an embodiment of the present disclosure, the flange extension 730 may include a plurality of flange extensions and the plurality of flange extensions may be spaced apart from each other in the cap flange portion 726 along a circumferential direction of the detergent injection hole 312. The number of flange extensions 730 may vary, and the plurality of flange extensions may be spaced apart from each other along the circumferential direction of the detergent injection hole 312. For example, the plurality of flange extensions 730 may be arranged at equal spacings from each other along the circumferential direction.

FIGS. 28 and 30 illustrate a state in which two flange extensions 730 are arranged on opposite sides of the detergent cap 720 with respect to the cap body 723, according to an embodiment of the present disclosure.

In an embodiment of the present disclosure, the flange extension 730 include the plurality of flange extensions and the plurality of flange extensions are arranged spaced apart from each other. Thus, even when one of the flange extensions is blocked by foreign substances or the deformation of the detergent cap 720 or the cap support 760, a ventilation effect between the detergent storage space and the outside may be maintained by the remaining flange extensions.

In one example, FIGS. 29 and 31 illustrate a cap sealer 740 disposed on the detergent cap 720 according to an embodiment of the present disclosure. Referring to FIGS. 29 and 31, in an embodiment of the present disclosure, the detergent cap 720 may further include the cap sealer 740, and the cap sealer 740 may be located between said one face of the cap flange portion 726 and the cap support 760 and extend to surround the cap body 723 to seal a portion between the cap flange portion 726 and the cap support 760. In addition, in at least a portion of the flange extension 730, the open face facing the cap support 760 may be shielded by the cap sealer 740.

The cap sealer 740 may have a ring shape like the cap flange portion 726 and the cap support 760. The detergent injection hole 312 and the cap body 723 may be located at a center of the cap sealer 740. The cap sealer 740 may be disposed between said one face of the cap flange portion 726 facing the cap support 760 and the cap support 760. Accordingly, the portion between the cap flange portion 726 and the cap support 760 may be sealed by the cap sealer 740 and the leakage of the detergent may be prevented.

In addition, the cap sealer 740 may serve as a support between the cap flange portion 726 and the cap support 760 and allow the cap flange portion 726 to be stably supported on the cap support 760. That is, the cap flange portion 726 is supported by the cap support 760 through the cap sealer 740, so that stability of the support structure may be improved.

The cap sealer 740 may be formed separately from the cap body 723 and may be coupled to the cap body 723. The cap sealer 740 may be made of a material having higher elasticity and higher deformability than the cap body 723 or the cap flange portion 726. Accordingly, the cap sealer 740 may be compressed and deformed between the cap flange portion 726 and the cap support 760 to seal the portion between the cap flange portion 726 and the cap support 760.

In one example, in the flange extension 730 having the groove shape, the open face faces the cap sealer 740. At least a portion of the open face may be shielded by the cap sealer 740 along the radial direction.

In one example, referring to FIGS. 29 and 30, in an embodiment of the present disclosure, the flange extension 730 may further include an anti-adhesion rib 737. The anti-adhesion rib 737 may protrude from a recessed face 735 of the flange extension 730 toward the cap sealer 740 and extend in the radial direction to separate the cap sealer 740 from the recessed face 735.

As described above, the flange extension 730 may have the groove shape, have the inner recessed face recessed in a direction away from the cap support 760, for example, in an upward direction in the flange extension 730, and have the outer open face.

FIGS. 29 and 30 illustrate the state in which the flange extension 730 is defined in the bottom face of the cap flange portion 726, the flange extension 730 has the recessed face 735 recessed upward, and the bottom face of the flange extension 730 forms the open face, according to an embodiment of the present disclosure.

The anti-adhesion rib 737 may protrude toward the cap sealer 740 from the recessed face 735 of the flange extension 730. The anti-adhesion rib 737 may extend in the radial direction like the flange extension 730 and may be positioned between the cap sealer 740 and the recessed face 735 of the flange extension 730.

In the situation in which the detergent cap 720 is coupled to the detergent reservoir 310, the cap sealer 740 is subjected to a compressive force between the cap flange portion 726 and the cap support 760. Accordingly, a portion of the cap sealer 740 may be in contact with or adhere to the recessed face 735 of the flange extension 730.

When the cap sealer 740 is in contact with the recessed face of the flange extension 730 as described above, the flange extension 730 is partially blocked along the longitudinal direction, and the ventilation between the detergent storage space and the outside may not be smooth.

Accordingly, an embodiment of the present disclosure may have the anti-adhesion rib 737 protruding from the recessed face of the flange extension 730, and may prevent the situation in which the cap sealer 740 is in contact with or adheres to the recessed face 735 of the flange extension 730 through the anti-adhesion rib 737.

FIG. 29 illustrates the anti-adhesion rib 737 protruding from the recessed face 735 of the flange extension 730 viewed in the radial direction, that is, in the extension direction of the anti-adhesion rib 737 and the flange extension 730, and FIG. 30 illustrates the anti-adhesion rib 737 viewed through the open face of the flange extension 730.

In one example, as shown in FIGS. 30 and 31, in an embodiment of the present disclosure, the detergent cap 720 may further include a sealer fixing portion 745. The sealer fixing portion 745 may be disposed to be spaced apart from the cap flange portion 726 toward the detergent storage space, protrude from the cap body 723 in the radial direction, and extend to surround the cap body 723.

The sealer fixing portion 745 may have a shape of a protrusion or a flange protruding from the cap body 723. FIG. 30 illustrates the sealer fixing portion 745 having a ring-shaped flange shape protruding from the cap body 723 according to an embodiment of the present disclosure.

The sealer fixing portion 745 may be disposed spaced apart from the cap flange portion 726 and may be disposed closer to the detergent storage space than the cap flange portion 726. Referring to FIG. 31, in an embodiment of the present disclosure, the detergent cap 720 may be downwardly inserted and fixed in the detergent injection hole 312, and the sealer fixing portion 745 may be spaced downwardly apart from the cap flange portion 726.

The cap sealer 740 may be fixed between the cap flange portion 726 and the sealer fixing portion 745. In addition, the cap sealer 740 may include an inner inserted portion 742. The inner inserted portion 742 may be inserted and fixed in a portion between the cap flange portion 726 and the sealer fixing portion 745.

An inner portion facing the cap body 723 of the cap sealer 740 may form the inner inserted portion 742. The inner inserted portion 742 of the cap sealer 740 may face the cap body 723 and may be inserted and fixed in the portion between the cap flange portion 726 and the sealer fixing portion 745.

In one example, as shown in FIG. 31, in an embodiment of the present disclosure, the inner inserted portion 742 may be spaced apart from the cap body 723, so that the ventilation space 747 may be defined between the inner inserted portion 742 and the cap body 723. In addition, the inner end 731 of the flange extension 730 may be in communication with the ventilation space 747, and the ventilation space 747 may be in communication with the detergent storage space.

The inner inserted portion 742 of the cap sealer 740 inserted into the portion between the cap flange portion 726 and the sealer fixing portion 745 may be constructed to be spaced apart from the cap body 723. The ventilation space 747 defined between the inner inserted portion 742 and the cap body 723 may be in communication with the inner end 731 of the flange extension 730, and, at the same time, in communication with the detergent storage space.

For example, as shown in FIG. 31, one face of the flange extension 730 facing the detergent storage space from the inner end 731 may be opened. That is, one face facing the ventilation space 747 of the inner end 731 of the flange extension 730 may correspond to the open face to be in communication with the ventilation space 747.

The ventilation space 747 may be in communication with the detergent storage space in various schemes, such as through the shape of the cap body 723, an opening defined in the sealer fixing portion 745, or the like. Therefore, the detergent storage space is in communication with the ventilation space 747, the ventilation space 747 is in communication with the inner end 731 of the flange extension 730, and the inner end 731 of the flange extension 730 is in communication with the outer end 732 that is opened to the outside of the detergent cap 720, so that air may be shared between the detergent storage space and the outside.

In one example, as shown in FIGS. 30 and 31, in an embodiment of the present disclosure, the open groove 749 recessed toward the cap body 723 to open the ventilation space 747 toward the detergent storage space may be defined in the sealer fixing portion 745, and the flange extension 730 may be in communication with the detergent storage space through the ventilation space 747 and the open groove 749.

The open groove 749 of the sealer fixing portion 745 may be recessed from an outer circumferential face of the sealer fixing portion 745 toward a center of the cap body 723 or the detergent injection hole 312. Both one face facing the ventilation space 747 and the other face facing the detergent storage space of the open groove 749 may be opened. Accordingly, the ventilation space 747 may be in communication with the detergent storage space.

A depth at which the open groove 749 is recessed along the radial direction of the detergent injection hole 312 may be larger than a depth at which the inner inserted portion 742 is inserted into the portion between the cap flange portion 726 and the sealer fixing portion 745. That is, an exposed region in which the detergent storage space is directly exposed toward the ventilation space 747 along the insertion direction of the detergent cap 720 may be defined by the open groove 749.

In an embodiment of the present disclosure, air outside the detergent reservoir 310 may be flowed into the detergent storage space through the flange extension 730, the ventilation space 747, and the open groove 749. In FIG. 31, an air flow channel between the detergent storage space and the detergent reservoir 310 is indicated by an arrow according to an embodiment of the present disclosure.

In one example, FIG. 32 illustrates the cap support 760 and the detergent injection hole 312 according to an embodiment of the present disclosure. A cap fixing flange 765 connected to the cap support 760 is illustrated in FIG. 32.

As shown in FIGS. 31 and 32, in an embodiment of the present disclosure, the detergent reservoir 310 may further include the cap fixing flange 765. The cap fixing flange 765 may extend to surround the detergent injection hole 312 and may be spaced apart from the cap support 760 toward the detergent storage space.

In addition, the detergent cap 720 may include a cap fixing leg. The cap fixing leg is supported by the cap fixing flange 765, so that the detergent cap 720 may be fixed in the detergent injection hole 312.

The cap fixing leg may be formed at a lower portion of the cap body 723, and at least a portion thereof, for example, a leg engaging portion 753 to be described later, may be supported on the cap fixing flange 765 such that the detergent cap 720 is fixed.

The cap fixing leg may include a leg extension 751 and the leg engaging portion 753. The leg extension 751 may extend from the cap body 723 toward the detergent storage space. The leg engaging portion 753 may protrude from the leg extension 751 to the outside of the cap body 723 along the radial direction, and may be supported on one face of the cap fixing flange 765 facing the detergent storage space.

Specifically, the cap fixing flange 765 may have an approximately ring shape, and may be spaced apart from the cap support 760 toward the detergent storage space. For example, when the detergent cap 720 is inserted and coupled downward from the top face of the detergent reservoir 310, the cap fixing flange 765 may be spaced downwardly apart from the cap support 760.

In addition, a size and a shape of the cap fixing flange 765 may vary. For example, an outer diameter of the cap fixing flange 765 may be smaller than an inner diameter of the cap support 760. As will be described later, the cap fixing flange 765 may be connected to the cap support 760 through a cap connection portion 763.

FIG. 32 illustrates the cap fixing flange 765 disposed downwardly spaced apart from the cap support 760 and located inward of the cap support 760 along the radial direction of the detergent injection hole 312 according to an embodiment of the present disclosure.

The leg extension 751 may extend from the cap body 723 of the detergent cap 720 toward the detergent storage space. The leg extension 751 may have a shape of a bar or a pillar protruding from the cap body 723 toward the detergent storage space, and may include a plurality of leg extensions.

In addition, the leg extension 751 may extend from a side face of the cap body 723 or an end facing the detergent storage space of the cap body 723 toward the detergent storage space. Referring to FIGS. 30 and 31, in an embodiment of the present disclosure, the leg extension 751 may extend downward from the lower portion of the cap body 723, and may extend from a circumference of a bottom face of the cap body 723.

The leg engaging portion 753 may be formed to protrude outward from the leg extension 751 along the radial direction of the detergent injection hole 312. That is, the leg engaging portion 753 may protrude from the leg extension 751 toward the cap fixing flange 765. Referring to FIGS. 30 and 31, in an embodiment of the present disclosure, the leg engaging portion 753 may protrude outward from a lower end of the leg extension 751.

In the leg engaging portion 753, one face facing the cap flange portion 726 may be in contact with and support on the cap fixing flange 765. The leg engaging portion 753 may be in contact with one face of the cap fixing flange 765 facing the detergent storage space. A direction in which the leg engaging portion 753 is supported by the cap fixing flange 765 may be the same as the direction in which the detergent cap 720 is inserted.

That is, the leg engaging portion 753 is supported in the insertion direction by the cap fixing flange 765 and the cap flange portion 726 is supported in the direction opposite to the insertion direction by the cap support 760, so that the detergent cap 720 may be fixed and coupled to the detergent reservoir 310.

Referring to FIG. 31, in an embodiment of the present disclosure, the detergent cap 720 may be downwardly inserted into and coupled to the detergent injection hole 312, the leg extension 751 may extend downward from the bottom face of the cap body 723, and the leg engaging portion 753 may protrude radially outward of the detergent injection hole 312 from the lower end of the leg extension 751. In addition, a top face of the leg engaging portion 753 may be in contact with and supported on the bottom face of the cap fixing flange 765 spaced downwardly apart from the cap support 760.

In one example, as the leg extension 751 extends from the cap body 723 toward the detergent storage space, air flow channels may be defined on both sides of the leg extension 751. That is, in an embodiment of the present disclosure, the ventilation space 747 defined between the cap sealer 740 and the cap body 723 may be opened toward the detergent storage space through the open groove 749 of the sealer fixing portion 745, and may be in communication with the detergent storage space through the leg extension 751.

In FIG. 31, the flow channel of the air from the outside of the detergent reservoir 310 toward the detergent storage space is indicated by the arrow. Referring to FIG. 31, the air outside the detergent reservoir 310 may be introduced into the detergent storage space through the outer end 732 of the flange extension 730, the inner end 731 of the flange extension 730, the ventilation space 747 between the cap sealer 740 and the cap body 723, the open groove 749 of the sealer fixing portion 745, and the both sides of the leg extension 751. Such air inflow channel is the same as a path through which the air in the detergent storage space flows out of the detergent reservoir 310.

In one example, as shown in FIGS. 31 and 32, in an embodiment of the present disclosure, the detergent reservoir 310 may further include the cap connection portion 763. The cap connection portion 763 may extend from the cap support 760 toward the detergent storage space, surround the cap body 723, and connect the cap support 760 with the cap fixing flange 765. The cap connection portion 763 may be spaced apart from the cap body 723 in the radial direction.

Specifically, in an embodiment of the present disclosure, the cap connection portion 763 may extend from one face of the cap support 760 facing the detergent storage space, for example, the bottom face of the cap support 760 in FIG. 31 toward the detergent storage space.

The cap connection portion 763 may extend from an inner end or an inner diameter portion of the cap support 760 facing the cap body 723 toward the detergent storage space. The cap connection portion 763 may have a shape of a bar or a beam. FIG. 32 illustrates the cap connection portion 763 having a cylindrical shape and extending downward from the cap support 760 as an embodiment of the present disclosure.

The cap connection portion 763 of the cylindrical shape or a ring shape having a length in a direction parallel to the insertion direction of the detergent cap 720 may be constructed to surround the cap body 723. The cap fixing flange 765 may be connected to one end of the cap connection portion 763 facing the detergent storage space, and the cap support 760 may be connected to the other end of the cap connection portion 763. The cap fixing flange 765 may be constructed to be spaced apart from the cap support 760 toward the detergent storage space by the cap connection portion 763.

In one example, an inner circumferential face of the cap connection portion 763 may be spaced apart from an outer circumferential face of the cap body 723. That is, the cap connection portion 763 may be spaced apart from the cap body 723 disposed at the center. The air may flow through the spaced space between the cap connection portion 763 and the cap body 723.

In one example, as shown in FIG. 32, in an embodiment of the present disclosure, the cap fixing flange 765 may have a leg passage groove 767 defined therein that is recessed away from the leg extension 751 in the radial direction.

The leg passage groove 767 is opened along the insertion direction of the detergent cap 720. While the cap body 723 is inserted into the detergent injection hole 312, the leg fixing portion may pass through the leg passage groove 767.

The leg passage groove 767 may correspond to an entrance of the leg engaging portion 753 in the process of coupling and detaching the detergent cap 720. The leg passage groove 767 may be recessed away from the cap body 723 from the inner circumferential face of the cap fixing flange 765, and may have an open groove shape in which one face facing the detergent storage space and the other face on the opposite side are opened.

A shape of a cross-section of the leg passage groove 767 may correspond to a shape of a cross-section of the leg engaging portion 753 and a cross-sectional area of the leg passage groove 767 may be greater than that of the leg engaging portion 753. In the process in which the detergent cap 720 is coupled to the detergent injection hole 312, the leg engaging portion 753 may pass through said one face and the other face, which are opened, of the leg passage groove 767 and may be inserted into the detergent storage space.

The user may insert the detergent cap 720 into the detergent injection hole 312 by placing the leg engaging portion 753 of the detergent cap 720 on the leg passage groove 767 of the cap fixing flange 765. In a state in which the leg engaging portion 753 has passed through the leg passage groove 767, the detergent cap 720 may be rotated in the circumferential direction of the detergent injection hole 312, so that the leg engaging portion 753 may be supported on the cap fixing flange 765.

Figure 33:
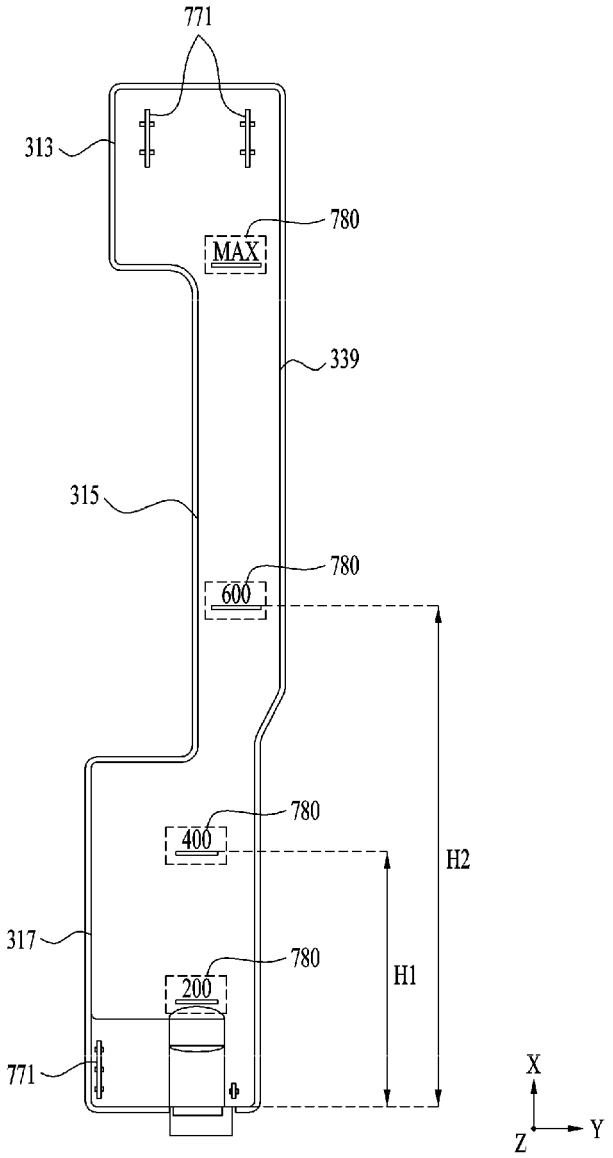
FIG. 33 is a view of a detergent reservoir viewed from below in a laundry treating apparatus according to an embodiment of the present disclosure.

In one example, FIG. 33 illustrates the bottom face of the detergent reservoir 310 according to an embodiment of the present disclosure viewed from below. As shown in FIG. 33, in an embodiment of the present disclosure, in the detergent reservoir 310, the detergent injection hole 312 may be defined in the top face, the support leg 771 protruding downward from the bottom face to support the detergent reservoir 310 may be disposed, and leg reinforcing ribs 773 protruding from the support leg 771 in parallel with the bottom face and connected to the bottom face may be arranged.

In an embodiment of the present disclosure, as shown in FIG. 7, the detergent injection hole 312 may be defined in the top face of the detergent reservoir 310 and the support leg 771 may be formed on the bottom face of the detergent reservoir 310. The support leg 771 may support the detergent reservoir 310 with respect to the bottom face of the detergent storage frame 390.

Figure 34:
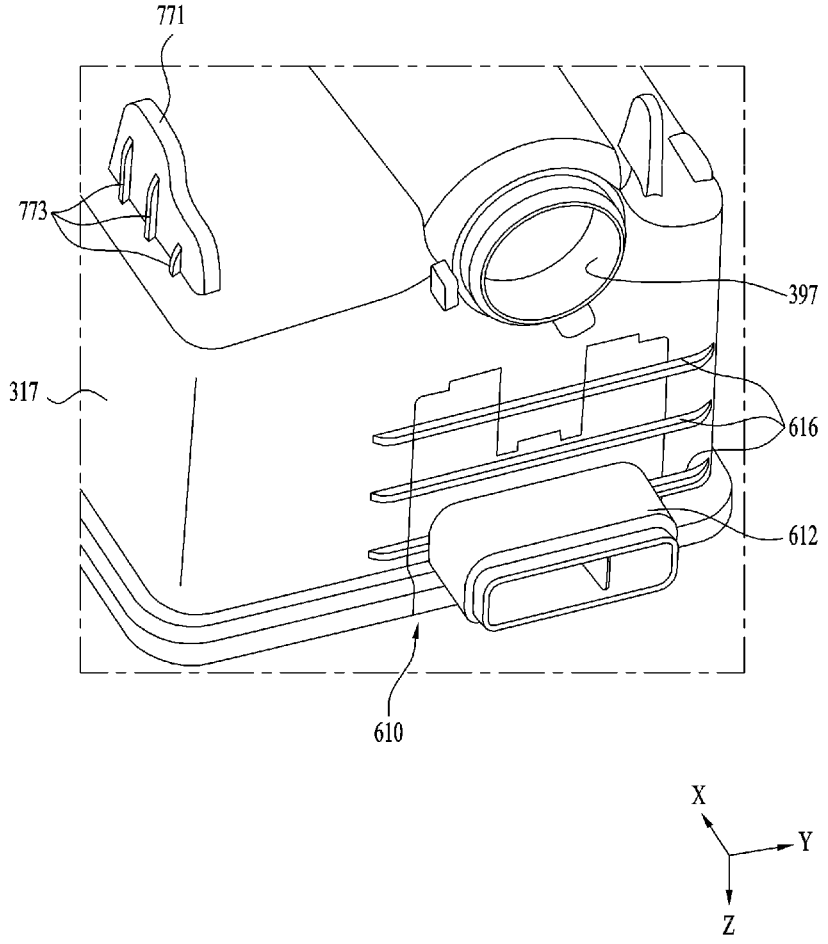
FIG. 34 is a perspective view of a detergent reservoir viewed from the rear in a laundry treating apparatus according to an embodiment of the present disclosure.

The support leg 771 may protrude downward from the bottom face of the detergent reservoir 310. FIGS. 33 and 34 illustrate the support leg 771 disposed on the bottom face of the detergent reservoir 310. A protruding height of the support leg 771 may be determined in various ways as necessary, and a shape of the support leg 771 may also be determined in various ways.

FIG. 34 illustrates the support leg 771 protruding downward from the bottom face of the detergent reservoir 310 and extending along the longitudinal direction of the detergent reservoir 310, that is, the front and rear direction of the detergent storage 300 according to an embodiment of the present disclosure.

In one example, the leg reinforcing ribs 773 may be arranged on the support leg 771, and the leg reinforcing ribs 773 may protrude from the support leg 771 in a direction parallel to the bottom face of the detergent reservoir 310. The leg reinforcing ribs 773 may have a shape extending downward from the bottom face of the detergent reservoir 310 together with the support leg 771.

That is, the leg reinforcing ribs 773 may be connected to both the bottom face of the detergent reservoir 310 and the support leg 771. FIG. 34 illustrates the leg reinforcing ribs 773 protruding in the left and right direction from a side face of the support leg 771 extending in the front and rear direction according to an embodiment of the present disclosure.

Loads of the detergent reservoir 310 and the detergent, for example, the first detergent, stored in the detergent reservoir 310 may be transferred to the support leg 771. As the leg reinforcing ribs 773 are arranged on the support leg 771, rigidity of the bottom face of the detergent reservoir 310 from which the support leg 771 and the support leg 771 protrude may be reinforced.

In one example, FIG. 34 is a perspective view of the rear end of the detergent reservoir 310 viewed from below. As shown in FIG. 34, in an embodiment of the present disclosure, a residual amount detection sensor 610 for detecting a residual amount of the first detergent may be installed on the rear face of the detergent reservoir 310, and a sensor terminal 612 of the residual amount detection sensor 610 may protrude rearward from the rear face of the detergent reservoir 310.

As described above, the residual amount detection sensor 610 may be installed on the rear face of the detergent reservoir 310, and the residual amount detection sensor 610 may detect the residual amount of the detergent stored in the detergent reservoir 310.

For example, the residual amount detection sensor 610 may detect whether the detergent residual amount of the detergent reservoir 310 is less than a predetermined reference residual amount. The reference residual amount may correspond to a minimum amount of detergent that the laundry treating apparatus 1 according to an embodiment of the present disclosure may perform the washing process.

The residual amount detection sensor 610 may be of various types. For example, the residual amount detection sensor 610 may include an electrode disposed inside the detergent reservoir 310. Presence or absence of the detergent and the residual amount may be identified based on a current or a voltage of the electrode.

The residual amount detection sensor 610 may be formed integrally with the rear face of the detergent reservoir 310 or separately formed and coupled to the rear face of the detergent reservoir 310. The residual amount detection sensor 610 may include the sensor terminal 612, and a measured value of the residual amount detection sensor 610 may be transmitted to a controller disposed in the cabinet 10 through the sensor terminal 612.

The sensor terminal 612 may be constructed to protrude rearward from the rear face of the detergent reservoir 310. Accordingly, when the detergent reservoir 310 is retracted into the cabinet 10 in a state of being inserted into the detergent storage frame 390, a receiving terminal disposed in advance in the cabinet 10 and the sensor terminal 612 may be connected to each other.

FIG. 34 illustrates a state in which the residual amount detection sensor 610 is disposed to form at least a portion of the rear face of the detergent reservoir 310 and the sensor terminal 612 of the residual amount detection sensor 610 protrudes rearward from an upper end of the rear face of the detergent reservoir 310, according to an embodiment of the present disclosure.

Figure 35:
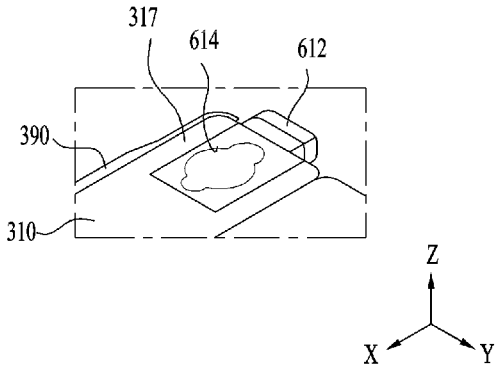
FIG. 35 is a view illustrating a sensor inspection hole of a detergent reservoir in a laundry treating apparatus according to an embodiment of the present disclosure.

In one example, FIG. 35 illustrates the rear end of the detergent reservoir 310, that is, the detergent discharge portion 317 viewed from above. As shown in FIG. 35, in an embodiment of the present disclosure, a sensor inspection hole 614 exposing the residual amount detection sensor 610 from the inside may be defined at the rear end of the detergent reservoir 310.

The sensor inspection hole 614 may be defined at the rear end of the top face of the detergent reservoir 310. That is, the sensor inspection hole 614 may be defined at the rear end of the cap member 330 of the detergent reservoir 310. The sensor inspection hole 614 may be located in front of the residual amount detection sensor 610 and may be located adjacent to the residual amount detection sensor 610, so that the residual amount detection sensor 610 in the detergent reservoir 310 may be exposed to the outside.

In addition, a hole plug may be coupled to and shield the sensor inspection hole 614. The hole plug may be formed such that at least a portion of the hole plug is detachable from the sensor inspection hole 614. The user may identify the residual amount detection sensor 610 inside the detergent reservoir 310 by removing the hole plug from the sensor inspection hole 614.

The residual amount detection sensor 610 may have means for measuring an amount of detergent stored, such as the electrode and the like. The electrode and the like may be located inside the detergent reservoir 310. When residue of the detergent or other foreign substance adheres to the residual amount detection sensor 610 in the process of using the residual amount detection sensor 610, a function of the residual amount detection sensor 610 may be degraded.

Accordingly, an embodiment of the present disclosure defines the sensor inspection hole 614 at the rear end of the detergent reservoir 310. The user may identify the residual amount detection sensor 610 or insert cleaning means to clean the residual amount detection sensor 610 through the sensor inspection hole 614.

Referring again to FIG. 34, in an embodiment of the present disclosure, rear face reinforcing ribs 616 protruding rearward and extending to pass through an installation portion of the residual amount detection sensor 610 may be disposed on the rear face of the detergent reservoir 310.

The detergent reservoir 310 may be molded of a lightweight material such as plastic, and the residual amount detection sensor 610 is disposed on the rear face of the detergent reservoir 310, so that there is a possibility of damage or deformation resulted from an increase in load.

Therefore, in an embodiment of the present disclosure, the rear face reinforcing ribs 616 protruding rearward may be arranged on the rear face of the detergent reservoir 310. At least a portion of the rear face reinforcing rib 616 may overlap the residual amount detection sensor 610 in the front and rear direction of the detergent storage 300, and the remaining portion thereof may be placed on the rear face of the detergent reservoir 310.

That is, the rear face reinforcing ribs 616 may extend in a direction parallel to the rear face of the detergent reservoir 310 to cross the residual amount detection sensor 610 or the installation portion of the residual amount detection sensor 610. Rigidity of the rear face of the detergent reservoir 310 may be increased by the rear face reinforcing ribs 616.

FIG. 34 illustrates the leg reinforcing ribs 773 protruding rearward from the rear face of the detergent reservoir 310 and extending along the left and right direction of the detergent storage 300 according to an embodiment of the present disclosure.

Figure 36:
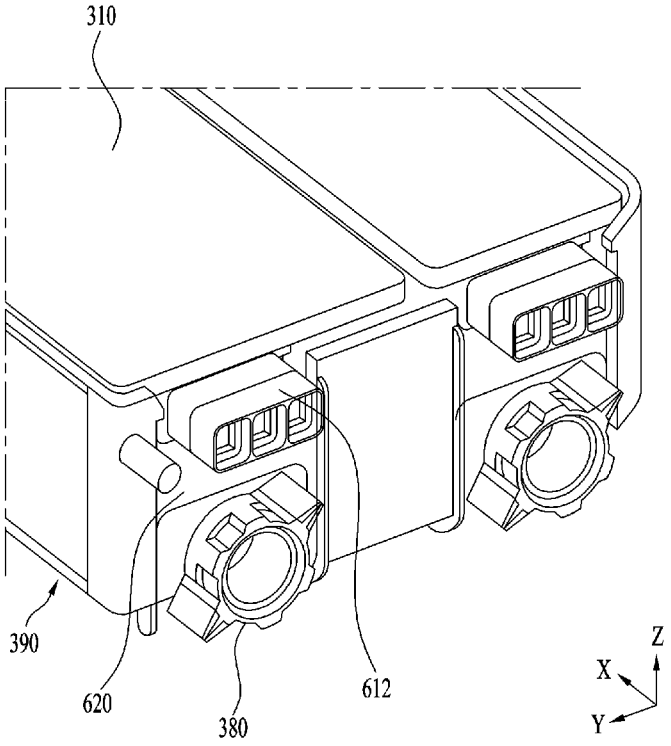
FIG. 36 is a perspective view of a detergent storage coupled with a detergent reservoir viewed from the rear in a laundry treating apparatus according to an embodiment of the present disclosure.

In one example, FIG. 34 illustrates a valve hole 397 to which the detergent valve 380 is coupled, and FIG. 36 illustrates the rear end of the detergent reservoir 310 to which the detergent valve 380 is coupled and which is inserted into the detergent storage frame 390.

As shown in FIGS. 34 and 36, in an embodiment of the present disclosure, the detergent valve 380 through which the first detergent is discharged is installed on the rear face of the detergent reservoir 310, and a rear end of the detergent valve 380 may protrude rearward from the rear face of the detergent reservoir 310.

The detergent valve 380 may be inserted into and coupled to the valve hole 397 defined in the rear face of the detergent reservoir 310. The valve hole 397 and the detergent valve 380 may be located at a lower end of the rear face. The first detergent in the detergent reservoir 310 may be discharged to the outside of the detergent reservoir 310 through the detergent valve 380.

A portion of the detergent valve 380 may be inserted into the detergent reservoir 310 through the valve hole 397, and the remaining portion thereof may protrude rearward from the rear face of the detergent reservoir 310. For example, for the detergent valve 380, a front end may be inserted into the detergent reservoir 310 and a rear end may protrude rearward from the detergent reservoir 310.

When the detergent reservoir 310 is inserted into the cabinet 10 in a state of being inserted into the detergent storage frame 390, an inlet port of a detergent pump disposed in advance in the cabinet 10 may be connected to the rear end of the detergent valve 380, so that the first detergent inside may be discharged to the outside.

In FIG. 36, the sensor terminal 612 is disposed at an upper end of the rear face of the detergent reservoir 310 and the detergent valve 380 is disposed at the lower end according to an embodiment of the present disclosure.

In one example, in an embodiment of the present disclosure, as shown in FIG. 36, the rear face of the detergent storage frame 390 may be opened at positions corresponding to the sensor terminal 612 and the detergent valve 380 and may be penetrated by the sensor terminal 612 and the detergent valve 380.

Accordingly, in the state in which the detergent reservoir 310 is connected to the detergent storage frame 390, the sensor terminal 612 and the detergent valve 380 may be exposed rearward from the detergent storage frame 390. When the detergent storage 300 is inserted into the cabinet 10, the receiving terminal and the inlet port may be coupled to the sensor terminal 612 and the detergent valve 380.

In one example, as shown in FIG. 36, in an embodiment of the present disclosure, a holder 620 that extends along the left and right direction of the detergent storage 300 to cross a portion between the sensor terminal 612 and the detergent valve 380 may be disposed on the rear face of the detergent storage frame 390.

The rear face of the detergent storage frame 390 may be opened at positions corresponding to the sensor terminal 612 and detergent valve 380, and the holder 620 that is disposed to cross the portion between the sensor terminal 612 and the detergent valve 380 may be disposed on the rear face of the detergent storage frame 390.

Figure 48:
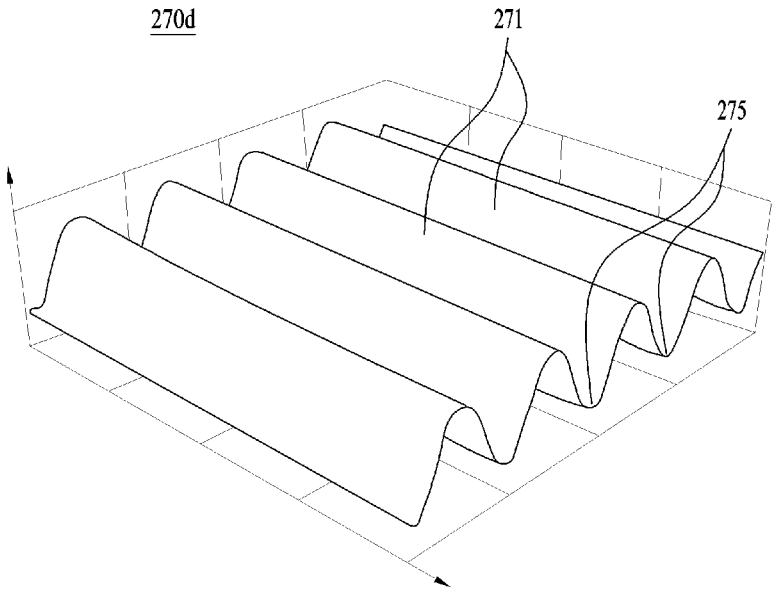
FIG. 48 is a view illustrating a water-repellent pattern in which convex portions and concave portions extending along a first direction are alternately arranged with each other in an embodiment of the present disclosure.

The holder 620 may be extended along a width direction of the detergent storage frame 390. In addition, the rear face of the detergent storage frame 390 may have a shape in which both portions thereof above and below the holder 620 are open as shown in FIG. 48.

As described above, when the user holds the gripping portion 332 and lifts the detergent reservoir 310 from the detergent storage frame 390, as the holder 620 prevents the detergent valve 380 from moving upward, the detergent injection portion 313 of the detergent reservoir 310 may be separated from the detergent storage frame 390 before the detergent discharge portion 317, and the leakage of the detergent through the ventilation hole may be further suppressed.

Referring to FIG. 33 again, in an embodiment of the present disclosure, a residual amount indicator 780 for indicating the residual amount of the detergent stored in the detergent storage space may be disposed on the bottom face of the detergent reservoir 310.

The residual amount indicator 780 may indicate a residual amount of the detergent corresponding to a corresponding position in various schemes such as numbers or letters. When the user grips the gripping portion 332 of the detergent reservoir 310 and lifts the front end of the detergent reservoir 310 from the detergent storage frame 390, the residual amount indicator 780 may be disposed on the bottom face of the detergent reservoir 310 such that the user may visually identify the bottom face of the detergent reservoir 310 to determine the detergent residual amount.

In one example, in an embodiment of the present disclosure, in a state in which the detergent injection portion 313 of the detergent reservoir 310 is located above the detergent discharge portion 317, the residual amount indicator 780 may indicate a detergent residual amount corresponding to a vertical level of the residual amount indicator 780 from the bottom of the detergent storage space.

As described above, when the user is located in front of detergent storage 300 and lifts the front end of the detergent reservoir 310 from the detergent storage frame 390, the front end of the detergent reservoir 310, that is, the detergent injection portion 313 of the detergent reservoir 310, is located above the rear end of the detergent reservoir 310, that is, the detergent discharge portion 317 of the detergent reservoir 310.

That is, when the user grips the gripping portion 332 disposed at the front end of the detergent reservoir 310 and lifts the front end of the detergent reservoir 310, the bottom face of the detergent reservoir 310 may face the user and the rear face of the detergent reservoir 310 may become the bottom of the detergent storage space.

In this connection, the residual amount indicator 780 disposed on the bottom face of the detergent reservoir 310 may indicate an amount of detergent corresponding to a vertical level from the bottom of the detergent storage space, that is, the rear face of the detergent reservoir 310 to the residual amount indicator 780.

The residual amount indicator 780 may include a scale that is a reference for the detergent residual amount, and may indicate a detergent residual amount corresponding to the scale. The detergent residual amount indication may be numbers, letters, and the like. The detergent residual amount may be indicated to be read by the user when the user looks at the bottom face of the detergent reservoir 310 from below.

In one example, the residual amount indicator 780 may include a plurality of residual amount indicators, and the plurality of residual amount indicators may be spaced apart from each other along a longitudinal direction of the detergent reservoir 310. For a pair of neighboring residual amount indicators 780, a separation distance therebetween may be set such that respective detergent residual amount indications thereof differ from each other by a predetermined single-time consumption.

As shown in FIG. 33, the plurality of residual amount indicators 780 may be arranged on the bottom face of the detergent reservoir 310. The plurality of residual amount indicators 780 may be arranged along the longitudinal direction of the detergent reservoir 310. The longitudinal direction of the detergent reservoir 310 may be a height direction of the detergent storage space when the user lifts the front end of the detergent reservoir 310.

The separation distance between the neighboring pair of residual amount indicators 780 may correspond to the single-time consumption of the detergent. For example, in the laundry treating apparatus 1 according to an embodiment of the present disclosure, the single-time consumption of the detergent consumed when the washing process proceeds may be determined in advance.

Therefore, the neighboring pair of residual amount indicators 780 may be separated from each other such that the respective detergent residual amount indications thereof differ from each other by the predetermined single-time consumption. Referring to FIG. 33, a difference in a vertical level between a vertical level H1 of one residual amount indicator 780 from the bottom of the detergent storage space, that is, the rear face of the detergent reservoir 310, and a vertical level H2 of the neighboring residual amount indicator 780 may correspond to the single-time consumption.

Therefore, when the washing process is performed several times in a state in which the detergent is fully charged in the detergent storage space of the detergent reservoir 310, and when the user lifts the front end of the detergent reservoir 310, an interface of the detergent may be approximately the same as or adjacent to a scale of one of the plurality of residual amount indicators 780, and the user may determine the number of times the washing may be performed in the future or when to replenish the detergent, so that the use efficiency and usability of the detergent storage 300 may be improved.

In one example, in an embodiment of the present disclosure, the residual amount indicator 780 has a second transparency higher than a first transparency of the bottom face in the detergent reservoir 310. In addition, a letter indicating the detergent residual amount may be imprinted on the residual amount indicator 780.

The rear face of the detergent reservoir 310 made of plastic or the like may have the first transparency determined in advance. The transparency may be proportional to a degree at which light is transmitted and may be inversely proportional to a degree at which the light is reflected.

In one example, the residual amount indicator 780 may have an indication region for indicating the detergent residual amount, and the indication region may have the second transparency higher than the first transparency. In FIG. 33, an indication region of each residual amount indicator 780 is indicated by a dotted line.

A difference in the transparency between the residual amount indicator 780 and the rest of the detergent reservoir 310 may be variously implemented. For example, the bottom face of the detergent reservoir 310 may be etched or be subjected to a surface-treatment to have the first transparency. The surface-treatment may be omitted for the residual amount indicator 780, so that the residual amount indicator 780 may have the second transparency higher than the first transparency.

The detergent residual amount indication of the residual amount indicator 780 may be the letters or the numbers, and the detergent residual amount indication may be in a form imprinted on the detergent reservoir 310. The indication region of the residual amount indicator 780 has the second transparency higher than the first transparency, thereby increasing a recognition rate of the user for the residual amount indicator 780 and also increasing character discrimination.

Figure 37:
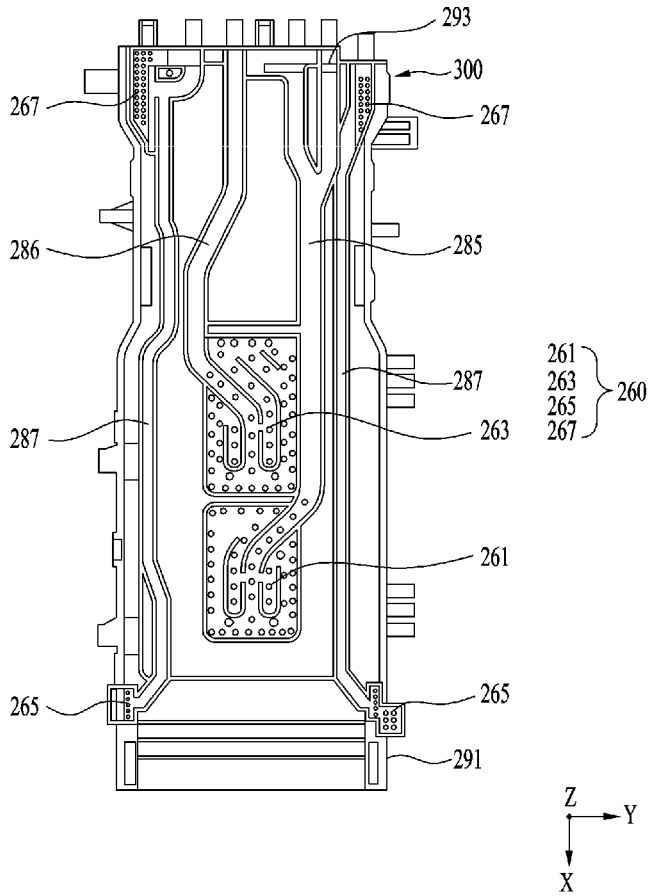
FIG. 37 is a view illustrating an interior of a dispenser in a laundry treating apparatus according to an embodiment of the present disclosure.

In one example, FIG. 37 is a view of the bottom face of the dispenser 200 according to an embodiment of the present disclosure viewed from above. That is, FIG. 37 corresponds to an internal view of the dispenser 200 in which the bottom face of the dispenser 200 in FIG. 37 is viewed from above.

Figure 38:
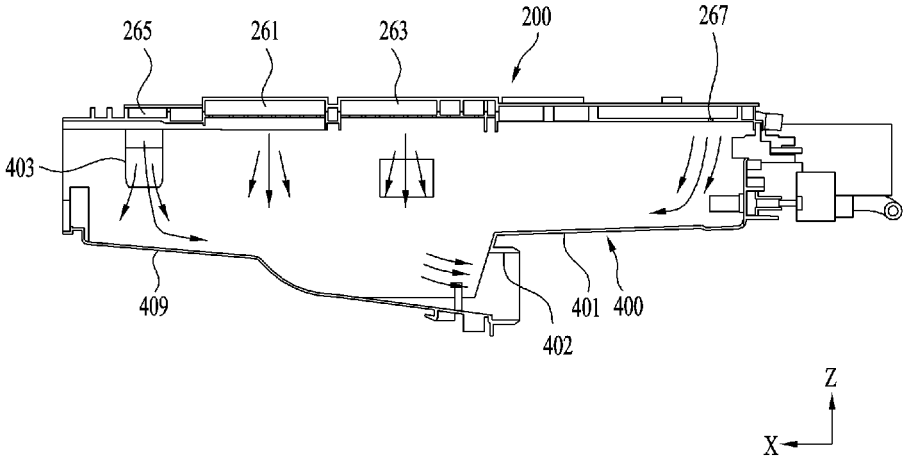
FIG. 38 is a cross-sectional view of a dispenser and a detergent supply casing in a laundry treating apparatus according to an embodiment of the present disclosure.
Figure 39:
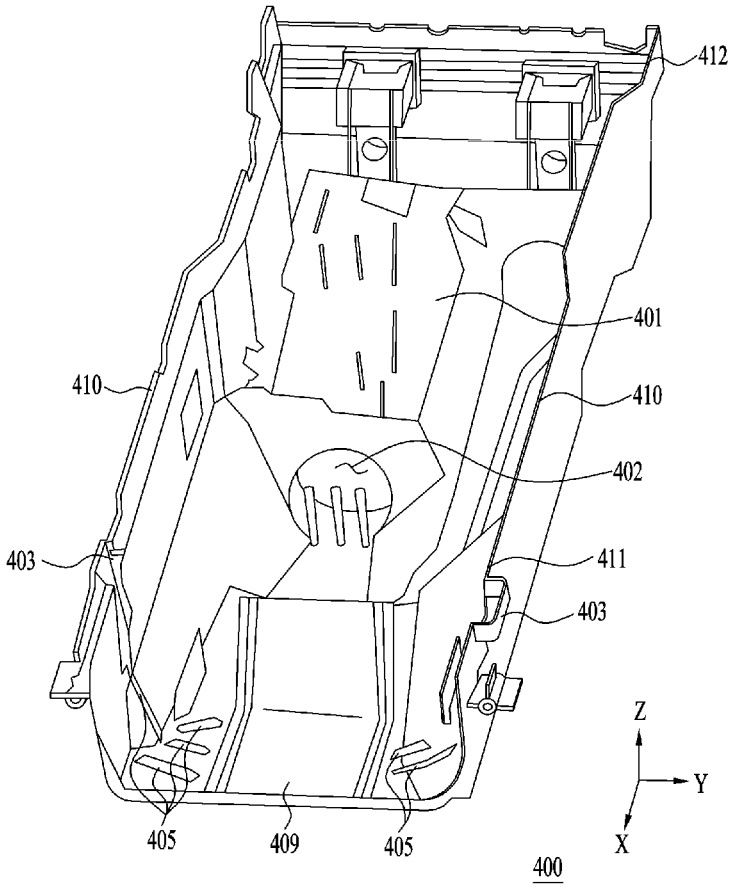
FIG. 39 is a perspective view illustrating a detergent supply casing in a laundry treating apparatus according to an embodiment of the present disclosure.

FIG. 38 is a cross-sectional view of the dispenser 200 and the detergent supply casing 400 viewed from the side. FIG. 39 illustrates the interior of the detergent supply casing 400.

Referring to FIGS. 37 to 39, in an embodiment of the present disclosure, the detergent storage 300 may include the detergent container 340 and the detergent outlet 648 in communication with the detergent container 340. The detergent supply casing 400 may be disposed inside the cabinet 10 and accommodate the detergent storage 300 retracted through the opening 15 therein, and the drain hole 402 through which the detergent discharged from the detergent outlet 648 is discharged may be defined at the bottom of the detergent supply casing 400.

Further, the dispenser 200 may be disposed inside the cabinet 10 and may include a water supply 260 that is located above the detergent storage 300 and through which water falls disposed on the bottom face of the dispenser 200. The water supply 260 may include a detergent water supply 261 located above the detergent container 340 to supply water the detergent container 340, and a front shower means 265 that is located at the front end 291 of the dispenser 200 to supply water to the front end of the detergent supply casing 400.

Specifically, as described above, the detergent in the detergent container 340 of the detergent storage 300 may be discharged to the outside of the detergent storage 300 through the detergent outlet 648. The detergent discharged through the detergent outlet 648 may flow into the detergent supply casing 400.

The detergent supply casing 400 may have an open top face as shown in FIG. 39, and a front face of the detergent supply casing 400 may be opened. The detergent storage 300 may be inserted into the detergent supply casing 400 through the open front face of the detergent supply casing 400 and accommodated in the detergent supply casing 400.

Further, as shown in FIG. 38, the bottom face of the dispenser 200 may be located on the open top face of the detergent supply casing 400. The dispenser 200 may be supported on or coupled to the side wall 410 of the detergent supply casing 400.

The detergent storage 300 retracted into the cabinet 10 may be located above the bottom 401 of the detergent supply casing 400, and the detergent discharged through the detergent outlet 648 of detergent storage 300 may exist on the bottom 401 of the detergent supply casing 400.

The detergent drain hole 402 through which the detergent is discharged may be defined at the bottom of the detergent supply casing 400. The detergent existing inside the detergent supply casing 400 may be discharged to the outside of the detergent supply casing 400 through the detergent drain hole 402, and the drain hole 402 may be connected to the tub 20. That is, in the laundry treating apparatus 1 according to an embodiment of the present disclosure, the detergent may be supplied from the detergent supply 100 to the tub 20.

In one example, the dispenser 200 may be located above the detergent storage 300 and the detergent supply casing 400. The bottom 401 of the detergent supply casing 400, the detergent storage 300, and the dispenser 200 may have a structure stacked in the vertical direction.

The dispenser 200 may have the water supply 260 that drops the water downward. The water supply 260 has a plurality of openings through which the water inside the dispenser 200 falls. The water may fall through the opening and be delivered to the detergent storage 300. FIG. 37 illustrates the water supply 260 disposed on the bottom face of the dispenser 200.

A plurality of channels along which the water flows may be defined inside the dispenser 200, that is, on the bottom face of the dispenser 200. As will be described later, the dispenser 200 may be connected to a supply hose 280, so that the water may be supplied into the dispenser 200. The water delivered from the supply hose 280 may flow along the channels formed inside the dispenser 200 and may be delivered to the water supply 260. In addition, the water supply 260 may discharge the water delivered through the channels downward through the plurality of openings.

In one example, as shown in FIG. 37, in an embodiment of the present disclosure, the water supply 260 may include the detergent water supply 261 and front shower means 265. The detergent water supply 261 may be located above the detergent container 340 of the detergent storage 300. The detergent container 340 may have the open top face, and the water falling from the detergent water supply 261 may be delivered into the detergent container 340 through the open top face of the detergent container 340.

When the detergent storage 300 is fully retracted into cabinet 10 and the washing proceeds, the detergent water supply 261 may drop the water, the water falling from the detergent water supply 261 may be delivered to the detergent container 340 through the open top face of the detergent container 340, and the detergent stored in the detergent container 340 may be discharged to the outside of the detergent storage 300, that is, to the bottom 401 of the detergent supply casing 400 through the detergent outlet 648 of the detergent storage frame 390 together with the water.

In one example, the front shower means 265 may be located at the front end 291 of the dispenser 200. That is, the front shower means 265 may be located above the front end of the bottom 401 of the detergent supply casing 400. Accordingly, the water discharged from the front shower means 265 may be delivered to the front end of the detergent supply casing 400.

As described above, the user may extend the detergent storage 300 and inject the detergent into the detergent container 340, and then retract the detergent storage 300 into the cabinet 10 again to prepare for the washing. As above, the detergent storage 300 may be retracted into or extended from the cabinet 10 in the state in which the detergent is stored in the detergent container 340. During this process, a portion of the detergent stored in the detergent container 340 may be discharged to the outside of the detergent storage 300 through the detergent outlet 648.

The detergent that is discharged through the detergent outlet 648 before the washing may remain on the front end of the bottom 401 of the detergent supply casing 400 depending on the retraction and extension states of the detergent storage 300, that is, the location of the detergent storage 300.

For example, when the user injects the detergent into the detergent container 340 in the state in which the detergent storage 300 is extended from the interior of the cabinet 10 by a certain amount, such as the set extension distance described above, the detergent unintentionally leaking from the interior of the detergent container 340 through the detergent outlet 648 is located in front of the detergent outlet 648 in the state in which the detergent storage 300 is fully retracted.

Furthermore, foreign substances may exist on the front end of the bottom 401 of the detergent supply casing 400 during the use of the detergent supply 100.

As above, the detergent and the like located in front of the detergent container 340 in the state in which the detergent storage 300 is fully retracted on the front end of the bottom 401 of the detergent supply casing 400, for example, the bottom 401 of the detergent supply casing 400 may not be removed even when being discharged from the detergent water supply 261.

Accordingly, an embodiment of the present disclosure has the front shower means 265 at the front end of the dispenser 200 as shown in FIG. 37. The front end of the dispenser 200 inside the detergent supply casing 400 may be cleaned through the water discharged from the front shower means 265.

In FIG. 38, flow paths of the water falling from the detergent water supply 261 and the front shower means 265 of the water supply 260 of the dispenser 200 are indicated by arrows. The front shower means 265 may be located in front of the detergent water supply 261, and the front end of the detergent supply casing 400 may be washed by supplying the water to the front end of the detergent supply casing 400.

In one example, the detergent supply casing 400 may include a front shower groove 403. The front shower groove 403 may be defined in a front end 411 of the side wall 410 of the detergent supply casing 400, and a top face of the front shower groove 403 may be opened by being indented away from the detergent storage 300 along the left and right direction of the detergent storage 300.

Further, the front shower means 265 may be located above the front shower groove 403, so that the water may be supplied to the front end of the bottom 401 of the detergent supply casing 400 by falling water into the front shower groove 403.

Figure 40:
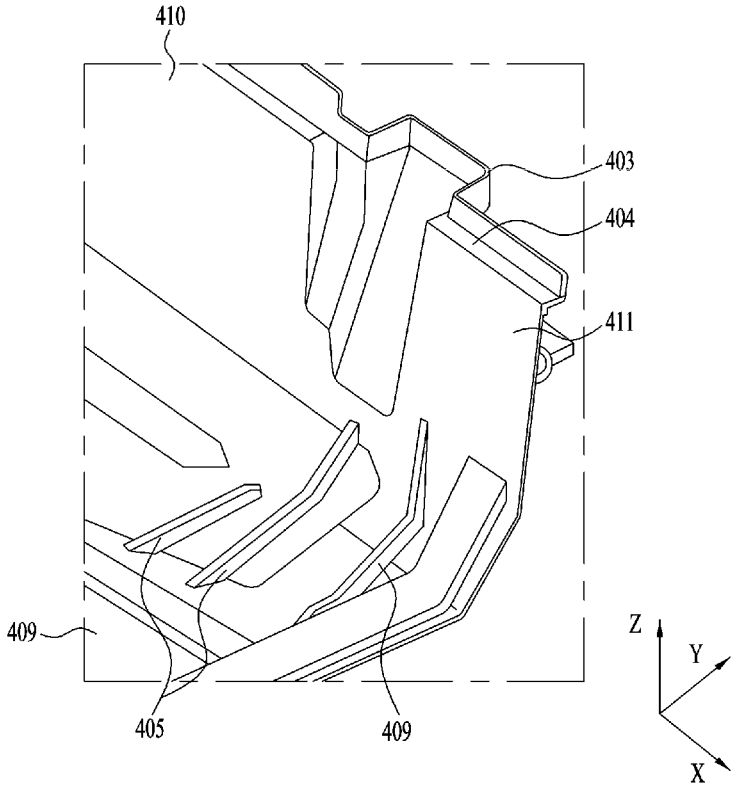
FIG. 40 is a view illustrating a front shower groove of a detergent supply casing in a laundry treating apparatus according to an embodiment of the present disclosure.
Figure 41:
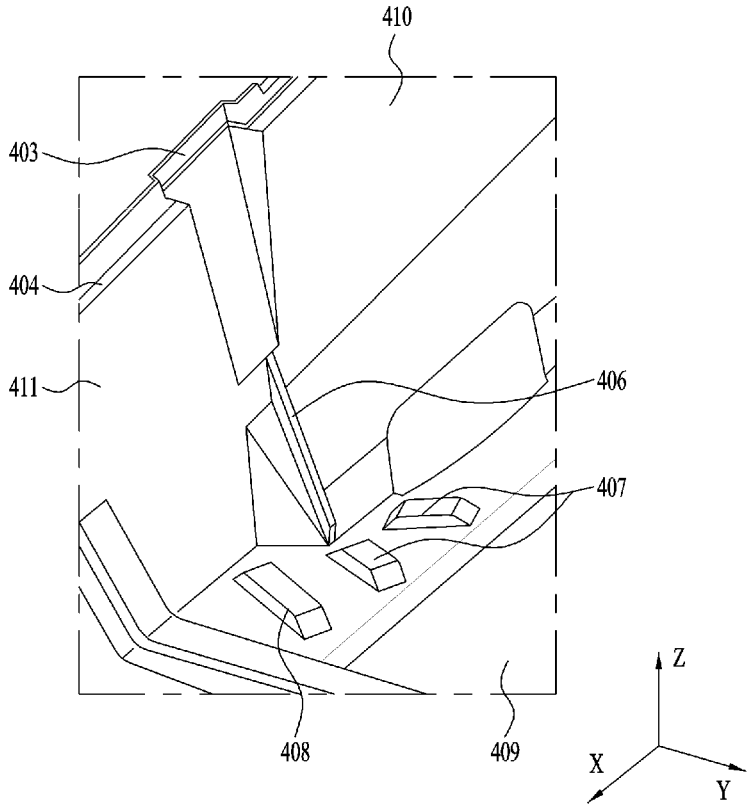
FIG. 41 is a view illustrating a front shower groove and shower water ribs of a detergent supply casing in a laundry treating apparatus according to an embodiment of the present disclosure.

FIG. 39 illustrates the front shower groove 403 defined in the detergent supply casing 400, and FIGS. 40 and 41 are enlarged views of the front shower groove 403 in FIG. 39.

Referring to FIGS. 39 to 41, the front shower groove 403 is defined in the side wall 410 of the detergent supply casing 400, and the front shower groove 403 may be located at the front end of the detergent supply casing 400 so as to correspond to the front shower means 265. That is, the front shower groove 403 may be located at the front end 411 on the side wall 410 of the detergent supply casing 400.

The front shower groove 403 may have a shape recessed outward from the interior of the detergent supply casing 400 along the left and right direction of the detergent supply casing 400. Further, the front shower groove 403 has the open top face.

In one example, the front shower means 265 may be positioned on a side of the front end 291 of the dispenser 200 as shown in FIG. 37. That is, the front shower means 265 may be located above the front shower groove 403 to discharge the water to the open top face of the front shower groove 403.

The water flowed into the open top face of the front shower groove 403 may flow along the front shower groove 403 and be delivered to the bottom 401 of the detergent supply casing 400. An embodiment of the present disclosure delivers the water of the front shower means 265 to the front end of the detergent supply casing 400 through the front shower groove 403 recessed away from the detergent storage 300 in the left and right direction, so that the water falling from the front shower means 265 may be delivered to the detergent supply casing 400 by avoiding the detergent storage 300.

Accordingly, in an embodiment of the present disclosure, even when the front shower means 265 is disposed, deliver of unnecessary water to the detergent storage 300 may be suppressed, and the usability and manageability of the detergent storage 300 may be improved.

A shape of a cross-section of the front shower groove 403 viewed from above may be varied. A cross-sectional area of the front shower groove 403 may be approximately equal to or greater than a cross-sectional area of the front shower means 265. The shape of the cross-section of the front shower groove 403 may correspond to a shape of a cross-section of the front shower means 265.

Further, the front shower groove 403 may be defined such that an indented depth decreases toward the bottom 401 of the detergent supply casing 400 from the open top face. Accordingly, the water flowed into the front shower groove 403 may naturally flow from the front shower groove 403 to the bottom 401 of the detergent supply casing 400 as approaching the bottom 401 of the detergent supply casing 400.

In one example, as shown in FIGS. 39 to 41, the front shower groove 403 may protrude outward from the side wall 410 of the detergent supply casing 400 along the width direction. Accordingly, the depth of the front shower groove 403 indented to be away from the detergent storage 300 may not be restricted by a thickness of the side wall 410 of the detergent supply casing 400, and the front shower means 265 and the open top face of the front shower groove 403 may be spaced from the top face of the detergent storage 300 in the left and right direction.

In one example, as shown in FIGS. 40 and 41, in an embodiment of the present disclosure, the detergent supply casing 400 may further include a sliding rail 404. The sliding rail 404 may be disposed on the side wall 410 of the detergent supply casing 400, extend in the front and rear direction of the detergent supply casing 400, and be supported by the detergent storage 300 and be slid. Further, at least a portion of the top face of the front shower groove 403 may protrude outward from the sliding rail 404 along the left and right direction.

The sliding rail 404 disposed on the side wall 410 of the detergent supply casing 400 may extend along the front and rear direction of the detergent supply casing 400 on the side wall 410 of the detergent supply casing 400. The sliding rail 404 may be of various shapes. FIGS. 40 and 41 illustrate the sliding rail 404 in a stepped shape such that a top face of the sliding rail 404 faces the detergent storage 300 on the side wall 410 of the detergent supply casing 400.

The detergent storage 300 retracted into the cabinet 10 through the opening 15 of the cabinet 10 may slide toward a rear portion of the detergent supply casing 400 with both sides thereof supported on the sliding rail 404.

In one example, at least a portion of the top face of the front shower groove 403 may protrude to be farther away from the detergent storage 300 than the sliding rail 404. That is, the front shower groove 403 may be recessed more outward than the sliding rail 404 along the left and right direction of the detergent supply casing 400.

Because the top face of the front shower groove 403 is located outward in the left and right direction than the sliding rail 404 on which the both sides of the detergent storage 300 are supported and slides, the water falling from the front shower means 265 located above the front shower groove 403 may be delivered to the front shower groove 403 by avoiding the detergent storage 300.

Figure 42:
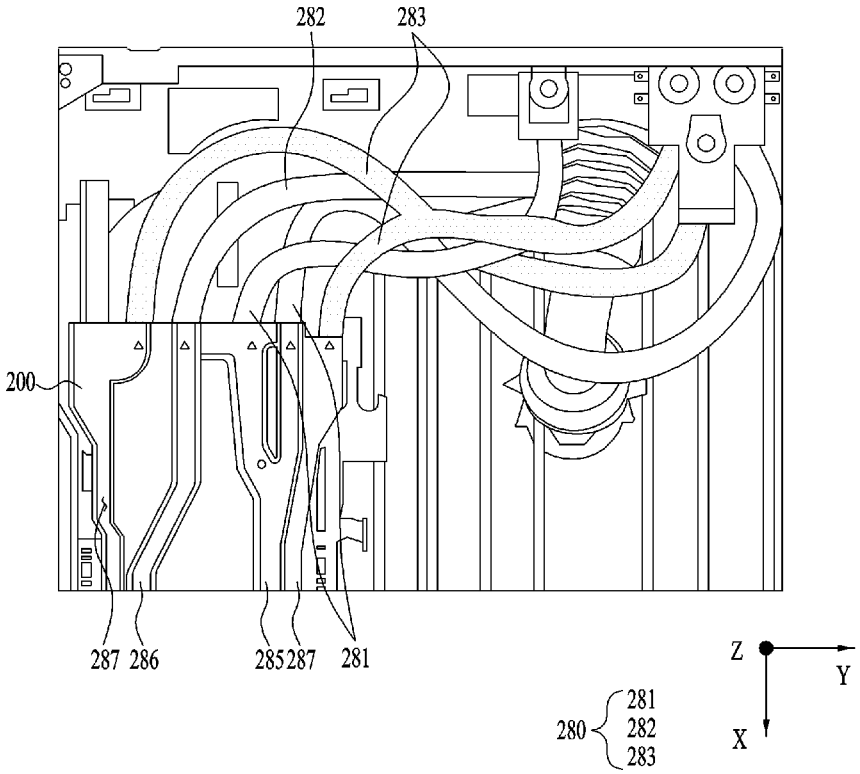
FIG. 42 is a view illustrating a supply hose connected to a dispenser in a laundry treating apparatus according to an embodiment of the present disclosure.

In one example, FIG. 42 illustrates a plurality of supply hoses 280 arranged inside the cabinet 10 and connected to the dispenser 200 according to an embodiment of the present disclosure. Referring to FIG. 42, the plurality of supply hoses 280 may be connected to the dispenser 200 to supply the water to the dispenser 200.

The plurality of supply hoses 280 may receive the water from a water supply outside the laundry treating apparatus 1 according to an embodiment of the present disclosure. Further, a plurality of hose valves for regulating inflow of water supplied from the water supply may be arranged, and the flow of the water in the plurality of supply hose 280 may be regulated by the plurality of hose valves.

Further, the front shower means 265 and the detergent water supply 261 may receive the water delivered from different supply hoses 280 among the plurality of supply hoses 280. That is, one of the plurality of supply hoses 280 may supply the water to a channel connected from the interior of the dispenser 200 to the front shower means 265, and another of the plurality of supply hoses 280 may supply the water through a channel connected from the interior of the dispenser 200 to the detergent water supply 261.

As shown above, in an embodiment of the present disclosure, a water pressure of the water discharged through the front shower means 265 may be secured to be equal to or above a certain level because the front shower means 265 receives the water from a supply hose different from the supply hose that supplies the water to the detergent water supply 261.

For example, when the water diverges and is delivered to the front shower means 265 and the detergent water supply 261 from one supply hose 280, water pressures at the front shower means 265 and the detergent water supply 261 will be lower than a water pressure at the supply hose 280, which may be disadvantageous for supplying the water to the detergent storage 300 or the detergent supply casing 400.

Further, when one supply hose 280 supplies the water to the detergent water supply 261 and when the water supplied to the detergent water supply 261 is delivered back to the front shower means 265 through the channel defined inside the dispenser 200, the water pressure lowered via the detergent water supply 261 may be provided to the front shower means 265, which may be disadvantageous.

Accordingly, an embodiment of the present disclosure is capable of securing sufficient water pressure in the front shower means 265 and the detergent water supply 261 by respectively arranging the supply hoses 280 that respectively supply the water to the front shower means 265 and the detergent water supply 261. In one example, a detailed description of a type and the like of the plurality of supply hoses 280 will be described later.

In one example, referring again to FIGS. 40 and 41, an embodiment of the present disclosure may further include shower water ribs 405. The shower water ribs 405 may protrude from an inner face of the front end of the detergent supply casing 400 and extend along the direction transverse to the front and rear direction of the detergent supply casing 400 to guide the flow of the water inflowed through the front shower groove 403.

The shower water ribs 405 may be arranged on the bottom 401, the side wall 410, or a connection portion of the bottom 401 and the side wall 410 of the detergent supply casing 400. The shower water ribs 405 may protrude from the inner face of the detergent supply casing 400 and may extend in the direction transverse to the front and rear direction of the detergent supply casing 400, for example, approximately along the left and right direction of the detergent supply casing 400. However, the extension direction of the shower water ribs 405 is not necessarily limited thereto.

The shower water ribs 405 may be located between the front shower groove 403 and the bottom 401 of the detergent supply casing 400. One end of the shower water rib 405 may be disposed to approximately face toward the front shower groove 403 to guide the flow of the water inflowed through the front shower groove 403.

In some cases, the water inflowed through the front shower groove 403 may be discharged through the detergent drain hole 402 of the detergent supply casing 400 without washing a sufficient area at the front end of the bottom 401 of the detergent supply casing 400.

Thus, in an embodiment of the present disclosure, the shower water ribs 405 extending in the direction transverse to the front and rear direction of the detergent supply casing 400 between the front shower groove 403 and the bottom 401 of the detergent supply casing 400 are arranged, so that the flow may be diffused or guided such that the water inflowed through the front shower groove 403 may reach a sufficient area at the front end of the bottom 401 of the detergent supply casing 400.

Said one end of the shower water rib 405 may approximately face toward the front shower groove 403. However, when the plurality of shower water ribs 405 are arranged, one end of one of the shower water ribs 405 may face toward another shower water rib 405.

As shown in FIGS. 40 and 41, in an embodiment of the present disclosure, the plurality of shower water ribs 405 may be arranged and may include a main rib 406. One end of the main rib 406 may face toward the end of the shower groove and the other end thereof may face toward the bottom 401. The water discharged from the front shower groove 403 may flow from said one end of the main rib 406 along the other end to the bottom 401.

In one example, in an embodiment of the present disclosure, the shower water ribs 405 may further include auxiliary ribs 407.

One end of the auxiliary rib 407 may face toward the other end of the main rib 406, and the other end of the auxiliary rib 407 may face toward a center of the bottom 401 based on the left and right direction. The flow of the water flowed into the detergent supply casing 400 through the front shower groove 403 may be primarily guided by the main rib 406, and then secondarily guided by the auxiliary ribs 407.

The auxiliary rib 407 is disposed such that one end thereof faces toward the other end of the main rib 406, so that the auxiliary rib 407 may be in contact with the water flowed along the main rib 406. Further, the auxiliary rib 407 is disposed such that the other end thereof faces toward the center of the bottom 401 of the detergent supply casing 400, so that the water flowed along the main rib 406 may flow toward the bottom 401 of the detergent supply casing 400 again.

A specific shape of the detergent supply casing 400 may be designed by various components inside the cabinet 10, and accordingly, the side wall 410 or the bottom 401 may not have a flat face. Positions or the number of main ribs 406 may be restricted by such design constraints, but an embodiment of the present disclosure may overcome the design constraints by arranging the auxiliary ribs 407 that organically guide the flow of the water along with the main rib 406.

For example, when one main rib 406 is disposed in one front shower groove 403, the plurality of auxiliary ribs 407 are arranged on a side of the other end of the main rib 406. When the plurality of auxiliary ribs 407 are arranged in a fan shape in which the plurality of auxiliary ribs 407 are away from each other from one end toward the other end, the water delivered from one main rib 406 may be diffused and flowed over a wider area using the plurality of auxiliary ribs 407.

FIG. 40 illustrates the shower water ribs 405 including the main rib 406, and FIG. 41 illustrates the shower water ribs 405 including the main rib 406 and the auxiliary ribs 407. The arrangement of the auxiliary ribs 407 may be determined in consideration of a design such as a shape of the inner face of the detergent supply casing 400 at a corresponding position and an actual degree of diffusion of the water.

When a plurality of front shower grooves are defined in the detergent supply casing 400, for each front shower groove 403, whether to arrange the shower water ribs 405 and whether to arrange the shower water ribs 405 by including the auxiliary ribs 407 may be determined.

In one example, as shown in FIGS. 40 and 41, an embodiment of the present disclosure may further include a leak-proof rib 408. The leak-proof rib 408 protrudes from an inner face of the detergent supply casing 400, and extends along a direction transverse to a front and rear direction of the detergent supply casing 400, and is located in front of the shower water rib 405 and the front shower groove 403 to prevent water from leaking through the opening 15.

The leak-proof rib 408 may have one end facing a side wall 410 of the detergent supply casing 400 and the other end opposite to one end. One end and the other end thereof may be spaced apart from and disposed in front of the front shower groove 403 and the shower water rib 405. A protrusion height and a length of the leak-proof rib 408 may be variously determined according to needs.

As one end of the leak-proof rib 408 is located in front of the front shower groove 403 and the shower water rib 405 which may include a plurality of shower water ribs, water introduced through the front shower groove 403 and guided by the shower water rib 405 may be prevented from moving to a position in front of the leak-proof rib 408.

Since the front shower groove 403 and the shower water rib 405 are located at a front end of the detergent supply casing 400, the water flowing from the front shower groove 403 may leak out through the opening 15 of the cabinet 10 located in front of the detergent supply casing 400.

Thus, an embodiment of the present disclosure may include the leak-proof rib 408 extending in a direction transverse to the front and rear direction of the detergent supply casing 400, e.g., extending along an approximately left and right direction of the detergent supply casing 400 and spaced from and disposed in front of the front shower groove 403 and the shower water rib 405. Thus, the shower water to clean a front end of the detergent supply casing 400 may be prevented from leaking to the opening 15.

Referring again to FIG. 39, in an embodiment of the present disclosure, the detergent supply casing 400 may have a detergent water flow groove 409 that is recessed downward in a center of the bottom 401 based on the left and right direction.

The detergent water flow groove 409 may extend from the front end of the bottom 401 toward the detergent drain hole 402 so that the water introduced through the front shower groove 403 may flow to the detergent drain hole 402.

The detergent water flow groove 409 may be located in front of the detergent drain hole 402. The detergent water flow groove 409 may be recessed downward from the bottom 401 of the detergent supply casing 400, that is, in a direction away from the detergent storage 300.

The detergent water flow groove 409 extends from the front end of the bottom 401 of the detergent supply casing 400 toward the detergent drain hole 402, so that water or detergent present in the front of the detergent drain hole 402 and on the bottom 401 of the detergent supply casing 400 may flow along the detergent water flow groove 409 toward the detergent drain hole 402. The detergent water flow groove 409 may be located at the center of the bottom 401 of the detergent supply casing 400 based on the left and right direction of the detergent supply casing 400.

When water flowing into the detergent supply casing 400 through the front shower groove 403 flows toward the detergent drain hole 402, that is, in a rear direction, instead of toward the bottom 401 of the detergent supply casing 400, and then is discharged to the outside of the detergent supply casing 400 through the detergent drain hole 402, the washing area by water introduced through the front shower groove 403 may be reduced on the front end of the bottom 401 of the detergent supply casing 400.

Accordingly, one embodiment of the present disclosure may include the detergent water flow groove 409 that is recessed downwards in the center of the bottom 401 of the detergent supply casing 400. Thus, water flowing from the front shower groove 403 may flow into the detergent water flow groove 409 to increase the cleaning area on the bottom 401 of the detergent supply casing 400.

A recessed depth of the detergent water flow groove 409 may be determined in various ways. A width of the detergent water flow groove 409 based on the left and right direction of the detergent supply casing 400 may also be determined in various ways as required. The determination of the depth or the width of the detergent water flow groove 409 may reflect statistical results from a plurality of experiments.

The shower water rib 405 may be located adjacent to the detergent water flow groove 409. The other end thereof facing toward the bottom 401 of the detergent supply casing 400 may face toward the detergent water flow groove 409.

In an embodiment of the present disclosure, the detergent drain hole 402 may be defined in the bottom 401 of the detergent supply casing 400, and may be located behind the front shower means 265 and the detergent outlet 648.

The water supply 260 of the dispenser 200 shown in FIG. 38 may include a detergent cup water supply 263 together with a front shower means 265 and a detergent water supply 261. The detergent cup water supply 263 may be disposed above the detergent cup 700 of the detergent storage 300 completely retracted into the cabinet 10. A detailed description of the detergent cup water supply 263 will be disposed later.

As described above, the detergent outlet 648 of the detergent storage 300 may be located under the detergent cup 700. The detergent cup water supply 263 may be located above the detergent cup 700. FIG. 38 shows a state in which the detergent drain hole 402 is located in rear of the detergent cup water supply 263 based on the front and rear direction of the detergent supply casing 400.

In other words, in an embodiment of the present disclosure, the detergent drain hole 402 is located in rear of the detergent outlet 648 of the detergent storage 300 retracted into the cabinet 10 as well as the front shower means 265, so that together with water flowing into the detergent supply casing 400 through the front shower means 265, the detergent flowing out through the detergent outlet 648 may be completely discharged out of the detergent supply casing 400 through the detergent drain hole 402.

Referring again to FIG. 37, in an embodiment of the present disclosure, the water supply 260 may further include a rear shower means 267. The rear shower means 267 may be disposed at a rear end 293 of the dispenser 200, and may supply water to the rear end of the detergent supply casing 400.

The rear shower means 267 may provide water to the detergent supply casing 400 to clean the rear end of the detergent supply casing 400. In FIG. 38, the flow of water falling through the rear shower means 267 is indicated by arrows.

A detergent valve 380 of the detergent reservoir 310 and an inlet port of the detergent pump may be connected to each other at the rear end of the detergent supply casing 400. At the connection point between the detergent valve 380 and the inlet port, unexpected leakage of detergent may occur. Other foreign matter may be present at the rear end of the detergent supply casing 400.

An embodiment of the present disclosure includes the front shower means 265 at the front end 291 of the dispenser 200, and the rear shower means 267 at the rear end 293 of the dispenser 200, thereby to clean both the front and rear portions of the detergent supply casing 400 based on the detergent drain hole 402.

As in the front shower means 265, the rear shower means 267 has a plurality of opening formed in the bottom face of the dispenser 200 through which water falls down, such that water may be supplied to the detergent supply casing 400 while bypassing the detergent storage 300.

In an embodiment of the present disclosure, a detergent water supply 261 may be located between the front shower means 265 and the rear shower means 267. FIG. 38 shows a positional relationship between the front shower means 265, the detergent water supply 261, and the rear shower means 267. That is, the water supply 260 disposed in the dispenser 200 may have the front shower means 265 at the front end 291 of the dispenser 200, the detergent water supply 261 at the center of the dispenser 200, and the rear shower means 267 at the rear end 293 of the dispenser 200.

In one example, in an embodiment of the present disclosure, the rear end 412 of the side wall 410 of the detergent supply casing 400 may be spaced outwardly from the detergent storage 300 along the left and right direction. The rear shower means 267 may be located above a space between the rear end 412 of the side wall 410 and the detergent storage 300.

FIG. 38 shows that the rear end 412 of the side wall 410 of the detergent supply casing 400 is spaced outwardly from the detergent storage 300. As described above, the detergent storage 300 has the width W3 of the rear end smaller than the width W2 of the front end. The side wall 410 of the detergent supply casing 400 may have a narrow section between the front end 411 and the rear end 412 corresponding to a shape of the detergent storage 300.

In one example, the rear end 412 of the side wall 410 of the detergent supply casing 400 may be located away from the detergent storage 300 in the left and right direction. Accordingly, a space may be formed between the side wall 410 of the detergent supply casing 400 and the detergent storage 300, and the space may have a top face open.

In one example, the rear shower means 267 may be located above the space. Water falling from the rear shower means 267 may be supplied to the rear end of the detergent supply casing 400 through the open top face of the space.

Furthermore, as described above, the detergent storage 300 may have the rear end narrower than the front end thereof. Therefore, this is advantageous in design in that the side wall 410 of the detergent supply casing 400 may suppress the increase in a total width of the detergent supply casing 400 even when the rear end 412 is spaced from the detergent storage 300 in the left and right direction.

For example, when the rear end of detergent storage 300 has the same width as the front end thereof, and when the rear end 412 of the side wall 410 of the detergent supply casing 400 is spaced outwardly from the rear end of the detergent storage 300 along the width direction, the width of the rear end of the detergent supply casing 400 is formed to be larger than the width of the front end of the detergent supply casing 400. Accordingly, an unnecessary increase in the width of the detergent supply casing 400 may occur.

Therefore, according to the present disclosure, the width W3 of the rear end of the detergent storage 300 is smaller than the width W2 of the front end as described above, to facilitate the insertion of the detergent storage 300 through the opening 15, and, at the same time, to allow the formation of the space between the rear end of the detergent storage 300 and the rear end 412 of the side wall 410 of the detergent supply casing 400, such that the rear shower means 267 may be effectively disposed.

In one example, in an embodiment of the present disclosure, the dispenser 200 has the rear end 293 narrower than the front end 291 based on the left and right direction to correspond to the shape of the detergent storage 300. The rear shower means 267 may protrude outward from the dispenser 200 along the left and right direction.

FIG. 37 shows the bottom face of the dispenser 200 in which the width of the rear end 293 is smaller than that of the front end 291 so as to correspond to the shape of the detergent storage 300. That is, in an embodiment of the present disclosure, each of the detergent supply casing 400, the detergent storage 300 and the dispenser 200 may have a width of the rear end 293 smaller than that of the front end 291.

As described above, since the width of the rear end of each of the detergent storage 300 and the detergent supply casing 400 is smaller than the width of the front end thereof, a space may be secured such that the rear end of the detergent supply casing 400 is eventually separated from the detergent storage 300 in the left and right direction.

In other words, the detergent supply casing 400 may have a narrow section narrower than the front end and the rear end and defined between the front end and the rear end. The width of the narrow section may correspond to the width W3 of the rear end of the detergent storage 300.

In one example, the dispenser 200 is configured so that the rear end 293 has a narrower width than that of the front end 291, and the rear shower means 267 protrudes in the left and right direction from the rear end 293 of the dispenser 200. Thus, it may be understood that the dispenser 200 has a narrow portion formed between the front end 291 and the rear end 293 so as to correspond to the shape of the detergent supply casing 400.

In an embodiment of the present disclosure, the rear end 293 is narrower than the front end 291 so that a shape of the dispenser 200 corresponds to a shape of the detergent supply casing 400 as shown in FIG. 37. Thus, as shown in FIG. 38, the dispenser 200 may be stably supported on the side wall 410 of the detergent supply casing 400. At the same time, the rear shower means 267 protrudes in the left and right direction from the rear end 293 of the dispenser 200, such that water may be supplied to the space between the rear end 412 of the side wall 410 of the detergent supply casing 400 and the detergent storage 300.

In one example, referring to FIG. 42, in an embodiment of the present disclosure, a plurality of supply hose 280 connected to the dispenser 200 may include a detergent supply hose 281 and a shower water supply hose 283. The detergent supply hose 281 is connected to the dispenser 200 to supply water to the detergent water supply 261 of the dispenser 200. The shower water supply hose 283 is connected to the dispenser 200 to supply water to the front shower means 265 and the rear shower means 267 of the dispenser 200.

In the detergent supply hose 281, the flow of water may be interrupted via a hose valve as described above. The detergent supply hose 281 may be connected to the dispenser 200 to supply water thereto. Water flowing into the dispenser 200 through the detergent supply hose 281 may be delivered to the detergent water supply 261.

The detergent supply hose 281 may be connected to the detergent water supply 261 to supply water to the detergent water supply 261. As shown in FIG. 42, the detergent supply hose 281 may be connected to one side of the dispenser 200, for example, the rear end 293 of the dispenser 200, and water supplied from the detergent supply hose 281 through a detergent flow channel 285 disposed inside the dispenser 200 may be delivered to the detergent water supply 261.

The detergent flow channel 285 may have a pair of channel walls protruding upward from the bottom face of the dispenser 200. A top face of the dispenser 200 may be positioned on a top of the channel wall. The detergent flow channel 285 may be formed inside the dispenser 200 and may extend from the detergent supply hose 281 to the detergent water supply 261.

In one example, each of the shower water flow channel 287 and the detergent cup channel which may be formed inside dispenser 200 as described below may have a pair of channel wall as in the detergent flow channel 285, and may be formed inside dispenser 200.

In the dispenser 200, different channels have their respective channel walls. The different channels may share some of the channel walls with each other. However, the different channels may be separated from each other by the channel walls so that the different channels do not share the same water with each other.

The shower water supply hose 283 may be connected to one side of the dispenser 200, for example, to the rear end 293 of the dispenser 200. Inside the dispenser 200, a shower water flow channel 287 extending from the shower water supply hose 283 to the rear shower means 267 and the front shower means 265 may be defined. In an embodiment of the present disclosure, a combination of the front shower means 265 and the rear shower means 267 may be defined as shower means.

An embodiment of the present disclosure includes the shower water supply hose 283 that supplies water to the shower means separately from the detergent supply hose 281 that supplies water to the detergent water supply 261. As a result, sufficient water pressure and amount of the detergent water supply 261 and the shower means may be secured.

Water from an water supply outside the cabinet 10 may flow to both the detergent supply hose 281 and the shower water supply hose 283 which may be connected to different hose valves, such that flows of water therein may be controlled independently.

The hose valves may have a parallel connection with the water supply from outside the cabinet 10. That is, opening and closing of the hose valves may not have mutual influence on control of the supply hoses 280.

In one example, in an embodiment of the present disclosure, the water supply 260 of the dispenser 200 may further include a detergent cup water supply 263. As described above, the detergent cup 700 may be disposed in the detergent storage frame 390. The detergent cup water supply 263 may be located above the detergent cup 700 and may supply water to the detergent cup 700.

Further, the plurality of supply hoses 280 connected to the dispenser 200 may further include a detergent cup supply hose 282. The detergent cup supply hose 282 may be connected to the dispenser 200 to supply water to the detergent cup water supply 263 of the dispenser 200.

The detergent cup 700 may receive water falling from the detergent cup water supply 263 through an open top face thereof, such that the detergent stored in the detergent cup 700, for example, a third detergent that may be defined for convenience of description, together with water may be discharged through a cup discharger 705.

As described above, the detergent discharged from the cup discharger 705 of the detergent cup 700 may be discharged to the outside of the detergent storage 300 through the detergent outlet 648 located under the detergent cup 700 in the detergent containing region 650 and then may be delivered into the tub 20 through the detergent drain hole 402 of the detergent supply casing 400.

In one example, the detergent cup water supply 263 may be disposed behind the detergent water supply 261, and may receive water from the detergent cup supply hose 282 which is separate from the detergent supply hose 281 and the shower water supply hose 283.

For example, the detergent cup supply hose 282 may be connected to the rear end 293 of the dispenser 200. Inside the dispenser 200, a detergent cup channel 286 extending from the detergent cup supply hose 282 to the detergent cup water supply 263 may be defined.

In an embodiment of the present disclosure, the water supply 260 disposed in the dispenser 200 includes the detergent water supply 261, the detergent cup water supply 263 and the shower means. In this connection, the detergent supply hose 281 for the detergent water supply 261, the detergent cup supply hose 282 for the detergent cup water supply 263 and the shower water supply hose 283 for the shower means may be provided, thereby to sufficiently secure the flow rate and pressure of water to be supplied to the water supply 260, and to minimize operational influences between the detergent water supply 261, the detergent cup water supply 263 and the shower means. As described above, the shower means may include the front shower means 265 and the rear shower means 267.

Referring to FIG. 37 again, in an embodiment of the present disclosure, the shower water flow channel 287 extends in a front direction from the rear shower means 267 and within the dispenser 200 and may be connected to the front shower means 265. The front shower means 265 may receive water supplied to the rear shower means 267 through the shower water supply hose 283, through the shower water flow channel 287.

Specifically, the rear shower means 267 may be located at the rear end 293 of the dispenser 200. The shower water supply hose 283 may be connected to the rear portion of the rear shower means 267. That is, the rear shower means 267 may be directly connected to a connection port to which the shower water supply hose 283 is coupled in the dispenser 200, so that water may be supplied thereto from the shower water supply hose 283.

However, when necessary, an additional channel may be formed between the rear shower means 267 and the shower water supply hose 283. Even in this case, water supplied from the shower water supply hose 283 may be first delivered to the rear shower means 267.

In one example, the shower water flow channel 287 may connect the rear shower means 267 and the front shower means 265 to each other. The front shower means 265 located at the front end 291 of the dispenser 200 may be located in front of the rear shower means 267 located at the rear end 293 of the dispenser 200. The shower water flow channel 287 may extend in a front direction from the rear shower means 267 and may be connected to the front shower means 265.

That is, water received from the shower water supply hose 283 may flow toward the rear shower means 267, the shower water flow channel 287 and the front shower means 265. Accordingly, an embodiment of the present disclosure may efficiently supply water to the front shower means 265 and the rear shower means 267 through a single shower water supply hose 283, and may not cause the water pressure decrease in the detergent water supply 261 and the detergent cup water supply 263.

In one example, referring to the dispenser 200 of FIG. 37 with reference to FIG. 42, in an embodiment of the present disclosure, the front shower means 265 and the rear shower means 267 may constitute a pair. Two pairs may be disposed, respectively, on both sides of the dispenser 200. Two shower water supply hoses 283 may be connected to both sides of the dispenser 200 respectively to supply water to the rear shower means 267. The detergent supply hose 281 may be connected to the dispenser 200 while being disposed between the two shower water supply hoses 283.

Specifically, in an embodiment of the present disclosure, as shown in FIG. 37, the front shower means 265 and the rear shower means 267 may constitute a pair. Two pairs may be disposed on both sides of the dispenser 200, respectively.

That is, two front shower means 265 may be disposed on both sides of the front end 291 of the dispenser 200, respectively. Two rear shower means 267 may be disposed on both sides of the rear end 293 of the dispenser 200, respectively. Accordingly, the detergent supply casing 400 may receive the shower water on both sides of the bottom 401 thereof so that efficient cleaning may be achieved.

Two shower water supply hoses 283 may be connected to both sides of the rear end 293 of the dispenser 200, respectively. That is, a pair of shower water supply hoses 283 may be connected to the rear of the rear shower means 267 at both sides of rear end 293 of the dispenser 200, respectively.

Since the pair of shower water supply hoses 283 are connected to both sides of the rear end 293 of the dispenser 200, respectively, the rest except for the shower water supply hose 283 of the plurality of supply hoses 280, for example, the detergent supply hose 281 or the detergent cup supply hose 282 may be connected to the dispenser 200 while being disposed between the pair of shower water supply hoses 283.

The detergent supply hose 281 may include a hot water supply hose and a cold water supply hose.

In one example, as shown in FIG. 37, two shower water flow channels 287 may be connected to different rear shower means 267, respectively. That is, a pair of rear shower means 267 disposed respectively on both sides of the rear end 293 of the dispenser 200 may be connected to different shower water flow channels 287, respectively.

A pair of shower water flow channels 287 respectively extending in a front direction from the pair of rear shower means 267 may be respectively connected to a pair of front shower means 265 located on both sides of the front end 291 of the dispenser 200, respectively.

The shower water flow channels 287 may be respectively disposed on both sides of the dispenser 200 to correspond to the front shower means 265 and the rear shower means 267. The detergent flow channel 285 and the detergent cup channel 286 may be located between the pair of shower water flow channels 287.

Figure 43:
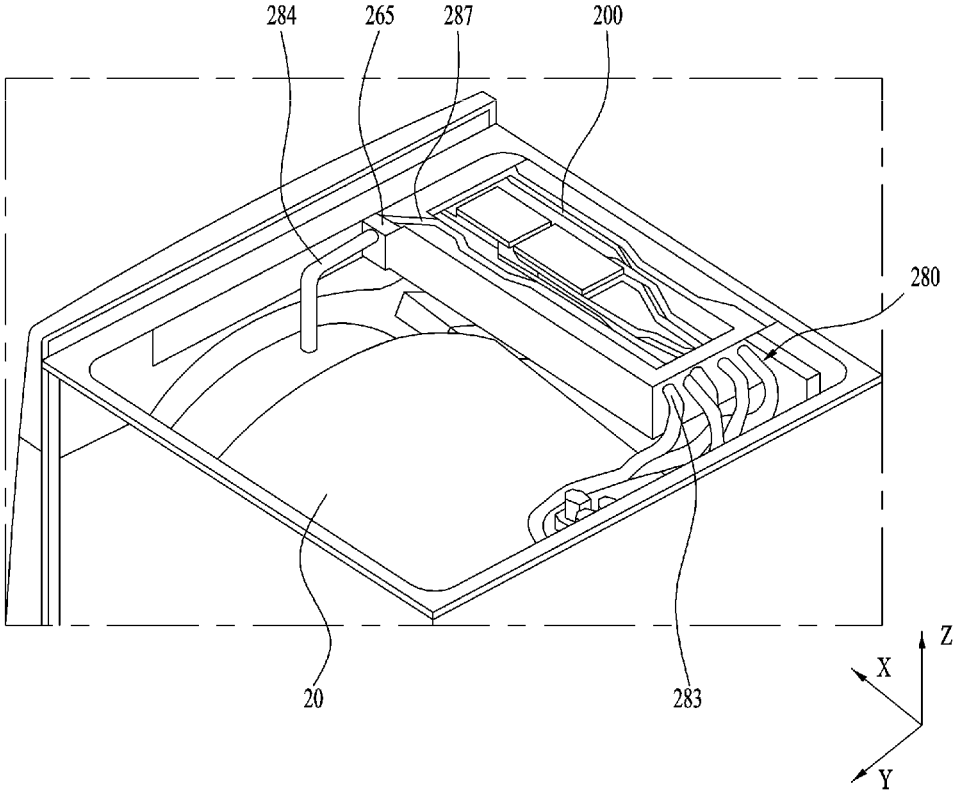
FIG. 43 is a view illustrating a tub connection hose connecting a dispenser and a tub with each other in a laundry treating apparatus according to an embodiment of the present disclosure.

In one example, FIG. 43 shows the interior of the cabinet 10 as viewed from above. As shown in FIG. 43, an embodiment of the present disclosure may further include a tub connection hose 284 which is connected to the dispenser 200 to receive water from the front shower means 265, and is connected to the tub 20 to transfer water from the front shower means 265 to the tub 20.

One end of the tub connection hose 284 may be connected to the dispenser 200 to communicate with the front shower means 265, and the other end thereof may be connected to the tub 20. Accordingly, a portion of the water supplied to the front shower means 265 may be supplied into the tub 20 through the tub connection hose 284.

The water fed into the tub 20 through the tub connection hose 284 may be used for various purposes. For example, at the beginning of the washing process, the water may be used to supplement wash water for washing. In the middle of the washing process, the water may be sprayed into the tub 20 for atomizing to improve washing efficiency.

In one example, when the water is supplied into tub 20 through the tub connection hose 284, the water may be discharged from the front shower means 265 and the rear shower means 267 based on the flow path of the water. That is, in a situation where the water is supplied into the tub 20 through the tub connection hose 284, the inside of the detergent supply casing 400 may be cleaned by the front shower means 265 and the rear shower means 267.

The front shower means 265 and the rear shower means 267 may not supply water to the detergent storage 300, but supply water to the detergent supply casing 400. Thus, when the tub connection hose 284 is used to supply water to the inside of the tub 20, only the front shower means 265 and the rear shower means 267 may be used separately from the detergent water supply 261 and the detergent cup water supply 263.

In one example, when a plurality of front shower means 265 are disposed in the dispenser 200 according to an embodiment of the present disclosure, the tub connection hose 284 may be connected to all of the plurality of front shower means 265. Alternatively, as shown in FIG. 43, the tub connection hose 284 may be connected to any one of the plurality of the front shower means 265.

When the tub connection hose 284 is connected to any one of the plurality of the front shower means 265, the tub connection hose 284 may be connected to any one of the plurality of front shower means 265 as located close to the tub 20.

In FIG. 43, it is shown that the tub connection hose 284 is connected to one front shower means 265 facing toward the tub 20 among a pair of front shower means 265 respectively located on both sides of the dispenser 200 according to an embodiment of the present disclosure.

Figure 44:
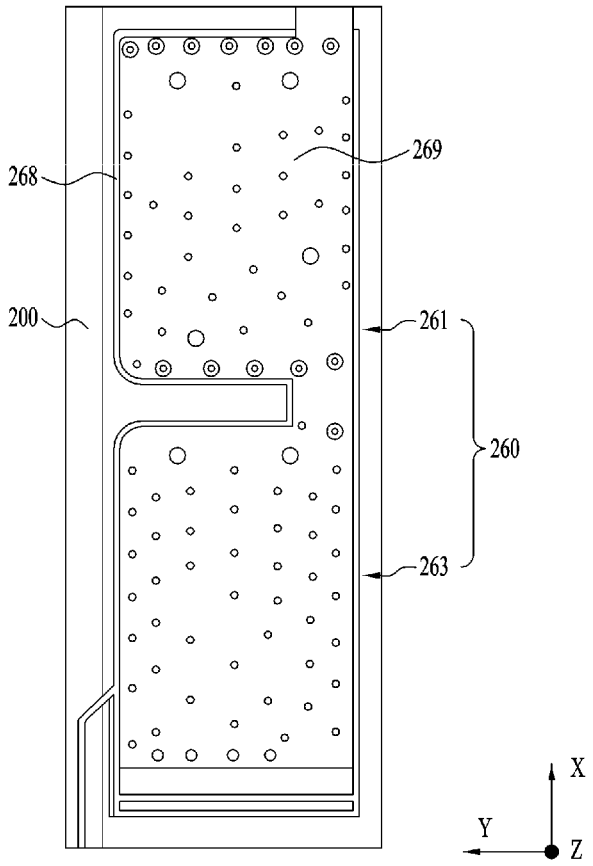
FIG. 44 is a view illustrating a surface of a water supply of a dispenser in a laundry treating apparatus according to an embodiment of the present disclosure.

In one example, FIG. 44 is a diagram of the water supply 260 disposed on the bottom face of the dispenser 200 as viewed from below.

As shown in FIG. 44, in an embodiment of the present disclosure, the water supply 260 disposed on the bottom face of the dispenser 200 has a surface 269 from which water is discharged. The surface 269 is subjected to water-repellent treatment so that the removal of water from the surface 269 may be induced.

Specifically, the water supply 260 has a plurality of openings and water falls down therethrough. The surface 269 from which water falls down from the water supply 260 may be located on the bottom face of the dispenser 200. The surface 269 of the water supply 260 may be subjected to water-repellent treatment so that water does not remain thereon when the use of the detergent supply 100 is finished.

The water-repellent treatment may refer to a work that makes it easier for water to be removed from the surface 269 of the water supply 260. The surface 269 may be coated with a hydrophobic material for the water-repellent treatment. The water-repellent treatment may include forming an irregular pattern on the surface 269 to reduce a contact area thereof with water and reduce the contact force of water.

As described above, the water supply 260 drops water toward the detergent supply casing 400 or the detergent storage 300. Thus, a portion of the water discharged from the water supply 260 remains on the surface 269 of the water supply 260 due to the adhesion of the water thereto.

In this case, over time, the water remaining on the surface 269 of the water supply 260 may cause unsanitary substances such as mold. Accordingly, in an embodiment of the present disclosure, the water supply 260 may supply water to the detergent storage 300 or the detergent supply casing 400, and the surface 269 of the water supply 260 facing downward may be subjected to the water-repellent treatment, thereby to effectively remove water from the surface 269 of the water supply 260 while effectively supplying water to the detergent storage 300 and the detergent supply casing 400, thereby to improve hygiene and manageability.

In one example, in an embodiment of the present disclosure, a water-repellent pattern 270 may be formed on the surface 269 of the water supply 260, thereby reducing the contact area thereof with water. That is, in an embodiment of the present disclosure, the water-repellent treatment may be achieved by forming the water-repellent pattern 270 on the surface 269 of the water supply 260. Water may be removed from the surface 269 on which the water-repellent pattern 270 is formed via separating the water from the surface 269 of the water supply 260 as the contact area thereof with water is reduced and the contact force of the water is reduced.

The water-repellent pattern 270 may be formed during a manufacturing process of the dispenser 200, for example, during an injection process, or may be formed by laser processing the injected dispenser 200. When the water-repellent pattern 270 is formed on the surface 269 of the water supply 260 through the injection process, the water-repellent pattern 270 may be formed into a mold for injection via laser processing.

When the laser processing is used, it may be possible to form the water-repellent pattern 270 that is more sophisticated and delicate. Accordingly, it is possible to prevent an unfavorable situation in which water adhered to the surface 269 of the water supply 260 penetrates between convex portions 271 of the water-repellent pattern 270, and thus the contact area is maintained or rather increased.

In one example, FIGS. 45 to 48 show shapes of the water-repellent patterns 270, respectively in an embodiment of the present disclosure. In an embodiment of the present disclosure, the surface 269 of the water supply 260 may have the water-repellent pattern 270 as formed by alternately repetitive arrangement of convex portions 271 protruding downward and concave portions 275 recessed upward.

In an embodiment of the present disclosure, the convex portion 271 of the water-repellent pattern 270 may mean a portion protruding downward from the surface 269 of the water supply 260, the concave portion 275 may mean a portion that is recessed upward in the surface 269.

Figure 45:
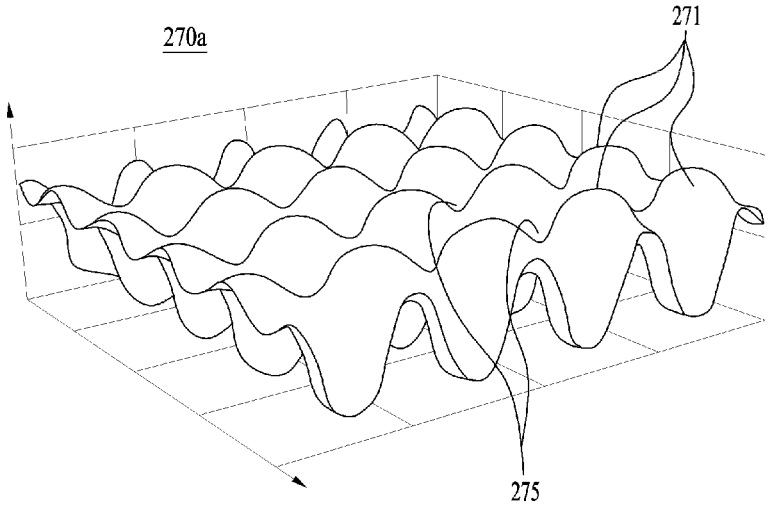
FIG. 45 is a view illustrating a water-repellent pattern in which convex portions and concave portions are arranged in a laundry treating apparatus according to an embodiment of the present disclosure.

In FIG. 45 and FIG. 48, the protruding direction of the convex portion 271 is shown to be upward on the drawing. That is, the convex portion 271 protrudes downward from the surface 269 of the water supply 260. However, in FIGS. 45 and 48, the convex portion 271 protrudes upward for convenience of description and understanding.

The convex portion 271 of the water-repellent pattern 270 may be in contact with water, while the concave portion 275 thereof may not be in contact with water and may be defined between adjacent convex portions 271. Therefore, when the water-repellent pattern 270 is formed in the same cross-sectional area, a contact area thereof with water may be reduced by approximately a total area of the concave portions 275, compared to a case where the water-repellent pattern 270 is not formed.

Accordingly, the contact force of water with the surface 269 may be reduced, and the contact angle thereof with the surface 269 may be increased, such that separation of the water from the surface 269 may be induced and the removal thereof from the surface 269 may be induced.

In one example, in an embodiment of the present disclosure, the surface 269 of the water supply 260 may have a contact angle of 120 degrees or greater with water. That is, the water-repellent pattern 270 formed on the surface 269 of the water supply 260 may be formed such that the contact angle of water therewith is 120 degrees or greater.

The contact angle means an angle containing liquid among two angles between a tangential line at a contact point of three phases, that is, solid, liquid, and gas and a solid surface when there is a liquid on the solid surface in the air.

As the contact angle increases, the water droplets get closer to a circle. Accordingly, the contact area and the contact force of water with the surface 269 of the water supply 260 may be reduced, and separation may be facilitated. A specific shape of the water-repellent pattern 270 for increasing the contact angle of water therewith may be determined in various ways.

For example, in the formation of the water-repellent pattern 270, the shape of the convex portion 271, the shape of the concave portion 275, the width of each of the convex portion 271 and the concave portion 275, the height or the depth of each of the convex portion 271 and the concave portion 275, and/or the arrangement of the convex portions 271 and the concave portions 275 may be considered.

The water-repellent pattern 270 in which the contact angle of water therewith is larger than 120 degrees may be determined based on the results of a plurality of experiments conducted while changing various factors as described above. An embodiment of the present disclosure may determine the water-repellent pattern 270 having the contact angle of 120 degrees or greater with the water based on statistical results of a plurality of experiments, and form the determined water-repellent pattern 270 on the surface 269 of the water supply 260.

Figure 46:
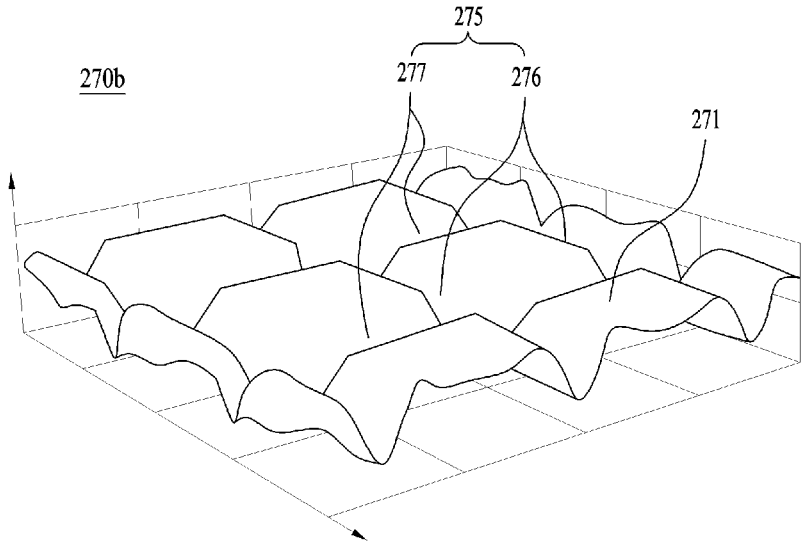
FIG. 46 is a view illustrating a water-repellent pattern in which first concave portions and second concave portions are arranged in a laundry treating apparatus according to an embodiment of the present disclosure.
Figure 47:
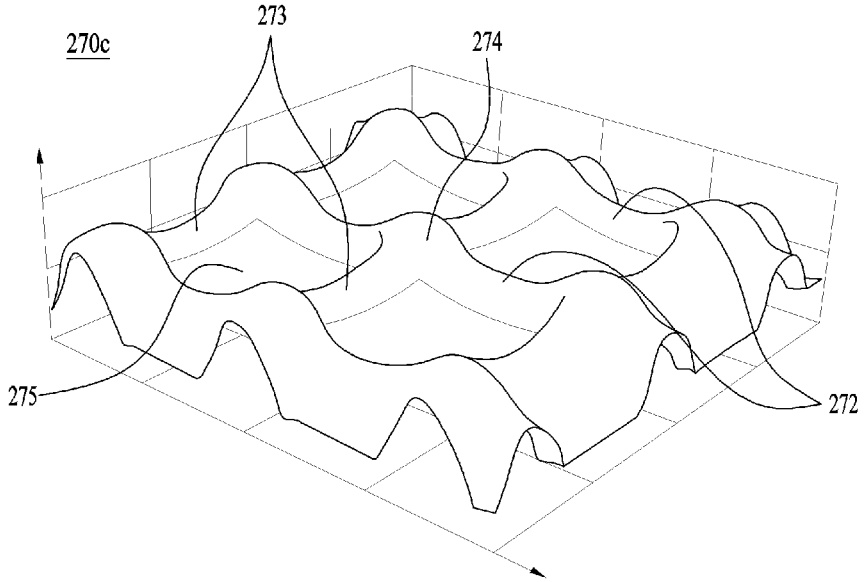
FIG. 47 is a view illustrating a water-repellent pattern in which first convex portions and second convex portions are arranged in a laundry treating apparatus according to an embodiment of the present disclosure.

In one example, referring to FIGS. 45 to 47, in an embodiment of the present disclosure, the water-repellent pattern 270 may include the convex portions 271 and the concave portions 275 arranged in a lattice form. The lattice form may mean that certain unit shapes are repeatedly arranged in one direction and the other direction on one plane.

FIG. 45 shows a first pattern 270*a* of the water-repellent pattern 270 according to an embodiment of the present disclosure. The first pattern 270*a* may be constructed such that the convex portions 271 and the concave portions 275 are arranged in a lattice form. Specifically, the convex portions 271 may be arranged along a first direction and a second direction perpendicular to the first direction on the surface 269 of the water supply 260, while the concave portions 275 may be arranged alternately with the convex portions 271. The concave portion 275 of FIG. 45 may have a maximum depression point positioned between the four convex portions 271.

In one example, in an embodiment of the present disclosure, the convex portion 271 may at least partially have an inclined surface or a curved surface such that the cross-sectional area thereof decreases as a vertical level thereof increases. For example, the convex portion 271 may have a protruding end having a shape of a sphere or a shape of a cone. Alternatively, the convex portion 271 may have a conical shape in which a cross-sectional area thereof decreases as a vertical level thereof increases.

The convex portion 271 may at least partially have an inclined surface or a curved surface such that the cross-sectional area thereof decreases as a vertical level thereof increases. Thus, the contact area thereof with water may be further reduced and removal of the water therefrom may be facilitated.

However, a specific shape of the convex portion 271 may be variously determined as needed and may not be necessarily limited to having an inclined or curved surface. For example, the convex portion 271 may have a square column or cylindrical shape.

In one example, FIG. 46 shows a second pattern 270*b* as another water-repellent pattern 270 in an embodiment of the present disclosure. Referring to FIG. 46, in an embodiment of the present disclosure, the concave portions 275 may include a first concave portion 276 and a second concave portion 277.

Each of a plurality of first concave portions 276 may extend along a first direction parallel to the surface 269, and the plurality of first concave portions 276 may be arranged along a second direction perpendicular to the first direction. Each of a plurality of second concave portions 277 may extend along the second direction and the plurality of second concave portions may be arranged along the first direction.

The concave portions 275 may be arranged so that the first concave portions 276 and the second concave portions 277 may be arranged in a lattice form. Each of convex portions 271 may be disposed between the concave portions 275 and surrounded with the concave portions 275.

For example, the first direction may be the front and rear direction of the dispenser 200, and the second direction may be a left and right direction of the dispenser 200. That is, in the second pattern 270*b* of the water-repellent pattern 270, the concave portions 275 may include the first concave portions 276 extending in the front and rear direction of the dispenser 200 and the second concave portions 277 extending in the left and right direction of the dispenser 200, and each convex portion 271 may be surrounded in all directions with the first concave portions 276 and the second concave portions 277.

However, the first and second directions may be determined in various ways in addition to the front and rear direction and the left and right direction of the dispenser 200. The second pattern 270*b* may have a narrow width of the concave portion 275, and accordingly, may be advantageous in preventing water from penetrating into the concave portion 275.

In one example, FIG. 47 shows a third pattern 270*c* of the water-repellent pattern 270 in an embodiment of the present disclosure. As shown in FIG. 47, in an embodiment of the present disclosure, the convex portion 271 may include a first convex portion 272 and a second convex portion 273.

The plurality of first convex portion 272 extends in a first direction parallel to the surface 269 and may be arranged in a second direction crossing the first direction. The plurality of second convex portion 273 may extend along the second direction and may be arranged along the first direction. The convex portions 271 may be arranged such that the first convex portions 272 and the second convex portions 273 are arranged in a lattice form. Each of the concave portions 275 may be defined between the convex portions 271 and surrounded with the convex portions 271.

For example, in the third pattern 270*c* of the water-repellent pattern 270, the convex portion 271 may include the first convex portions 272 extending in the front and rear direction of the dispenser 200 and the second convex portions 273 extending in the left and right direction of the dispenser 200. Each concave portion 275 may correspond to a groove surrounded with the first convex portion 272 and the second convex portion 273 in all directions.

However, the first and second directions may be determined in various ways in addition to the front and rear direction and the left and right direction of the dispenser 200. The third pattern 270*c* may be advantageous to reduce the cross-sectional area of the convex portion 271 and reduce the contact area thereof with water.

Further, the convex portion 271 may have a protrusion height of an intersection 274 where the first convex portion 272 and the second convex portion 273 intersect with each other, as shown in FIG. 47. The protrusion height of the intersection 274 may be larger than that of the remaining portion of the convex portion 271 except for the intersection 274.

As above, an embodiment of the present disclosure may reduce the contact area between the surface 269 of the water supply 260 and water or water droplets due to the water-repellent pattern 270 having the convex portions 271 and the concave portions 275 and thus may lower the contact force therebetween. At the same time, the convex portion 271 may have portions having different protrusion heights, thereby to prevent water from adhering to the surface 269 of the water supply 260.

For example, in the convex portion 271, the intersection 274 between the first convex portion 272 and the second convex portion 273 may correspond to a relative protrusion, while the remaining portion thereof except for intersection 274 may correspond to a relative depression. This construction may be beneficial in preventing water from adhering to the water-repellent pattern 270.

In one example, in an embodiment of the present disclosure, the water-repellent pattern 270 may be constructed such that the convex portions 271 and the concave portions 275 may be alternately arranged with each other along the first direction parallel to the surface 269.

FIG. 48 illustrates a fourth pattern 270*d* of the water-repellent pattern 270 according to an embodiment of the present disclosure. The water-repellent pattern 270 may have a concave-convex form or a wave form in which the convex portions 271 and the concave portions 275 are alternately repeatedly arranged with each other only in the first direction as in the fourth pattern 270*d*, instead of a lattice form in which the convex portions 271 and the concave portions 275 are repeatedly arranged along the first and second directions.

In one example, in an embodiment of the present disclosure, in the fourth pattern 270*d* of the water-repellent pattern 270 shown in FIG. 48, each of the convex portions 271 and the concave portions 275 may extend in the first direction parallel to the surface 269 and crossing the second direction, and the convex portions 271 and the concave portions 275 may be arranged alternately with each other along the second direction.

For example, each of the convex portions 271 and concave portions 275 may extend along the first direction parallel to surface 269 of water supply 260. The convex portions 271 and the concave portions 275 may be arranged alternately with each other along the second direction perpendicular to the first direction. However, when necessary, the plurality of water-repellent patterns 270 repeated in the first direction as suggested in the fourth pattern 270*d* may be arranged in the second direction.

The water-repellent pattern 270 which may have various forms as above may be formed on the surface of the detergent water supply 261, the detergent cup water supply 263, and the shower means. The shower means may include the front shower means 265 and the rear shower means 267.

Referring again to FIG. 44, in an embodiment of the present disclosure, the detergent water supply 261 may further include an anti-splash rib 268. The anti-splash rib 268 may protrude toward the detergent storage 300, and may extend along the circumference of the surface 269 of the detergent water supply 261 to prevent water splashing.

The detergent water supply 261 may supply water to the detergent container 340 of the detergent storage 300. In this process, a portion of the water splashed from the detergent water supply 261 may be transferred to parts other than the detergent container 340 in the detergent storage 300. The water may be transferred to a portion other than the water supply 260 where the water-repellent pattern 270 is not formed on the bottom face of the dispenser 200, and may be adhered to the portion.

When water falling down or splashing from the detergent water supply 261 out of the detergent container 340 or water splashing from the detergent container 340 is delivered to a part other than the detergent container 340 in the detergent storage 300, and when the user extends the detergent storage 300 to the outside of the cabinet 10 before and after the washing process, the user may use the detergent storage 300 in a wet state, which may cause inconvenience.

Further, when water splashes on a portion other than the surface 269 of the water supply 260 where the water-repellent pattern 270 is formed in the dispenser 200, water may continue to remain on that portion until evaporation, and thus mold, etc. may be generated, which may degrade hygiene.

Accordingly, in an embodiment of the present disclosure, the anti-splash rib 268 may protrude downward and extend to surround at least a portion of the circumference of the surface 269 of the detergent water supply 261, thereby to effectively prevent water splashing out of the detergent water supply 261.

The anti-splash rib 268 may be disposed in the detergent cup water supply 263 or the shower means in addition to the detergent water supply 261. When the detergent cup water supply 263 has the anti-splash rib 268, the anti-splash rib 268 may be constructed to surround the entire surface 269 of the detergent water supply 261 and the detergent cup water supply 263 which are disposed to be adjacent to each other in the front and rear direction according to an embodiment of the present disclosure.

That is, as shown in FIG. 44, the anti-splash rib 268 may have a shape extending along both of the circumference of the detergent water supply 261 and the circumference of the detergent cup water supply 263.

Although the present disclosure has been illustrated and described in connection with the specific embodiments, it will be apparent to those of ordinary skill in the art that the present disclosure may be variously improved and changed without departing from the technical idea of the present disclosure defined by the following claims.

What is claimed is:

1. A laundry treating apparatus comprising:

a cabinet defining an opening at a front side of the cabinet;

a tub disposed in the cabinet;

a drum configured to rotate in the tub; and a detergent storage configured to receive a detergent, the detergent storage being configured to be inserted into and drawn out from the cabinet through the opening, wherein the detergent storage includes:

a detergent storage frame having an open top and configured to be inserted into and drawn out from the cabinet through the opening;

a locking bar disposed at the detergent storage frame and configured to restrict a distance that the detergent storage is drawn out from the cabinet; and a detergent cup configured to be received in the detergent storage frame through the open top of the detergent storage frame and configured to receive the detergent, the detergent cup including a separation preventing protrusion that protrudes from a side wall of the detergent cup, wherein at least a portion of the locking bar is located above the separation preventing protrusion and configured to restrict an upward movement of the separation prevention protrusion to thereby restrict movement of the detergent cup relative to the detergent storage frame.

2. The laundry treating apparatus of claim 1, wherein the detergent storage frame has a detergent containing wall protruding upward from a bottom face of the detergent storage frame and defines a detergent containing region surrounded by the detergent containing wall, wherein the detergent cup is located at the detergent containing region, and wherein the locking bar is disposed at the detergent containing wall.

3. The laundry treating apparatus of claim 2, wherein a first portion of the detergent cup has a larger width than a second portion of the detergent cup, wherein the first portion of the detergent cup has a wide width portion that extends laterally beyond the second portion of the detergent cup, and wherein the separation preventing protrusion protrudes from a wall of the wide width portion in a first direction away from the front side of the cabinet.

4. The laundry treating apparatus of claim 3, wherein a top face of the separation preventing protrusion is inclined downward in a direction away from the wall of the wide width portion.

5. The laundry treating apparatus of claim 3, further comprising:

a fixing portion disposed in the cabinet and located above the detergent storage, the fixing portion including a stopper that protrudes toward the detergent storage, wherein the locking bar includes a locking protrusion that protrudes toward the fixing portion, wherein at least a portion of the stopper of the fixing portion is spaced apart from the locking protrusion of the locking bar, and wherein the locking protrusion of the locking bar is configured to, based on the detergent storage being drawn out from the cabinet, contact the stopper and restrict the distance of the detergent storage being drawn out from the cabinet.

6. The laundry treating apparatus of claim 5, wherein the detergent containing wall includes a detergent containing rear wall located at a rear of the detergent cup relative to the front side of the cabinet, wherein the locking bar extends from the detergent containing rear wall toward the wide width portion, and wherein the locking bar includes a free end that is positioned above the separation preventing protrusion and is downwardly movable.

7. The laundry treating apparatus of claim 6, wherein, based on the locking protrusion contacting the stopper, the free end of the locking bar and the detergent cup are at least partially exposed outward of the cabinet through the opening.

8. The laundry treating apparatus of claim 6, wherein the fixing portion further includes a guide protrusion that extends from the stopper in the first direction and is configured to guide the free end of the locking bar to be positioned below the stopper, wherein the locking protrusion defines a penetration groove that faces toward the guide protrusion of the fixing portion, and wherein the locking protrusion is configured to contact the stopper based on (i) the detergent storage being drawn out from the cabinet and (ii) the guide protrusion being inserted into the penetration groove and moving toward the front side of the cabinet.

9. The laundry treating apparatus of claim 2, wherein the detergent containing wall includes:

detergent containing side walls that is located on opposing sides of the detergent cup; and a detergent containing front wall that is spaced apart from a front face of the detergent cup toward the front side of the cabinet and that is connected to the detergent containing side walls, wherein the laundry treating apparatus further includes a detergent container that is disposed between the detergent containing front wall and the detergent cup at the detergent containing region, and wherein the detergent is configured to be injected into the detergent container through an open top of the detergent container.

10. The laundry treating apparatus of claim 9, wherein the detergent storage frame further includes a blocking portion that is disposed between the detergent cup and the detergent container and that is configured to block a movement of the detergent cup toward the front side of the cabinet.

11. The laundry treating apparatus of claim 10, wherein a detergent outlet is configured to discharge the detergent and is disposed at a detergent containing bottom face surrounded by the detergent containing wall at the detergent containing region, wherein the detergent outlet is located below the detergent cup, wherein the detergent cup has a cup discharge portion configured to discharge the detergent at a bottom of the detergent cup, and wherein the blocking portion is spaced upwardly apart from the detergent containing bottom face to thereby provide fluid communication between the detergent container and the detergent outlet.

12. The laundry treating apparatus of claim 11, wherein the detergent cup has an open top face configured to introduce the detergent into the detergent cup, wherein the detergent containing wall further includes a detergent containing rear wall that is located at a rear of the detergent cup relative to the front side of the cabinet and that is connected to the detergent containing side walls, wherein the detergent containing rear wall includes a rear spacer protrusion that protrudes from the detergent containing rear wall toward the detergent cup and spaces the detergent containing rear wall from the detergent cup.

13. The laundry treating apparatus of claim 12, wherein the detergent cup further includes a spacer rib protruding from a face of the detergent cup that faces toward the detergent containing rear wall, the spacer rib facing the rear spacer protrusion and contacting the rear spacer protrusion.

14. The laundry treating apparatus of claim 11, wherein the detergent cup further includes a detergent cup leg that protrudes from a bottom face of the detergent cup toward the detergent containing bottom face and spaces the bottom face of the detergent cup apart from the detergent containing bottom face.

15. The laundry treating apparatus of claim 14, wherein the detergent cup leg further includes a leg reinforcing rib that protrudes from the detergent cup leg and that is connected to the bottom face of the detergent cup.

16. The laundry treating apparatus of claim 3, wherein the first portion of the detergent cup is positioned closer to the front side of the cabinet than the second portion of the detergent cup is.

17. The laundry treating apparatus of claim 6, wherein the detergent containing wall includes:

detergent containing side walls that is located on opposing sides of the detergent cup; and a detergent containing front wall that is spaced apart from a front face of the detergent cup toward the front side of the cabinet and that is connected to the detergent containing side walls, wherein the laundry treating apparatus further includes a detergent container that is disposed between the detergent containing front wall and the detergent cup at the detergent containing region, and wherein the detergent is configured to be injected into the detergent container through an open top of the detergent container.

18. The laundry treating apparatus of claim 17, wherein the detergent containing front wall is positioned closer to the front side of the cabinet than the detergent containing rear wall is.

19. The laundry treating apparatus of claim 10, wherein the blocking portion extends along a direction transverse an axis of rotation of the drum.

20. The laundry treating apparatus of claim 12, wherein the detergent containing front wall is positioned closer to the front side of the cabinet than the detergent containing rear wall is.

* * * * *